US009934640B2

(12) United States Patent
Blake et al.

(10) Patent No.: US 9,934,640 B2
(45) Date of Patent: Apr. 3, 2018

(54) SYSTEM, METHOD AND APPARATUS FOR REPURPOSING CURRENCY

(71) Applicant: Cummins-Allison Corp., Mt. Prospect, IL (US)

(72) Inventors: John R. Blake, St. Charles, IL (US); Curtis Hallowell, Palatine, IL (US); William Jones, Barrington, IL (US); Marianne Krbec, Wood Dale, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 14/752,474

(22) Filed: Jun. 26, 2015

(65) Prior Publication Data

US 2015/0302678 A1 Oct. 22, 2015

Related U.S. Application Data

(63) Continuation-in-part of application No. 13/836,117, filed on Mar. 15, 2013, which is a (Continued)

(51) Int. Cl.
*G07D 9/00* (2006.01)
*G07D 9/04* (2006.01)
(Continued)

(52) U.S. Cl.
CPC ..... *G07D 9/06* (2013.01); *G07D 9/00* (2013.01); *G07D 9/004* (2013.01); *G07F 9/08* (2013.01)

(58) Field of Classification Search
CPC ..... G07D 9/004; G07D 9/006; G07D 9/06; G07D 9/065; G07D 9/00; G07D 9/002;
(Continued)

(56) References Cited

U.S. PATENT DOCUMENTS 1,099,706 A 6/1914 Lindeen
2,570,920 A 10/1951 Clough et al. ..... 232/16
(Continued)

FOREIGN PATENT DOCUMENTS

CA 2235925 C 11/1995 ..... G07D 9/00
CA 2189330 C 12/2000 ..... G07F 17/42
(Continued)

OTHER PUBLICATIONS

Office Action in Canadian Patent Application No. 2,845,729, dated Mar. 24, 2016 (5 pages).
(Continued)

*Primary Examiner* — Jeffrey Shapiro
(74) *Attorney, Agent, or Firm* — Greer, Burns & Crain, Ltd

(57) ABSTRACT

A method of repurposing coins includes the acts of discharging processed mixed coins into a coin bin, receiving a first request for a number of or value of coins of a first denomination from an authorized person, outputting the mixed coins from the coin bin onto a coin conveyor responsive to the received first request, conveying the mixed coins output from the coin bin, using the coin conveyor, to the coin processing machine for repurposing, and discharging the coins of the first denomination from the coin processing machine to a secure coin cassette and discharging coins of a denomination other than the first denomination back to the coin bin. These acts of outputting, conveying and discharging are continued until the number of or value of coins of the first denomination have been discharged to the secure coin cassette.

16 Claims, 33 Drawing Sheets

Related U.S. Application Data continuation-in-part of application No. 11/227,861, filed on Sep. 15, 2005, now Pat. No. 8,523,641, application No. 14/752,474, filed on Jun. 26, 2015, which is a continuation-in-part of application No. 11/726,828, filed on Mar. 23, 2007, now abandoned.

(60) Provisional application No. 60/610,050, filed on Sep. 15, 2004, provisional application No. 60/793,573, filed on Apr. 20, 2006, provisional application No. 60/785,251, filed on Mar. 23, 2006.

(51) Int. Cl.
*G07D 9/06* (2006.01)
*G07F 9/08* (2006.01)

(58) Field of Classification Search
CPC ..... G07D 9/008; G07D 9/04; G07D 13/00; G07D 3/00; G07D 3/128; G07D 3/14; G07D 3/16; G07D 5/00; G07D 2201/00; B65H 2402/45; B65H 31/26; B65B 11/04; B65B 11/045; B65B 35/50; G07F 9/06; G07F 9/08
USPC ..... 194/207, 350; 209/534; 453/6, 7, 10–13, 453/30–35, 49, 55–59, 61, 62
See application file for complete search history.

(56) References Cited

U.S. PATENT DOCUMENTS 2,669,998 A 2/1954 Buchholz ..... 133/8
2,750,949 A 6/1956 Kulo et al. ..... 133/8
2,835,260 A 5/1958 Buchholz ..... 133/8
2,865,561 A 12/1958 Rosapepe ..... 232/7
3,095,084 A 6/1963 Byron
3,132,654 A 5/1964 Adams ..... 133/1
3,376,970 A 4/1968 Roseberg ..... 198/40
3,457,695 A * 7/1969 McCollough ..... B65B 9/213 53/254
3,771,583 A 11/1973 Bottemiller ..... 160/327
3,778,595 A 12/1973 Hatanaka et al. ..... 235/61.7 B
3,851,755 A 12/1974 Hull et al.
3,916,922 A 11/1975 Prumm ..... 133/3 R
3,998,237 A 12/1976 Kressin ..... 133/3 A
3,998,379 A 12/1976 Myers et al. ..... 229/33
4,050,218 A 9/1977 Call ..... 53/167
4,059,122 A 11/1977 Kinoshita ..... 133/3 D
4,075,460 A 2/1978 Gorgens ..... 235/420
4,124,111 A 11/1978 Hayashi ..... 194/102
4,150,740 A 4/1979 Douno ..... 194/4 C
4,166,945 A 9/1979 Inoyama et al. ..... 235/379
4,172,462 A 10/1979 Uchida et al. ..... 133/3 A
4,179,685 A 12/1979 O'Maley ..... 340/146.3 H
4,179,723 A 12/1979 Spencer ..... 361/384
4,184,366 A 1/1980 Butler ..... 73/163
4,197,986 A 4/1980 Nagata ..... 235/379
4,208,549 A 6/1980 Polillo et al. ..... 179/6.3 R
4,228,812 A 10/1980 Marti ..... 133/3 F
4,232,295 A 11/1980 McConnell ..... 340/152 R
4,234,003 A 11/1980 Ristvedt et al. ..... 133/3
4,249,552 A 2/1981 Margolin et al. ..... 133/1 R
4,251,867 A 2/1981 Uchida et al. ..... 364/408
4,286,703 A 9/1981 Schuller et al. ..... 194/100 A
RE30,773 E 10/1981 Glaser et al. ..... 235/379
4,310,885 A 1/1982 Azcua et al. ..... 364/405
4,317,957 A 3/1982 Sendrow ..... 178/22.08
4,341,951 A 7/1982 Benton ..... 235/379
4,355,369 A 10/1982 Garvin ..... 364/900
4,360,034 A 11/1982 Davila et al. ..... 133/3 D
4,369,442 A 1/1983 Werth et al. ..... 340/825.35
4,380,316 A 4/1983 Glinka et al. ..... 232/16
4,383,540 A 5/1983 DeMeyer et al. ..... 133/3 H
4,385,285 A 5/1983 Horst et al. ..... 382/3
4,412,292 A 10/1983 Sedam et al. ..... 364/479
4,416,299 A 11/1983 Bergman ..... 133/1 R
4,417,136 A 11/1983 Rushby et al. ..... 235/379
4,423,316 A 12/1983 Sano et al. ..... 235/379
4,434,359 A 2/1984 Watanabe ..... 235/379
4,436,103 A 3/1984 Dick ..... 133/3 D
4,454,414 A 6/1984 Benton ..... 235/379
4,474,197 A 10/1984 Kinoshita et al. ..... 133/4 A
4,488,116 A 12/1984 Plesko ..... 324/236
4,531,531 A 7/1985 Johnson et al. ..... 133/3
4,543,969 A 10/1985 Rasmussen ..... 133/3
4,549,561 A 10/1985 Johnson et al. ..... 133/3
4,556,140 A 12/1985 Okada ..... 194/4 C
4,558,711 A 12/1985 Yoshiaki et al. ..... 133/3 F
4,564,036 A 1/1986 Ristvedt ..... 133/3
4,570,655 A 2/1986 Raterman ..... 133/3
4,594,664 A 6/1986 Hashimoto ..... 364/405
4,602,332 A 7/1986 Hirose et al. ..... 364/408
4,607,649 A 8/1986 Taipale et al. ..... 133/3 C
4,620,559 A 11/1986 Childers et al. ..... 133/3 R
4,641,239 A 2/1987 Takesako ..... 364/408
4,674,260 A 6/1987 Rasmussen et al. ..... 53/212
4,681,128 A 7/1987 Ristvedt et al. ..... 453/6
4,705,154 A 11/1987 Masho et al. ..... 194/319
4,718,218 A 1/1988 Ristvedt ..... 53/532
4,731,043 A 3/1988 Ristvedt et al. ..... 453/6
4,733,765 A 3/1988 Watanabe ..... 194/206
4,749,074 A 6/1988 Ueki et al. ..... 194/317
4,753,624 A 6/1988 Adams et al. ..... 453/10
4,753,625 A 6/1988 Okada ..... 453/32
4,765,464 A 8/1988 Ristvedt ..... 206/0.82
4,766,548 A 8/1988 Cedrone et al. ..... 364/479
4,775,353 A 10/1988 Childers et al. ..... 453/6
4,775,354 A 10/1988 Rasmussen et al. ..... 453/10
4,778,983 A 10/1988 Ushikubo ..... 235/381
4,803,347 A 2/1989 Sugahara et al. ..... 235/379
4,804,830 A 2/1989 Miyagisima et al. ..... 235/379
4,812,629 A 3/1989 O'Neil et al. ..... 235/383
4,839,505 A 6/1989 Bradt et al. ..... 235/381
4,840,290 A 6/1989 Nakamura
4,844,369 A 7/1989 Kanayachi
4,848,556 A 7/1989 Shah et al. ..... 194/212
4,863,414 A 9/1989 Ristvedt et al. ..... 453/6
4,883,158 A 11/1989 Kobayashi et al. ..... 194/217
4,884,212 A 11/1989 Stutsman ..... 364/479
4,900,909 A 2/1990 Nagashima et al. ..... 235/487
4,908,516 A 3/1990 West ..... 250/556
4,921,463 A 5/1990 Primdahl et al. ..... 453/3
4,936,435 A 6/1990 Griner ..... 194/317
4,953,086 A 8/1990 Fukatsu ..... 364/408
4,954,697 A 9/1990 Kokubun et al. ..... 235/381
4,964,495 A 10/1990 Rasmussen ..... 194/344
4,966,570 A 10/1990 Ristvedt et al. ..... 453/6
4,970,655 A 11/1990 Winn et al. ..... 364/479
4,971,187 A 11/1990 Furuya et al. ..... 194/318
4,988,849 A 1/1991 Sasaki et al. ..... 235/379
4,992,647 A 2/1991 Konishi et al. ..... 235/379
4,995,848 A 2/1991 Goh ..... 453/3
5,009,627 A 4/1991 Rasmussen ..... 453/10
5,010,238 A 4/1991 Kadono et al. ..... 235/379
5,010,485 A 4/1991 Bigari ..... 364/408
5,011,455 A 4/1991 Rasmussen ..... 453/10
5,022,889 A 6/1991 Ristvedt et al. ..... 453/6
5,025,139 A 6/1991 Halliburton, Jr. ..... 235/379
5,026,320 A 6/1991 Rasmussen ..... 453/6
5,031,098 A 7/1991 Miller et al. ..... 364/405
5,033,602 A 7/1991 Saarinen et al. ..... 194/334
5,039,848 A 8/1991 Stoken ..... 235/381
5,055,086 A 10/1991 Raterman et al. ..... 453/10
5,055,657 A 10/1991 Miller et al. ..... 235/381
5,056,643 A 10/1991 Kirberg
5,064,999 A 11/1991 Okamoto et al. ..... 235/379
5,067,928 A 11/1991 Harris
5,080,633 A 1/1992 Ristvedt et al. ..... 435/6
5,091,713 A 2/1992 Horne et al. ..... 340/541
5,104,353 A 4/1992 Ristvedt et al. ..... 453/6
5,105,601 A 4/1992 Horiguchi et al. ..... 53/465
5,106,338 A 4/1992 Rasmussen et al. ..... 453/10
5,111,927 A 5/1992 Schulze ..... 194/209

(56) References Cited

U.S. PATENT DOCUMENTS 5,114,381 A 5/1992 Ueda et al. 453/57
5,120,945 A 6/1992 Nishibe et al. 235/379
5,123,873 A 6/1992 Rasmussen 453/10
5,129,205 A 7/1992 Rasmussen 53/52
5,135,435 A 8/1992 Rasmussen 453/56
5,140,517 A 8/1992 Nagata et al. 364/408
5,141,443 A 8/1992 Rasmussen et al. 453/10
5,141,472 A 8/1992 Todd et al. 453/10
5,145,455 A 9/1992 Todd 453/6
5,146,067 A 9/1992 Sloan et al. 235/381
5,154,272 A 10/1992 Nishiumi et al. 194/318
5,163,866 A 11/1992 Rasmussen 453/10
5,163,867 A 11/1992 Rasmussen 453/10
5,163,868 A 11/1992 Adams et al. 453/11
5,167,313 A 12/1992 Dobbins et al. 194/317
5,175,416 A 12/1992 Mansvelt et al. 235/379
5,176,565 A 1/1993 Ristvedt et al. 453/6
5,179,517 A 1/1993 Sarbin et al. 364/410
5,183,142 A 2/1993 Latchinian et al. 194/206
5,184,709 A 2/1993 Nishiumi et al. 194/318
5,194,037 A 3/1993 Jones et al. 453/10
5,197,919 A 3/1993 Geib et al. 453/10
5,205,780 A 4/1993 Rasmussen 453/10
5,207,784 A 5/1993 Schwartzendruber 221/6
5,209,696 A 5/1993 Rasmussen et al. 453/10
5,236,071 A 8/1993 Lee 194/200
5,243,174 A 9/1993 Veeneman et al. 235/381
5,251,738 A 10/1993 Dabrowski 194/206
5,252,811 A 10/1993 Henochowicz et al. 235/379
5,253,167 A 10/1993 Yoshida et al. 364/408
5,259,491 A 11/1993 Ward, II
5,263,566 A 11/1993 Nara et al. 194/318
5,265,874 A 11/1993 Dickinson et al. 273/138 A
5,268,561 A 12/1993 Kimura et al. 235/384
5,277,651 A 1/1994 Rasmussen et al. 453/10
5,282,127 A 1/1994 Mu 364/130
5,286,226 A 2/1994 Rasmussen 453/10
5,286,954 A 2/1994 Sato et al. 235/379
5,291,003 A 3/1994 Avnet et al. 235/381
5,291,560 A 3/1994 Daugman 382/2
5,293,981 A 3/1994 Abe et al. 194/345
5,297,030 A 3/1994 Vassigh et al. 364/405
5,297,598 A 3/1994 Rasmussen 141/314
5,297,986 A 3/1994 Ristvedt et al. 453/6
5,299,977 A 4/1994 Mazur et al. 453/10
5,302,811 A 4/1994 Fukatsu
5,324,922 A 6/1994 Roberts 235/375
5,326,104 A 7/1994 Pease et al. 273/138 A
5,370,575 A 12/1994 Geib et al. 453/3
5,372,542 A 12/1994 Geib et al. 453/10
5,374,814 A 12/1994 Kako et al. 235/379
5,379,344 A 1/1995 Larson et al. 380/23
5,379,875 A 1/1995 Shames et al. 194/317
5,382,191 A 1/1995 Rasmussen 453/11
5,390,776 A 2/1995 Thompson 194/346
5,401,211 A 3/1995 Geib et al. 453/10
5,404,986 A 4/1995 Hossfield et al. 194/317
5,410,590 A 4/1995 Blood et al. 379/147
RE34,934 E 5/1995 Raterman et al. 453/10
5,425,669 A 6/1995 Geib et al. 453/10
5,429,550 A 7/1995 Mazur et al. 453/10
5,440,108 A 8/1995 Tran et al. 235/381
5,443,419 A 8/1995 Adams et al.
5,450,938 A 9/1995 Rademacher 194/206
5,453,047 A 9/1995 Mazur et al. 453/10
5,458,285 A 10/1995 Remien
5,468,182 A 11/1995 Geib 453/10
5,470,079 A 11/1995 LeStrange et al. 273/138 A
5,474,495 A 12/1995 Geib et al. 453/3
5,474,497 A 12/1995 Jones et al. 453/17
5,480,348 A 1/1996 Mazur et al. 453/10
5,489,237 A 2/1996 Geib et al. 453/12
5,500,514 A 3/1996 Veeneman et al. 235/381
5,501,631 A 3/1996 Mennie et al. 453/3
5,507,379 A 4/1996 Mazur et al. 194/318
5,514,034 A 5/1996 Jones et al. 453/10
5,520,577 A 5/1996 Rasmussen 453/56
5,531,309 A 7/1996 Kloss et al.
5,538,468 A 7/1996 Ristvedt et al. 453/3
5,542,880 A 8/1996 Geib et al. 453/10
5,542,881 A 8/1996 Geib 453/10
5,553,320 A 9/1996 Matsuura et al. 235/379
5,559,887 A 9/1996 Davis et al. 380/24
5,564,546 A 10/1996 Molbak et al. 194/216
5,564,974 A 10/1996 Mazur et al. 453/10
5,564,978 A 10/1996 Jones et al. 453/17
5,570,465 A 10/1996 Tsakanikas 395/114
5,573,457 A 11/1996 Watts et al. 453/31
5,584,758 A 12/1996 Geib 453/10
5,592,377 A 1/1997 Lipkin 395/242
5,602,933 A 2/1997 Blackwell et al. 382/116
5,615,625 A 4/1997 Cassidy et al.
5,620,079 A 4/1997 Molbak 194/217
5,623,547 A 4/1997 Jones et al. 380/24
5,625,562 A 4/1997 Veeneman et al. 364/479.05
5,630,494 A 5/1997 Strauts 194/317
5,641,050 A 6/1997 Smith et al. 194/210
5,650,605 A 7/1997 Morioka et al. 235/379
5,650,761 A 7/1997 Gomm et al. 235/381
5,652,421 A 7/1997 Veeneman et al. 235/381
5,665,952 A 9/1997 Ziarno 235/380
5,679,070 A 10/1997 Ishida et al. 453/41
5,684,597 A 11/1997 Hossfield et al. 356/384
5,696,366 A 12/1997 Ziarno 235/380
5,743,373 A 4/1998 Strauts 194/318
5,746,299 A 5/1998 Molbak et al. 194/200
5,774,874 A 6/1998 Veeneman et al. 705/27
5,782,686 A 7/1998 Geib et al. 453/10
5,799,767 A 9/1998 Molbak 194/217
5,813,510 A 9/1998 Rademacher 194/206
5,823,315 A 10/1998 Hoffman et al. 194/203
5,830,054 A 11/1998 Petri 453/5
5,838,812 A 11/1998 Pare, Jr. et al. 382/115
5,842,188 A 11/1998 Ramsey et al. 705/416
5,842,916 A 12/1998 Gerrity et al. 453/57
5,850,076 A 12/1998 Morioka et al. 235/379
5,854,581 A 12/1998 Mori et al. 235/379
5,865,673 A 2/1999 Geib et al. 453/10
5,875,879 A 3/1999 Hawthorn
5,880,444 A 3/1999 Shibata et al. 235/379
5,892,211 A 4/1999 Davis et al. 235/380
5,892,827 A 4/1999 Beach et al. 380/24
5,909,793 A 6/1999 Beach et al. 194/210
5,909,794 A 6/1999 Molbak et al. 194/216
5,913,399 A 6/1999 Takemoto et al. 194/200
5,918,748 A 7/1999 Clark et al. 209/534
5,940,623 A 8/1999 Watts et al. 395/712
5,941,364 A 8/1999 Wei
5,944,162 A 8/1999 Filiberti
5,944,600 A 8/1999 Zimmermann 435/10
5,944,601 A 8/1999 Hayashi et al.
5,951,476 A 9/1999 Beach et al. 600/437
5,957,262 A 9/1999 Molbak et al. 194/200
5,988,348 A 11/1999 Martin et al. 194/317
5,995,949 A 11/1999 Morioka et al. 705/43
5,997,395 A 12/1999 Geib et al. 453/10
6,017,270 A 1/2000 Ristvedt et al. 453/5
6,021,883 A 2/2000 Casanova et al. 194/217
6,032,859 A 3/2000 Muehlberger et al. 235/449
6,039,644 A 3/2000 Geib et al. 453/10
6,039,645 A 3/2000 Mazur 453/10
6,042,470 A 3/2000 Geib et al. 453/10
6,047,807 A 4/2000 Molbak 194/217
6,047,808 A 4/2000 Neubarth et al. 194/317
6,056,104 A 5/2000 Neubarth et al. 194/317
6,076,649 A 6/2000 Waldorff, Jr.
6,080,056 A 6/2000 Karlsson 453/3
6,082,519 A 7/2000 Martin et al. 194/350
6,086,471 A 7/2000 Zimmermann 453/3
6,095,313 A 8/2000 Molbak et al. 194/344
6,116,402 A 9/2000 Beach et al. 194/216
6,131,625 A 10/2000 Casanova et al. 141/314
6,139,418 A 10/2000 Geib et al. 453/10
6,142,285 A 11/2000 Panzeri et al. 194/328

(56) References Cited

U.S. PATENT DOCUMENTS 6,145,738 A 11/2000 Stinson et al. ..... 235/379
6,154,879 A 11/2000 Pare, Jr. et al. ..... 902/3
6,168,001 B1 1/2001 Davis ..... 194/200
6,171,182 B1 1/2001 Geib et al. ..... 453/10
6,174,230 B1 1/2001 Gerrity et al. ..... 453/57
6,196,371 B1 3/2001 Martin et al. ..... 194/317
6,196,913 B1 3/2001 Geib et al. ..... 453/10
6,202,006 B1 3/2001 Scott
6,213,277 B1 4/2001 Blad et al.
6,230,928 B1 5/2001 Hanna et al. ..... 221/13
6,264,545 B1 7/2001 Magee et al. ..... 453/3
6,302,294 B1 10/2001 Collier
6,308,887 B1 10/2001 Korman et al. ..... 235/379
6,318,536 B1 11/2001 Korman et al. ..... 194/217
6,318,537 B1 * 11/2001 Jones ..... G07D 1/04 194/346
6,349,972 B1 2/2002 Geiger et al. ..... 283/67
6,412,620 B1 7/2002 Imura ..... 194/317
6,431,342 B1 8/2002 Schwartz ..... 194/346
6,438,230 B1 8/2002 Moore ..... 380/42
6,456,928 B1 9/2002 Johnson ..... 701/114
6,471,030 B1 10/2002 Neubarth et al. ..... 194/317
6,474,548 B1 11/2002 Montross et al. ..... 235/379
6,484,863 B1 11/2002 Molbak ..... 194/216
6,484,884 B1 11/2002 Gerrity et al. ..... 209/233
6,494,776 B1 12/2002 Molbak ..... 453/32
6,499,277 B1 12/2002 Warner et al. ..... 53/447
6,503,138 B2 1/2003 Spoehr et al. ..... 453/10
6,520,308 B1 2/2003 Martin et al. ..... 194/317
6,522,772 B1 2/2003 Morrison et al. ..... 382/124
6,547,131 B1 4/2003 Foodman et al. ..... 235/380
6,552,781 B1 4/2003 Rompel et al. ..... 256/71
6,554,185 B1 4/2003 Montross et al. ..... 235/379
6,579,165 B2 6/2003 Kuhlin et al. ..... 453/3
6,581,042 B2 6/2003 Pare, Jr. et al. ..... 705/40
6,602,125 B2 8/2003 Martin ..... 453/12
6,609,604 B1 8/2003 Jones et al. ..... 194/302
6,612,921 B2 9/2003 Geib et al. ..... 453/13
6,637,576 B1 10/2003 Jones et al. ..... 194/216
6,640,956 B1 11/2003 Zwieg et al. ..... 194/328
6,644,696 B2 11/2003 Brown et al. ..... 283/67
6,652,380 B1 11/2003 Luciano
6,655,585 B2 12/2003 Shinn ..... 235/382
6,659,259 B2 12/2003 Knox et al. ..... 194/217
6,662,166 B2 12/2003 Pare, Jr. et al. ..... 705/39
6,663,675 B2 12/2003 Blake et al. ..... 753/63
6,666,318 B2 12/2003 Gerrity et al. ..... 194/347
6,719,121 B2 4/2004 Alexander et al.
6,755,730 B2 6/2004 Geib et al. ..... 453/3
6,758,316 B2 7/2004 Molbak ..... 194/200
6,761,308 B1 7/2004 Hanna et al. ..... 235/379
6,766,892 B2 7/2004 Martin et al. ..... 194/317
6,783,452 B2 8/2004 Hino et al. ..... 453/3
6,783,785 B1 8/2004 Raghavan et al. ..... 426/489
6,786,398 B1 9/2004 Stinson et al. ..... 235/379
6,854,581 B2 2/2005 Molbak ..... 194/344
6,854,640 B2 2/2005 Peklo ..... 235/100
6,863,168 B1 3/2005 Gerrity et al. ..... 194/347
6,892,871 B2 5/2005 Strauts et al. ..... 194/302
6,896,118 B2 5/2005 Jones et al. ..... 194/217
6,928,546 B1 8/2005 Nanavati et al. ..... 713/186
6,950,810 B2 9/2005 Lapsley et al. ..... 705/78
6,953,150 B2 10/2005 Shepley et al. ..... 235/379
6,957,746 B2 10/2005 Martin et al. ..... 221/131
6,966,417 B2 11/2005 Peklo et al. ..... 194/344
6,976,570 B2 12/2005 Molbak ..... 194/215
6,988,606 B2 1/2006 Geib et al. ..... 194/334
6,991,530 B2 1/2006 Hino et al. ..... 453/3
7,004,831 B2 2/2006 Hino et al. ..... 453/5
7,014,029 B2 3/2006 Winters ..... 194/302
7,014,108 B2 3/2006 Sorenson et al. ..... 235/381
7,017,729 B2 3/2006 Gerrity et al. ..... 194/347
7,018,286 B2 3/2006 Blake et al. ..... 453/61
7,028,827 B1 4/2006 Molbak et al. ..... 194/346
7,036,651 B2 5/2006 Tam et al. ..... 194/217
7,083,036 B2 8/2006 Adams ..... 194/223
7,111,754 B1 9/2006 Siemens
7,113,929 B1 9/2006 Beach et al. ..... 705/65
7,131,580 B2 11/2006 Molbak ..... 235/379
7,149,336 B2 12/2006 Jones et al. ..... 382/135
7,152,727 B2 12/2006 Waechter ..... 194/317
7,158,662 B2 1/2007 Chiles ..... 382/135
7,188,720 B2 3/2007 Geib et al. ..... 194/302
7,213,697 B2 5/2007 Martin et al. ..... 194/317
7,243,773 B2 7/2007 Bochonok et al. ..... 194/350
7,269,279 B2 9/2007 Chiles ..... 382/135
7,303,119 B2 12/2007 Molbak ..... 235/379
7,331,521 B2 2/2008 Sorenson et al. ..... 235/381
7,337,890 B2 3/2008 Bochonok et al. ..... 194/353
7,427,230 B2 9/2008 Blake et al. ..... 453/63
7,438,172 B2 10/2008 Long et al. ..... 194/347
7,464,802 B2 12/2008 Gerrity et al. ..... 194/347
7,500,568 B2 3/2009 Cousin ..... 209/534
7,520,374 B2 4/2009 Martin et al. ..... 194/317
7,551,764 B2 6/2009 Chiles et al. ..... 382/135
7,552,810 B2 6/2009 Mecklenburg ..... 194/317
7,580,859 B2 8/2009 Economy ..... 705/16
7,604,107 B2 10/2009 Thierry
7,654,450 B2 2/2010 Mateen et al. ..... 235/379
7,658,270 B2 2/2010 Bochonok et al. ..... 194/350
7,735,125 B1 6/2010 Alvarez et al. ..... 726/9
7,743,902 B2 6/2010 Wendell et al. ..... 194/302
7,778,456 B2 8/2010 Jones et al. ..... 382/135
7,819,308 B2 10/2010 Osterberg et al. ..... 235/379
7,874,478 B2 1/2011 Molbak ..... 235/379
7,886,890 B2 2/2011 Blake et al. ..... 194/347
7,931,304 B2 4/2011 Brown et al. ..... 283/57
7,946,406 B2 5/2011 Blake et al. ..... 194/200
7,963,382 B2 6/2011 Wendell et al. ..... 194/302
7,980,378 B2 7/2011 Jones et al. ..... 194/217
8,023,715 B2 9/2011 Jones et al. ..... 382/135
8,042,732 B2 10/2011 Blake et al. ..... 235/375
8,229,821 B2 7/2012 Mennie et al. ..... 232/16
8,393,455 B2 3/2013 Blake et al. ..... 194/350
8,443,958 B2 5/2013 Jones et al. ..... 194/215
RE44,252 E 6/2013 Jones et al. ..... 194/217
8,523,641 B2 9/2013 Kuykendall et al.
8,545,295 B2 10/2013 Blake et al.
8,640,945 B1 2/2014 McCormick
8,684,160 B2 4/2014 Hallowell
2001/0015310 A1 * 8/2001 Cole ..... G07D 9/00 194/229
2001/0034203 A1 10/2001 Geib et al. ..... 453/3
2001/0048025 A1 12/2001 Shinn ..... 235/382
2002/0035515 A1 3/2002 Moreno
2002/0065033 A1 5/2002 Geib et al. ..... 453/3
2002/0069104 A1 6/2002 Beach et al. ..... 705/14
2002/0074209 A1 6/2002 Karlsson ..... 194/330
2002/0077937 A1 6/2002 Lyons
2002/0085745 A1 7/2002 Jones et al.
2002/0095587 A1 7/2002 Doyle et al. ..... 713/186
2002/0107738 A1 8/2002 Beach et al. ..... 705/14
2002/0126885 A1 * 9/2002 Mennie ..... G06K 9/033 382/135
2002/0130011 A1 9/2002 Casanova et al. ..... 194/344
2002/0147588 A1 10/2002 Davis et al. ..... 704/246
2002/0151267 A1 10/2002 Kuhlin et al. ..... 453/3
2002/0174348 A1 11/2002 Ting ..... 713/186
2002/0179401 A1 12/2002 Knox et al. ..... 194/217
2003/0004878 A1 1/2003 Akutsu et al. ..... 705/43
2003/0013403 A1 1/2003 Blake et al. ..... 453/60
2003/0042110 A1 3/2003 Wilfong
2003/0081824 A1 5/2003 Mennie et al. ..... 382/135
2003/0127299 A1 7/2003 Jones et al. ..... 194/217
2003/0168309 A1 9/2003 Geib et al. ..... 194/302
2003/0168310 A1 9/2003 Strauts et al. ..... 194/302
2003/0182217 A1 9/2003 Chiles ..... 705/35
2003/0190882 A1 10/2003 Blake et al. ..... 453/63
2003/0230464 A1 12/2003 Deaville
2003/0234153 A1 12/2003 Blake et al. ..... 194/347
2004/0021898 A1 2/2004 Ashizaki
2004/0055902 A1 3/2004 Peklo ..... 206/0.815
2004/0092222 A1 5/2004 Kowalczyk et al. ..... 453/12
2004/0153406 A1 8/2004 Alarcon-Luther et al. ..... 705/41

(56) References Cited

U.S. PATENT DOCUMENTS

| | | | | |
|---|---|---|---|---|
| 2004/0153421 | A1 | 8/2004 | Robinson | 705/75 |
| 2004/0154899 | A1 | 8/2004 | Peklo et al. | 193/33 |
| 2004/0167821 | A1 | 8/2004 | Baumgartner | |
| 2004/0173432 | A1 | 9/2004 | Jones | 194/216 |
| 2004/0188221 | A1 | 9/2004 | Carter | 194/215 |
| 2004/0193310 | A1* | 9/2004 | Clark | C12Q 1/6886 700/215 |
| 2004/0195302 | A1 | 10/2004 | Washington et al. | |
| 2004/0199924 | A1 | 10/2004 | Ganesh et al. | 719/313 |
| 2004/0200691 | A1 | 10/2004 | Geib et al. | 194/302 |
| 2004/0231956 | A1* | 11/2004 | Adams | G07D 1/04 194/217 |
| 2004/0238319 | A1 | 12/2004 | Hand et al. | |
| 2004/0238614 | A1 | 12/2004 | Yoshioka et al. | |
| 2004/0254861 | A1 | 12/2004 | Pentel | |
| 2004/0256197 | A1 | 12/2004 | Blake et al. | 194/350 |
| 2005/0006197 | A1 | 1/2005 | Wendell et al. | 194/302 |
| 2005/0035140 | A1 | 2/2005 | Carter | 221/195 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0067305 | A1 | 3/2005 | Bochonok et al. | 206/8 |
| 2005/0068178 | A1 | 3/2005 | Lee | |
| 2005/0077142 | A1 | 4/2005 | Tam et al. | 194/217 |
| 2005/0086140 | A1* | 4/2005 | Ireland | B32B 27/36 705/35 |
| 2005/0087425 | A1 | 4/2005 | Peklo | 194/350 |
| 2005/0091161 | A1 | 4/2005 | Gustin | |
| 2005/0096986 | A1 | 5/2005 | Taylor et al. | |
| 2005/0098625 | A1 | 5/2005 | Walker et al. | 235/381 |
| 2005/0108165 | A1 | 5/2005 | Jones et al. | 705/43 |
| 2005/0109836 | A1 | 5/2005 | Ben-Aissa | 235/380 |
| 2005/0121507 | A1 | 6/2005 | Brown et al. | 235/379 |
| 2005/0124407 | A1 | 6/2005 | Rowe | 463/25 |
| 2005/0150740 | A1 | 7/2005 | Finkenzeller et al. | |
| 2005/0156318 | A1 | 7/2005 | Douglas | 257/761 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0256792 | A1 | 11/2005 | Shimizu et al. | 705/35 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0065717 | A1 | 3/2006 | Hurwitz et al. | 235/381 |
| 2006/0069654 | A1 | 3/2006 | Beach et al. | 705/65 |
| 2006/0112007 | A1 | 5/2006 | Hurwitz | |
| 2006/0146839 | A1 | 7/2006 | Hurwitz et al. | |
| 2006/0148394 | A1 | 7/2006 | Blake et al. | 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2006/0253332 | A1 | 11/2006 | Dobbins | |
| 2006/0283685 | A1 | 12/2006 | Cousin | |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1 | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0251800 | A1 | 11/2007 | Castleberry | |
| 2007/0269097 | A1 | 11/2007 | Chiles et al. | 382/135 |
| 2007/0270997 | A1 | 11/2007 | Brumfield et al. | |
| 2008/0033829 | A1 | 2/2008 | Mennie et al. | 705/16 |
| 2008/0044077 | A1 | 2/2008 | Mennie et al. | 382/135 |
| 2008/0135606 | A1 | 6/2008 | Weston | |
| 2008/0135608 | A1 | 6/2008 | Ireland et al. | |
| 2008/0220707 | A1 | 9/2008 | Jones et al. | 453/2 |
| 2008/0223930 | A1 | 9/2008 | Rolland et al. | |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0065623 | A1 | 3/2010 | Sauter | |
| 2010/0092065 | A1 | 4/2010 | Jones | |
| 2010/0198726 | A1 | 8/2010 | Doran et al. | 705/41 |
| 2010/0234985 | A1 | 9/2010 | Shuren et al. | |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Mennie et al. | 700/223 |
| 2011/0099105 | A1 | 4/2011 | Mennie et al. | 705/41 |
| 2011/0259961 | A1 | 10/2011 | Folk et al. | |
| 2011/0270695 | A1 | 11/2011 | Jones et al. | 705/43 |
| 2012/0067950 | A1 | 3/2012 | Blake | 235/381 |
| 2012/0156976 | A1 | 6/2012 | Blake et al. | 453/4 |
| 2012/0231720 | A1 | 9/2012 | Starke | |
| 2013/0178139 | A1 | 7/2013 | Hallowell et al. | |
| 2013/0199890 | A1 | 8/2013 | Blake | |
| 2013/0205723 | A1 | 8/2013 | Blake et al. | |

FOREIGN PATENT DOCUMENTS

| | | | | |
|---|---|---|---|---|
| CA | 2143943 | C | 3/2003 | G07D 3/16 |
| DE | 06 60 354 | | 5/1938 | G07F 17/26 |
| DE | 30 21 327 | A1 | 12/1981 | G07D 3/06 |
| EP | 0 351 217 | A2 | 1/1990 | G07F 9/04 |
| EP | 0 667 973 | B1 | 1/1997 | G07D 3/14 |
| EP | 0 926 634 | A2 | 6/1999 | G07D 3/14 |
| EP | 1 104 920 | A1 | 6/2001 | G07D 5/08 |
| EP | 1 209 639 | A2 | 5/2002 | G07F 19/00 |
| EP | 1 528 513 | A1 | 5/2005 | G07F 7/08 |
| FR | 2042254 | | 2/1971 | G07B 11/00 |
| GB | 2035642 | A | 6/1980 | G07F 7/10 |
| GB | 2175427 | A | 11/1986 | G07F 17/42 |
| GB | 2198274 | A | 6/1988 | G07D 3/00 |
| GB | 2458387 | A | 9/2009 | G07D 11/00 |
| GB | 2468783 | A | 9/2010 | C07D 9/00 |
| JP | 49-058899 | | 6/1974 | |
| JP | 52-014495 | | 2/1977 | G07F 5/10 |
| JP | 52-071300 | A | 6/1977 | G07F 5/22 |
| JP | 56-040992 | A | 4/1981 | G07F 5/18 |
| JP | 57-117080 | A | 7/1982 | G07D 3/16 |
| JP | 59-079392 | A | 5/1984 | G07D 3/16 |
| JP | 60-016271 | U | 2/1985 | G07F 7/02 |
| JP | 62-134168 | U | 8/1987 | G07B 1/00 |
| JP | 62-182995 | A | 8/1987 | G07F 7/08 |
| JP | 62-221773 | A | 9/1987 | G06F 15/30 |
| JP | 62-166562 | U | 10/1987 | G07B 1/00 |
| JP | 64-035683 | A | 2/1989 | G07D 9/00 |
| JP | 64-042789 | A | 2/1989 | G07F 9/00 |
| JP | 64-067698 | A | 3/1989 | G07F 7/08 |
| JP | 01-118995 | A | 5/1989 | G07G 1/00 |
| JP | 01-307891 | A | 12/1989 | G07D 9/00 |
| JP | 02-050793 | A | 2/1990 | G07D 9/00 |
| JP | 02-252096 | A | 10/1990 | G07D 9/00 |
| JP | 03-012776 | A | 1/1991 | G06F 15/30 |
| JP | 03-063795 | A | 3/1991 | G07D 3/00 |
| JP | 03-092994 | A | 4/1991 | G07D 9/00 |
| JP | 03-156673 | A | 7/1991 | G06F 15/30 |
| JP | 04-085695 | A | 3/1992 | G07F 11/72 |
| JP | 04-175993 | A | 6/1992 | G07D 5/22 |
| JP | 05-046839 | A | 2/1993 | G07D 5/02 |
| JP | 05-217048 | A | 8/1993 | G07D 3/16 |
| JP | 05-274527 | A | 10/1993 | G07D 9/00 |
| JP | 06-035946 | A | 2/1994 | G06F 15/30 |
| JP | 06-103285 | A | 4/1994 | G06F 15/21 |
| JP | 09-251566 | A | 9/1997 | G07F 7/08 |
| JP | 2002-117439 | A | 4/2002 | G07D 9/00 |
| JP | 2003-242287 | A | 8/2003 | G06F 17/60 |
| JP | 2004-213188 | A | 7/2004 | G06F 17/60 |
| SE | 44 244 | | 9/1988 | |
| WO | WO 85/00909 | A1 | 2/1985 | G07D 5/02 |

(56) References Cited

FOREIGN PATENT DOCUMENTS

| | | | | |
|---|---|---|---|---|
| WO | WO 91/06927 | A1 | 5/1991 | G07D 3/16 |
| WO | WO 91/08952 | A1 | 6/1991 | B65B 11/04 |
| WO | WO 91/12594 | A1 | 8/1991 | G07D 3/16 |
| WO | WO 91/18371 | A1 | 11/1991 | G07D 3/16 |
| WO | WO 92/08212 | A1 | 5/1992 | G07D 3/16 |
| WO | WO 92/20043 | A1 | 11/1992 | G07D 3/00 |
| WO | WO 92/20044 | A1 | 11/1992 | G07D 3/16 |
| WO | WO 92/22044 | A1 | 12/1992 | G07D 3/00 |
| WO | WO 93/00660 | A1 | 1/1993 | G07D 3/00 |
| WO | WO 93/09621 | A1 | 5/1993 | H04L 9/32 |
| WO | WO 94/06101 | A1 | 3/1994 | G07D 3/16 |
| WO | WO 94/08319 | A1 | 4/1994 | G07D 3/16 |
| WO | WO 94/23397 | A1 | 10/1994 | G07D 3/00 |
| WO | WO 95/02226 | A1 | 1/1995 | G07D 3/00 |
| WO | WO 95/04978 | A1 | 2/1995 | G07D 3/06 |
| WO | WO 95/06920 | A1 | 3/1995 | G07D 3/16 |
| WO | WO 95/09406 | A1 | 4/1995 | G07D 3/16 |
| WO | WO 95/13596 | A1 | 5/1995 | G07D 3/14 |
| WO | WO 95/19017 | A1 | 7/1995 | G07D 1/00 |
| WO | WO 95/23387 | A1 | 8/1995 | G07D 3/16 |
| WO | WO 95/30215 | A1 | 11/1995 | G07F 17/42 |
| WO | WO 96/07163 | A1 | 3/1996 | G07D 3/06 |
| WO | WO 96/07990 | A1 | 3/1996 | G07D 3/16 |
| WO | WO 96/12253 | A1 | 4/1996 | G07D 3/00 |
| WO | WO 96/27525 | A1 | 9/1996 | B65B 11/02 |
| WO | WO 96/27859 | A1 | 9/1996 | G07D 5/08 |
| WO | WO 97/22919 | A1 | 6/1997 | G06F 7/08 |
| WO | WO 97/25692 | A1 | 7/1997 | G07D 3/06 |
| WO | WO 98/24041 | A1 | 6/1998 | G06F 17/60 |
| WO | WO 98/24067 | A1 | 6/1998 | G07D 3/14 |
| WO | WO 98/48383 | A2 | 10/1998 | G07D 1/00 |
| WO | WO 98/48384 | A2 | 10/1998 | G07D 1/00 |
| WO | WO 98/48385 | A2 | 10/1998 | G07D 1/00 |
| WO | WO 98/51082 | A1 | 11/1998 | H04N 7/18 |
| WO | WO 98/59323 | A1 | 12/1998 | G07D 3/00 |
| WO | WO 99/00776 | A1 | 1/1999 | G07F 9/06 |
| WO | WO 99/06937 | A1 | 2/1999 | G06F 19/00 |
| WO | WO 99/16027 | A2 | 4/1999 | G07F 7/02 |
| WO | WO 99/33030 | A1 | 7/1999 | G07D 3/00 |
| WO | WO 99/41695 | A1 | 8/1999 | G06K 5/00 |
| WO | WO 99/48057 | A1 | 9/1999 | G07D 3/06 |
| WO | WO 99/48058 | A1 | 9/1999 | G07D 3/06 |
| WO | WO 00/48911 | A1 | 8/2000 | B65B 67/12 |
| WO | WO 00/65546 | A1 | 11/2000 | G07F 1/04 |
| WO | WO 01/63565 | A2 | 8/2001 | G07D 9/00 |
| WO | WO 02/071343 | A1 | 9/2002 | G07D 3/00 |
| WO | WO 03/052700 | A2 | 6/2003 | |
| WO | WO 03/079300 | A1 | 9/2003 | G07D 7/00 |
| WO | WO 03/085610 | A1 | 10/2003 | G07D 9/06 |
| WO | WO 03/107280 | A2 | 12/2003 | |
| WO | WO 04/044853 | A1 | 5/2004 | G07D 3/12 |
| WO | WO 04/109464 | A2 | 12/2004 | |
| WO | WO 05/041134 | A2 | 5/2005 | |
| WO | WO 05/088563 | A1 | 9/2005 | G07D 3/00 |
| WO | WO 06/086531 | A1 | 8/2006 | G07D 9/00 |
| WO | WO 07/035420 | A2 | 3/2007 | G06F 7/00 |
| WO | WO 07/120825 | A2 | 10/2007 | G06K 9/00 |
| WO | WO 2010/032055 | | 3/2010 | |

OTHER PUBLICATIONS

Amiel Industries: AI-1500 'Pulsar' High Performance Sorting and Bagging Machine, 13 pages (date unknown, but prior to Dec. 14, 2000).

AUI: Coinverter—"No More Lines . . . Self-Serve Cash-Out," by Cassius Elston, 1995 World Games Congress/Exposition Converter, 1 page (dated prior to 1995).

Brandt: 95 Series Coin Sorter Counter, 2 pages (1982).

Brandt: Model 817 Automated Coin and Currency Ordering System, 2 pages (1983).

Brandt: Model 920/925 Counter, 2 pages (date unknown, prior to Jul. 2011, possibly prior to Mar. 17, 1997).

Brandt: System 930 Electric Counter/Sorter, "Solving Problems, Pleasing Customer, Building Deposits," 1 page (date unknown, prior to Mar. 2, 2011, possibly prior to Mar. 17, 1997).

Brandt: Model 940-6 High Speed Sorter/Counter, 2 pages (date unknown, prior to Oct. 31, 1989).

Brandt: System 945 High-Speed Sorter, 2 pages (date unknown, prior to Mar. 2, 2011, possibly prior to Mar. 17, 1997).

Brandt: Model 952 Coin Sorter/Counter, 2 pages (date unknown, prior to Oct. 31, 1989).

Brandt: Model 954 Coin Sorter/Counter, 2 pages (date unknown, prior to Oct. 31, 1989).

Brandt: Model 957 Coin Sorter/Counter, 2 pages (date unknown, prior to Oct. 31, 1989).

Brandt: Model 958 Coin Sorter/Counter, 5 pages (© 1982).

Brandt: Model 960 High-Speed Coin Sorter & Counter, 2 pages (1984).

Brandt; Model 966 Microsort™ Coin Sorter and Counter, 4 pages, (1979).

Brandt: Model 970 Coin Sorter and Counter, 2 pages (1983).

Brandt: Model 1205 Coin Sorter Counter, 2 pages (1986).

Brandt: Model 1400 Coin Sorter Counter, 2 pages (date unknown, prior to Mar. 2, 2011, possibly prior to Mar. 17, 1997).

Brandt: Model 8904 Upfeed—"High Speed 4-Denomination Currency Dispenser," 2 pages (1989).

Brandt: Mach 7 High-Speed Coin Sorter/Counter, 2 pages (1992).

Case ICC Limited: CDS Automated Receipt Giving Cash Deposit System, 3 pages (date unknown, prior to Nov. 15, 2000).

Cash, Martin: Newspaper Article "Bank Blends New Technology With Service," Winnipeg Free Press, 1 page (Sep. 4, 1992).

Childers Corporation: Computerized Sorter/Counter, "To coin an old adage, time is money . . . ," 3 pages (1981).

CTcoin: CDS602 Cash Deposit System, 1 page (date unknown, prior to Jan. 15, 2001).

Cummins: Cash Information and Settlement Systems (Form 023-1408), 4 pages (date Dec. 1991).

Cummins: The Universal Solution to All Coin and Currency Processing Needs (Form 13C1218 3-83), 1 page (Mar. 1983).

Cummins: JetSort® High Speed Sorter/Counter Kits I & J—Operating Instructions (Form 022-7123-00) 12 pages (1994).

Cummins: JetSort® Coin Sorter Counter/CA-130XL Coin Wrapper, Cummins Automated Money Systems (AMS) Case Study—Fifth-Third, "6,000 Coin Per Minute Counter/Sorter Keeps pace With Fifth-Third Bank's Money Processing Needs," (Form 13C1180), 2 pages (Nov. 1981).

Cummins: JetSort®, "Venders Love JetSort," (13C1255), 1 page (Mar. 1987).

Cummins: JetSort® "High Speed Coin Sorter & Counter for Payphone Applications," "CTOCS Ready" (Form 023-1365), 2 pages (Mar. 1989).

Cummins: JetSort® mailer, "One moving part simplicity," "Vendors—Are validators changing your coin and currency needs?" (Form 023-1297), 3 pages (Apr. 1987).

Cummins: JetSort® Series V High Speed Coin Sorter/Counter, (Form 023-1383), 2 pages (Sep. 1990).

Cummins: JetSort® "Time for a Change, Be a smashing success!," (Form 023-1328), 1 page (Jun. 1988).

Cummins: JetSort® "Time for a Change—JetSort® vs. Brandt X," (Form 023-1330), 1 page (Jun. 1988).

Cummins: JetSort® "Time for a Change—No Coins Sorted After 3:00 or on Saturday," (Form 023-1327), 1 page (Aug. 1988).

Cummins: JetSort®, "What do all these Banks have in Common . . . ?", JetSort, CA-130XL coin wrapper, CA-118 coin wrapper, CA-4000 JetCount, (13C1203), 3 pages (Aug. 1982).

Cummins: JetSort® 700-01/CA-118 Coin Wrapper, Cummins Automated Money Systems (AMS) Case Study—University State Bank, "Cummins Money Processing System Boosts Teller Service at University State Bank," (Form 13C1192), 2 pages (Mar. 1982).

Cummins: JetSort® 700-01, Cummins Automated Money Systems (AMS) Case Study—First State Bank of Oregon, "JetSort® Gives Bank Coin Service Edge," (Form 13C1196), 2 pages (Apr. 1982).

Cummins: JetSort® 700-01 Coin Sorter/Counter, Operating Instructions, 14 pages (1982).

(56) References Cited

OTHER PUBLICATIONS

Cummins: JetSort® 701, Cummins Automated Money Systems (AMS) Case Study—Convenco Vending, "High Speed Coin Sorter increases coin processing power at Convenco Vending," (Form 13C1226), 2 pages (Jul. 1983).
Cummins: JetSort Models 701 and 750 , "State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 1986).
Cummins: JetSort® 2000 Series High Speed Coin Sorter/Counter (Form 023-1488), 2 pages (Oct. 2000).
Cummins: JetSort® 3000 Series High Speed Coin Sorter (Form 023-1468 Rev 1), 2 pages (Feb. 1995).
Cummins: JetSort® 3000 Series Options, "Talking JetSort 3000," (Form 023-1338-00), 1 page (between Jan. 1989-Feb. 1989).
Cummins: JetSort® 3000, "3,000 Coins per Minute!," (Form 023-1312), 1 page (date unknown, est. 1987).
Cummins: JetSort® 3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, in Less Space Than a Branch Manager's Desk, 4 pages (date unknown, prior to Jan. 15, 2001).
Intellectual Australia Pty. Ltd.: Microbank, "From down under: Microbank," "hand-held smart card terminal that combines smart card functions and telephone banking," 2 pages (Feb. 1996).
ISH Electronic: ISH I2005/500 Coin Counter (with translation), 4 pages (date unknown, prior to Aug. 1996).
ISH Electronic: ISH I2005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deposit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System—Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).
Coin Sachet System brochure, 4 pages (last page marked "© Scan Coin / Jun. 2007").
Search Report, Intellectual Property Office, United Kingdom, Application No. GB1404625.4 dated Sep. 11, 2014, 9 pages.
Office Action in Canadian Patent Application No. 2,845,729, dated Aug. 5, 2015, 4 pages.
Office Action in British Patent Application No. GB1404625.4, dated Nov. 2, 2016, 3 pages.
Office Action in Canadian Patent Application No. 2,845,729, dated Feb. 10, 2017, 4 pages.
Pro Quest; From Down Under: Micro Bank, Funds Transfer Report (Feb. 1996), 2 pages; Cited by the USPTO in U.S. Appl. No. 10/084,856 in Office Action dated Jun. 5, 2013.
Examination Report for British Patent Application No. GB1404625.4, dated Apr. 24, 2017, 4 pages.
U.S. Appl. No. 13/836,117 Office Action, dated Dec. 13, 2017, 45 pages.
GB Patent Application No. 1714891.7 Combined Search and Examination Report, dated Jan. 10, 2018, 8 pages.

* cited by examiner

SYSTEM, METHOD AND APPARATUS FOR REPURPOSING CURRENCY

CROSS-REFERENCE TO RELATED APPLICATION

This application is a continuation-in-part of, and claims priority to, U.S. patent application Ser. No. 13/836,117, filed on Mar. 15, 2013, entitled "System, Method And Apparatus For Automatically Filling A Coin Cassette," which is a continuation-in-part of U.S. patent application Ser. No. 11/227,861, filed on Sep. 15, 2005, and entitled "System, Method And Apparatus For Automatically Filling A Coin Cassette," which claims the benefit of priority to U.S. Provisional Application 60/610,050 filed on Sep. 15, 2004, entitled "System, Method And Apparatus For Automatically Filling A Coin Cassette," each of the aforementioned applications being hereby incorporated by reference in its entirety. This application is also a continuation-in-part of and claims priority to, U.S. patent application Ser. No. 11/726,828, filed on Mar. 23, 2007, entitled "Systems, apparatus, and methods for currency processing control and redemption," which claims priority to U.S. Provisional Application Ser. No. 60/793,573, filed Apr. 20, 2006 and further claims priority to U.S. Provisional Application Ser. No. 60/785,251, filed Mar. 23, 2006, each of which is hereby incorporated by reference in its entirety.

FIELD OF THE INVENTION

The present invention relates generally to the field of bulk coin handling systems and, more particularly, to exemplary self-service systems and methods for bulk coin repurposing or bulk coin exchange and repurposing.

BACKGROUND OF THE INVENTION

Coin dispenser trays are widely used as cashier/check out areas and in the self-service check out equipment typically found in places like supermarkets (e.g., Jewel/Osco) and Home Depot. A variety of coin dispensing trays or coin cassettes are provided by a number of manufacturers, each manufacturer possibly offering several tray models having different sizes, arrangements, volumes, denominations, and combinations of coin receptacles for receiving coins in various coin positions.

One common coin dispenser is the Asahi Seiko USA, Inc. (www.asusainc.com) HM-4 coin hopper, in which a plurality of hoppers (i.e., 1¢, 25¢, $1.00) drop the coins into a single exit chute for delivery to a common coin cup. The HM-4 accepts an AMP drawer plug connection to simplify wiring and the hoppers each slide off of the main base plate to permit servicing of coin jams. As the hoppers are depleted, the cashiers or other designated personnel, fill the individual hoppers with coins.

Another popular conventional coin dispenser is the Telequip Transact 2+, which employs removable coin canister or cassette. The program software tracks the change being issued and optimizes the use of the coin supply by attempting to even out the distribution of the coins to enable a longer period of time between refills. The Transact 2+ provides a plug and play pre-wire installation with standard RS232 serial port and other register interfaces. Telequip advertises that the Transact 2+ enables vendors to save from 5 to 7 seconds on every transaction. However, despite these benefits, the refill operation of the Telequip $\text{Transact}_{CLS}$ must be done manually. To facilitate loading of the Transact 2+ coin canister, Telequip provides the $\text{Transact}_{CLS}$ (Canister Loading Solution), shown in FIG. 1. To use this manual device, one must first remove the clear plastic canister cover by depressing two tabs 70 at the bottom and sliding up until the canister handle hangs toward the back of the canister. Then, the canister stand 10 is placed on a flat surface and the canister 20 assembled to the stand by sliding it down onto two rails 60. The canister loading device 30 is then attached to the canister by lowering the device onto the canister, engaging the top rear of the canister, then pivoting the bottom of the loading device inwardly to engage the front of the canister. The canister loading device 30 is then slid down until it engages the taps at the base of the canister stand.

If the funnel retainer 40 is not already assembled onto the loading device, it is slid onto the two rails at the top of the loading device. The funnel 50 is then attached to the funnel retainer 40 by dropping the funnel onto the retainer with the slots aligned. The funnel 50 is then rotated ¼ turn clockwise, positioned with the opening 52 in the front and the "nose" 54 in the back. To manually position the funnel over the appropriate denomination, the funnel must be lifted slightly and slid until positioned over the appropriate column at which time the funnel is dropped in place so that the shoulder 56 of the funnel is flush with the retainer 40. At this point, the person performing the filling operation must begin loading coins for that denomination by slowly pouring coins into the funnel either by hand, cup, or directly from the coin bag. They must continue filling until that column is filled to the desired height indicated by the calibration strips on the canister. This work is tedious, time consuming, and must be repeated for each denomination.

Despite the advances realized by the aforementioned technology, there remains room for additional improvements to the technology to improve the speed with which coin hoppers and coin canisters may be refilled and returned to service.

Currency processing machines generally have the ability to receive bulk currency (e.g., currency bills and/or coins) from a user of the machine. Coin processing modules, for example, are commonly used as coin redemption machines wherein, after the deposited coins are counted and totaled, a receipt is issued indicating the value of the deposited coins. The user may exchange this receipt for the amount of deposited coins in the form of currency bills or, optionally, for an amount of the deposited coins less a commission charged for use of the coin redemption machine.

Coin redemption machines are used in banking environments (in patron accessible areas and in employee-only areas), business environments (e.g., armored transport services, telephone companies, etc.) and retail environments, such as grocery stores. In operation, a user inputs a batch of coins of mixed denominations into a hopper of the coin redemption machine. The machine discriminates items that are not valid coins, determines the value of the valid deposited coins and outputs a receipt indicative of the determined amount. In some embodiments, the receipt also indicates a second, lesser amount, which reflects a commission charged for use of the machine. The user exchanges the receipt for paper currency for the value of the deposited coins less the commission. In a banking environment, a user may exchange the receipt at a teller's window, whereas, in a retail environment, the user can exchange the receipt at a cashier's station or a patron-service station. In one example, the coin redemption machine disclosed by Molbak in U.S. Pat. No. 6,976,570, receives a number of unsorted coins, counts the total value of the valid coins, and outputs a voucher related to the total amount (i.e., less a commission charge for the use of the machine). The user then takes this voucher to a cashier or clerk for redemption, following the verification of the authenticity of the voucher by the cashier or clerk.

Coin repurposing is typically performed by armored car services ("armored carriers" or "cash in transit") and, accordingly, there are costs associated with managing retail cash drawers and deposits. FIG. 4 depicts a highly simplified illustration of conventional coin repurposing wherein an armored car carrier 402 sends out an armored vehicle 403 on a route 404 consisting of a plurality of different businesses #1-*n* (where n represents any number), some of which have disposed therein one or more self-service machines SSM #1-#m (where n represents any number) having coin receptacles requiring pickup. As shown, reference numeral 406*a* denotes an area where businesses #1-#4 are in the proximity of one another and reference numeral 406*b* denotes an area where businesses #5-#8 are in the proximity of one another. Once the armored car has picked up all of the coins from the self-service machines SSM and stores on the route 404, and dropped off wrapped or packaged coins according to the requirements of the businesses #1-#n, the armored car returns to the armored car carrier 402 and the coins transported back to the armored car carrier 402 are processed and repackaged for delivery on subsequent routes.

The armored carrier charges a "Deposit Pick Up Charge" for picking up the store's deposit each day (e.g., $25), including excess notes, coin and checks and a "Change Order Delivery Charge" for dropping off the cash (coin/notes) needed by store to fund the day (e.g., $25 per delivery). There are further fees for the "Currency Furnished" (e.g., $1.25 per $1000), "Rolled Coin Provided (per roll)" (e.g., $0.10 per roll) and a "Deposit Processing Charge" charged by the deposit processor (armored carrier or bank) to count and verify the deposit. A separate fee is usually imposed for each media type such as notes, coin and checks. Still further there can be "Per Deposit" fees (e.g., $1.50 for the deposit) and "Cash Processing" fees (e.g., per $1000)(e.g., $1.25). Yet further, on top of these fees, there is an In-Store-Labor to Manage Coin (preparing starting funds, replenishing, counting end of day) which are approximately $37.50/day (e.g., average 1.5 hours per day at $25.00/hr).

Yet further, the armored service that comes to pick up coins from a self-service machine might not even be the same armored service or driver that is picking up the store's deposit for the day. They could be right behind each other in different trucks, further increasing the total coin pick-up charge, processing charges, and coin delivery charge.

Likewise, costs associated with managing retail self-service machines of the types noted above can include armored carrier fees for "Bin Pick Up" (if using a bin machine) for picking up the store's coin bins (e.g., $40.00 for one pickup per week), a "Bin Processing Charge" charged by the deposit processor (armored carrier or bank) to count and verify the coin bin (e.g., $35.00 per bin), a "Bag Pick Up Charge" (if using a bag machine) charged by the armored carrier for picking up the store's coin bags (e.g., $40.00 for one pickup per week), and a "Bag Processing Charge" charged by the deposit processor (armored carrier or bank) to count and verify the coin bags (e.g., $1.00~4.00 per bag).

This longstanding manner of coin repurposing has proven to be reliable.

SUMMARY

Aspects of the present concepts disclosed herein are generally directed to currency (currency bills, coins, etc.) recycling, or repurposing, and currency exchange.

The average cost per year for an average grocery store to manage coin used in sales transactions is over about $14,000. It is estimated that the systems and methods disclosed herein will produce an estimated annual savings of about $5,800, cumulatively, in rolled coin charges, labor savings and less frequent bin/bag pickups and charges. Yet further, the present concepts also may permit such stores to utilize the systems and methods disclosed herein to realize a profit from servicing other local businesses with specialized coin repurposing services.

In one aspect, a method of repurposing coins includes the acts of discharging processed mixed coins into a coin bin, receiving a first request for a number of or value of coins of a first denomination from an authorized person, outputting the mixed coins from the coin bin onto a coin conveyor responsive to the received first request, conveying the mixed coins output from the coin bin, using the coin conveyor, to the self-service machine for repurposing, and discharging the coins of the first denomination from the self-service machine to a secure coin cassette and discharging coins of a denomination other than the first denomination back to the coin bin. These acts of outputting, conveying and discharging are continued until the number of or value of coins of the first denomination have been discharged to the secure coin cassette.

In one aspect, a self-service machine includes a controller, one or more user-interfaces, a coin processing module configured to sort coins and to discharge the sorted coins to a selected output destination, and a mixed coin bin configured to receive and hold mixed coins received from the coin processing module and to selectively discharge mixed coins held thereby, the coin bin comprising a discharge actuator, controlled by the controller, configured to selectively discharge mixed coins from the coin bin. The self-service machine also includes at least one secure repurposed currency retrieval area, a coin repurposing module configured to package coins received from the coin processing module into a deliverable coin package and to output the deliverable coin package to a designated one of the at least one secure repurposed coin retrieval area and a conveyor system configured to receive mixed coins discharged from the mixed coin bin and securely convey the mixed coins to the coin processing module for reprocessing. The controller, responsive to an order for a deliverable coin package received through the one or more user-interfaces, causes the mixed coin bin discharge actuator to selectively discharge mixed coins from the coin bin to the conveyor system, causes the conveyor system to securely convey the mixed coins received from the mixed coin bin to the coin processing module, causes the coin processing module to sort the mixed coins, outputting coins corresponding to the order for a deliverable coin package to the coin repurposing module and outputting coins not corresponding to the order for the deliverable coin package back to the mixed coin bin, and continuing these acts until the coin processing module outputs to the coin repurposing module coins corresponding to the order for a deliverable coin package, at which point any remaining coins conveyed by the conveyor system and processed by the coin processing module are directed to be output to the mixed coin bin and the coin repurposing module is caused to prepare the at least one deliverable coin package and to output the at least deliverable coin package to the designated one of the at least one secure repurposed coin retrieval area.

In yet another aspect, a self-service machine includes a controller, one or more user-interfaces, a coin processing module configured to sort coins and to discharge the sorted coins to a selected output destination, and a mixed coin bin configured to receive and hold mixed coins received from the coin processing module and to selectively discharge mixed coins held thereby, the coin bin comprising a discharge actuator, controlled by the controller, configured to selectively discharge mixed coins from the coin bin. The self-service machine also includes a plurality of removable secure coin cassettes and a conveyor system configured to receive mixed coins discharged from the mixed coin bin and securely convey the mixed coins to the coin processing module for reprocessing. The controller, responsive to an order for a deliverable coin package received through the one or more user-interfaces, causes the mixed coin bin discharge actuator to selectively discharge mixed coins from the coin bin to the conveyor system, causes the conveyor system to securely convey the mixed coins received from the mixed coin bin to the coin processing module, causes the coin processing module to sort the mixed coins, outputting coins corresponding to the order for a deliverable coin package to a selected one of the plurality of removable secure coin cassettes and outputting coins not corresponding to the order for the deliverable coin package back to the mixed coin bin, and continuing these acts until the coin processing module outputs to the selected one of the plurality of removable secure coin cassettes coins corresponding to the order for a deliverable coin package, at which point any remaining coins conveyed by the conveyor system and processed by the coin processing module are directed to be output to the mixed coin bin.

The above summary of the present invention is not intended to represent each embodiment, or every aspect, of the present invention. Additional features and benefits of the present invention will become apparent from the detailed description, figures, and claims set forth below.

Additional advantages of the present concepts will become readily apparent to those skilled in this art from the following detailed description, wherein only preferred aspects of the present concepts are shown and described, simply by way of illustration. As will be realized, the present invention is capable of other and different embodiments, and its details are capable of modifications in various obvious respects, all without departing from the disclosed concepts. Accordingly, the drawings and description are to be regarded as merely illustrative in nature, and are not to be regarded as limiting or restrictive on the broad aspects of the disclosure.

BRIEF DESCRIPTION OF THE DRAWINGS

The invention will be described in conjunction with the following drawings in which like reference numerals designate like elements and wherein.

Figure 1:
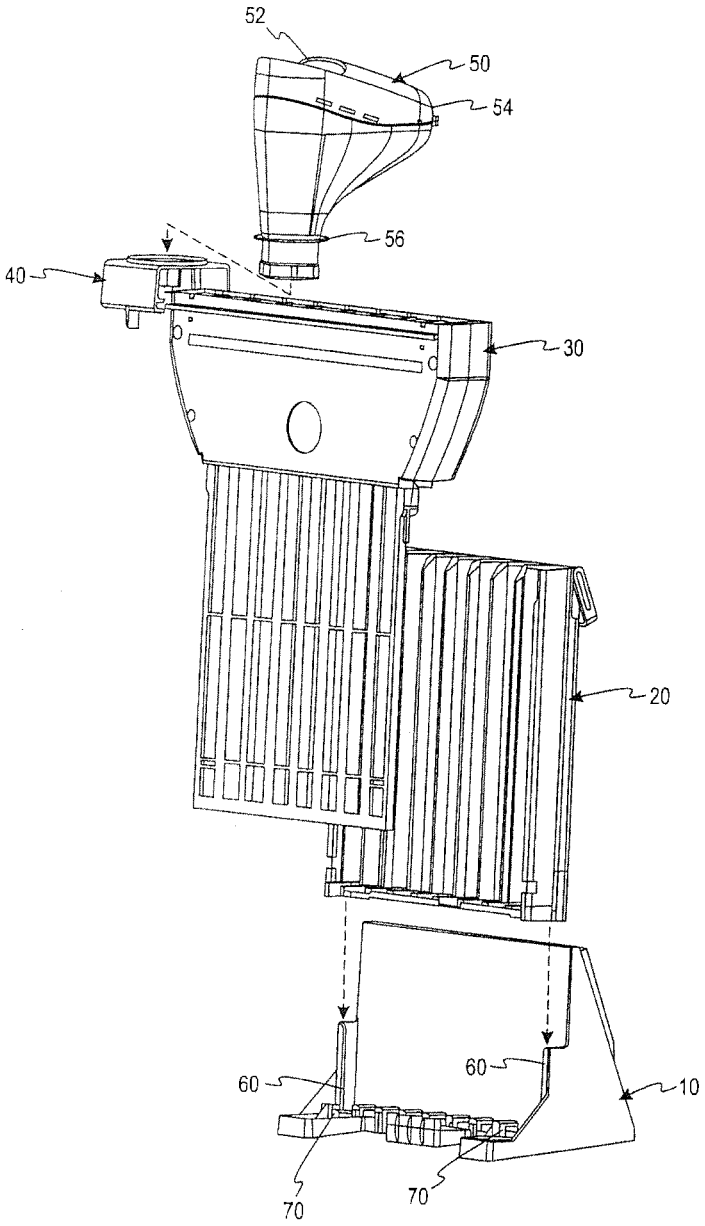
FIG. 1 depicts a Telequip Transact$_{CLS}$.
Figure 2A:
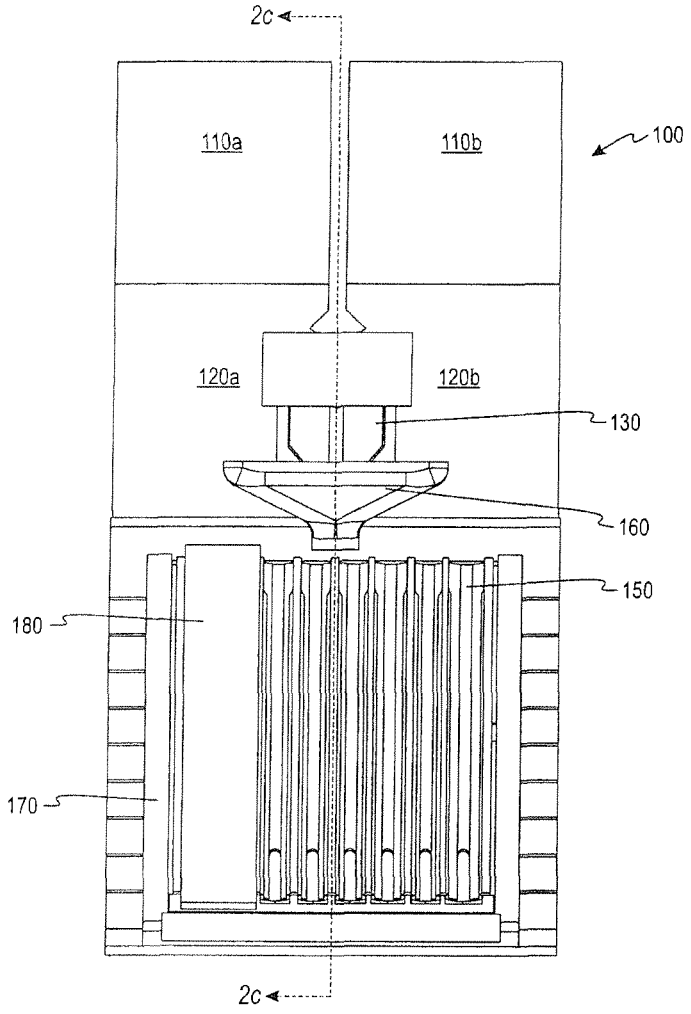
FIGS. 2(*a*)-(*d*) show front, top, cross-sectional, and side views, respectively, of one system for automated refill of a coin tray in accord with the present disclosure.
Figure 2B:
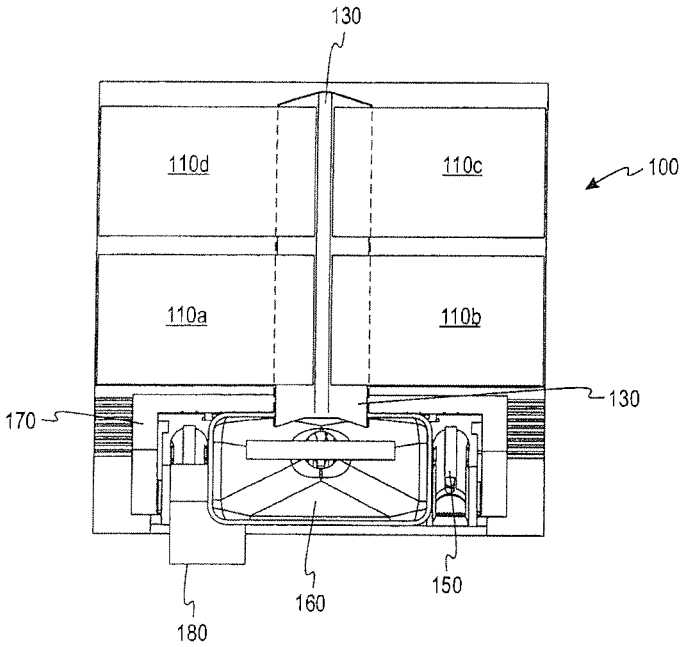
Figure 2C:
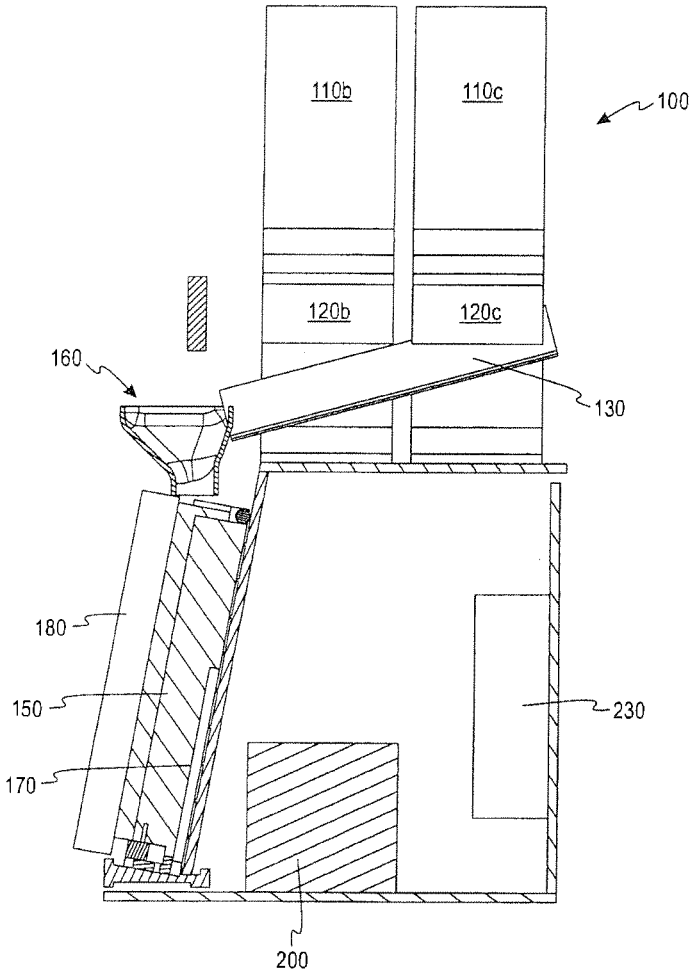
Figure 2D:
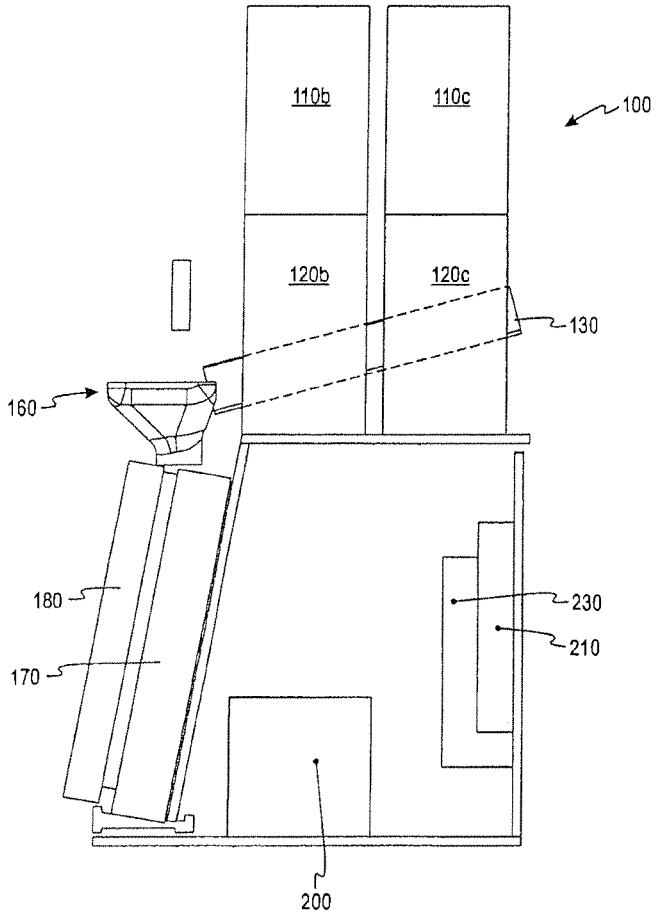

The appended drawings are not to scale are merely intended to convey a general sense of interrelation between components and systems.

DETAILED DESCRIPTION

The systems and subsystems defined below explore one approach to the development of an Automated Coin Tray Refill Device in accord with the present concepts. They are not intended to define the variety of possible solutions, but are merely exemplary of one preferred implementation of the disclosed concepts. The systems presented herein are intended to convey, to those skilled in the art, an appropriate level of detail to illustrate some of the possible functions involved and how they relate to the machine as a whole sufficient to enable them to make and/or use the concepts disclosed herein without undue experimentation.

FIGS. 2(*a*)-2(*d*) shows an example of an automated coin tray refill device or coin dispenser 100 in accord with the present concepts directed to an automated method of filling coin trays, cassettes, hoppers, bags, and canisters. Although the example of FIGS. 2(*a*)-2(*d*) depicts a coin dispenser 100 configured for use with the Telequip 2+ coin tray, the concepts herein are not limited to any one coin tray, cassette, canister, or bag.

The coin dispenser 100 generally comprises supports for individual coin dispensers 120*a*-120*d* and reservoirs 110*a*-110*d* and defines a housing to enclose components such as a power supply 230 and computer or processor 210. In one aspect, the power supply 230 and computer 210 could be external to the coin dispenser 100 and could be connected thereto using conventional electrical I/O connectors. A coin collector system is fed by the coin dispensers 120*a*-120*d* and outputs the coins input therein to a interface module 160 for output into a coin tray inserted into the coin dispenser 100, whether directly or through a coin interface tray or module 170. The interface module 160 and/or the coin interface tray 170 may be configured to translate, move, or rotate relative to one another to facilitate interface therebetween.

Power supply 230 is configured to interface with an available AC power supply and is configured to provide rated DC power to system components which may include, but are not limited to, interface module 160 actuators, sensors or drive systems, coin tray 150 actuators, sensors or drive systems, coin interface tray 170 actuators, sensors or drive systems, coin reader 180 actuators, sensors or drive systems, coin dispenser 120(*a*)-120(*d*) actuation devices or sensors, coin collector point distribution system 130 actuators, sensors or drive systems, display 190, computer or processor 210, and any attached memory devices (e.g., solid state memory, disk drive, CD-ROM drive, DVD-Drive, etc.) Computer 210 also includes a main memory, such as a random access memory (RAM) or other dynamic storage device, coupled to bus for storing information and instructions to be executed by a processor. The main memory also may be used for storing temporary variables or other intermediate information during execution of instructions to be executed by the processor. Computer 210 further includes a read only memory (ROM) or other static storage device coupled to the bus for storing static information and instructions for the processor. A storage device, such as a magnetic disk or optical disk, is preferably provided and coupled to bus for storing information and instructions.

Execution of sequences of instructions contained in main memory causes the processor or processors, if more than one is provided, to perform the actions described herein. In alternative embodiments, hard-wired circuitry or firmware may be used in place of or in combination with software instructions and it is to be understood that no specific combination of hardware circuitry, firmware, and software are required. Instructions may be provided in any number of forms such as source code, assembly code, object code, machine language, compressed or encrypted versions of the foregoing, and any and all equivalents thereof. "Computer-readable medium" refers to any medium that participates in providing instructions to the processor for execution and the term computer usable medium may be referred to as "bearing" the instructions, which encompass all ways in which instructions are associated with a computer usable medium. Computer-readable mediums include, but are not limited to, non-volatile media, volatile media, and transmission media. Non-volatile media include, for example, optical or magnetic disks. Volatile media include dynamic memory, such as main memory. Transmission media include coaxial cables, copper wire and fiber optics, including the wires that comprise bus 102. Transmission media can also take the form of acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor for execution. For example, the instructions may initially be borne on a magnetic disk of a remote computer, which can transmit instructions to computer 210 over a telephone line using a modem or through a cable line or wireless signal. Computer 210 may also include a communication interface coupled to the bus to provide a two-way data communication coupling to a network link connected to a local network. For example, the communication interface may be an integrated services digital network (ISDN) card or a modem to provide a data communication connection to a corresponding type of telephone line. As another example, the communication interface may be a local area network (LAN) connection to provide a data communication connection to a compatible LAN. Wireless links (e.g., RF or infrared) may also be implemented. In any such implementation, communication interface sends and receives electrical, electromagnetic or optical signals that carry digital data streams representing various types of information.

The network link typically provides data communication through one or more networks to other data devices. For example, the network link may provide a connection through local network to a host computer or to data equipment operated by an Internet Service Provider (ISP), which in turn provides data communication services through the worldwide packet data communication network, commonly referred to as the "Internet". The local network and Internet both use electrical, electromagnetic or optical signals that carry digital data streams. The signals through the various networks and the signals on network link and through communication interface, which carry the digital data to and from computer 210, are exemplary forms of carrier waves transporting the information.

Reservoirs 110*a*-110*d* each provide storage for a particular coin denomination and interior baffles may optionally be provided to reduce the direct weight of coins on a dispenser by supporting a portion of the load using angled plates. It is intended that the reservoirs 110*a*-110*d* provide an unobstructed gravity feed to the dispenser (e.g., dispensers 120*a*-120*d*), although a mechanical or assisted feed may also be provided in accord with the present concepts. Such mechanical or assisted feed may include, for example, one or more transducers or vibrating members configured to impart a vibration within the dispenser, or a movable member. Dispensers 120*a*-120*d* are designed to dispense a specific coin count (e.g., 72 coins) of a specific coin denomination (e.g., 10, 50, 100, 250) for a specified currency (e.g., coins minted by the United States Mint) upon receipt of an appropriate control signal from an associated controller or logic board and power board interface. In one aspect, the reservoirs are filled with a respective currency from an appropriate source such as, but not limited to Full Federal Bags, Half-Full Federal Bags, 19" through 12" coin bags, or coin sorter output bins. In an optional configuration, the reservoirs 110*a*-110*d* (or additional or fewer reservoirs, as needed) may be connected to an output of a conventional currency processing machine such as, but not limited to, the JetSort® manufactured by Cummins-Allison of Mt. Prospect, Ill., for direct deposit of sorted mixed coins into an appropriate one of the reservoirs 110*a*-100*d*, or additional reservoirs as may be the case. It is to be understood that the reservoirs 110*a*-110*d*, dispensers 120*a*-120*d*, collector point distribution 130, interface module tray 140, and all other systems and components herein described are applicable to all currencies and denominations of the United States and of other nations, states, republics and entities.

FIG. 2(*d*) shows a power supply 230 and conventional computer/processor 210, which power and regulate or control, respectively, the operation of dispensers 120*a*-120*d*. The dispensers 120*a*-120*d* are configured to dispense (e.g., sequentially), upon receipt of a control signal from computer 210, a predetermined number of coins of a respective denomination to a collection point distribution 130 by means of a gravity and/or mechanical feed such as, but not limited to, a computer controlled gate (not shown) or controlled feed mechanism. The number of coins may, for example, correspond to a difference between a measured stack height and a maximum stack height for a designated coin tray, cassette, hopper, or canister, the maximum stack height being stored in and retrieved from a conventional memory device.

In one aspect, a rotating disk could be disposed at a bottom of the dispensers 120*a*-120*d* to singulate and move coins at the bottom of the dispensers to a coin transport channel having one or more coin transport belts, such as described in U.S. Pat. Nos. 4,058,999 and 4,949,532, which are hereby incorporated in their entirety by reference. In another aspect, a device to output a predetermined number of coins of a respective denomination to a collection point distribution 130 could include, for example, a rotating drum having pockets for receiving individual coins dispersed thereover in a helical pattern to permit transport of a predetermined number of coins for a specified degree of rotation. Still other coin moving devices could include, but are in no means limited to, a worm gear disposed within a tube.

Although the reservoirs 110*a*-110*d* and dispensers 120*a*-120*d* are shown in a quad or 2×2 arrangement, the reservoirs and dispensers may also be arranged in any order and/or manner including, but not limited to, sequentially, laterally or vertically, staggered, stepped or in an arcuate path, in accord with the present concepts.

In one aspect, the dispensers 120*a*-120*d* may optionally be configured to hold one or more boluses or predetermined numbers of coins corresponding to a full complement of coins (or fraction thereof) for a designated coin tray, cassette, hopper, bag, and canister. For example, if a coin tray typically or exclusively used by an end-user holds a maximum of 100 quarters, the dispenser (e.g., 120*a*) could comprise one or more sections each adapted to hold 10, 20, 50, or 100 quarters in a pre-measured bolus. When a new (i.e., empty) dispenser tray 150 is inserted in-place adjacent the interface module, the dispenser could output the bolus(es) to cause a sequential filling of the coin channel(s) in the dispenser tray. The interface module 160 may optionally be configured to accept and route a parallel rather than a serial output from the dispensers 120*a*-*d*. In such aspect, a plurality of boluses of measured numbers of coins could be simultaneously directed through an interface module 160 have a plurality of coin paths or channels to a corresponding plurality of coin channels in a dispenser tray 150. Such pre-sorted during a system "down-time" permits faster filling. As to the fractional filling aspect, noted above, the computer 210 regulating the filling operation can, for example, instruct release of a predetermined combination of boluses (e.g., 3×20 quarters or 1×10 quarters and 1×50 quarters to get 60 quarters) once the requirements for a particular denomination are known (e.g., 67 quarters) and then instruct the appropriate dispenser (e.g., 120(*d*)) to output an additional small number of coins (e.g., 7 quarters) to complete the requirements.

The collection point distribution 130 collects any of a variety of coins from any of a series of coin dispensers (e.g., dispensers 120*a*-120*d*) and provides a point of distribution for filling a coin channel or coin channels in a dispenser tray 150 through an associated interface module 160. The collection point distribution 130, depicted as a chute or ramp in the illustrated example, may comprise any other conventional means of coin conveyance including, but not limited to rails, conveyor belts, moving platforms, rotating screws, guides, etcetera. The collection point distribution 130 may also be configured to vibrate to facilitate movement of coins thereover or therethrough. The interface module 160 may take any shape suitable to pass coins to a coin channel in a dispenser tray 150. The exemplary interface module 160 shown in FIGS. 2(*a*)-2(*d*) assumes a funnel-shape, but is not limited to such shape or closed surfaces. As used herein, the term funnel may include any body having one or more opposing, adjacent, and/or contiguous surfaces that converge toward one another over at least a portion of a length thereof so as to guide coins passing thereover to an opening common to the surfaces. The bottom opening of the interface module 160 may be circular, or may advantageously be oblong or flattened along one axis to force coins to pass vertically or substantially vertically therethrough.

In at least some embodiments, the bottom opening of the interface module 160 may comprise a vectored nozzle comprising opposing curved or flat plate portions that may be tilted toward or away from each other to regulate a distance between or may be pivoted substantially in unison to impart a desired exit angle to a coin passed therethrough. The geometry of the interface module 160 vectored nozzle is advantageously controlled by the computer 210 to correspond to a selected coin tray, cassette, hopper, bag, and canister, a desired throughput, a selected coin denomination, and selected other control inputs (e.g., programmed variations or limitations based on historical experience). The movement of the vectored nozzle may be achieved by any conventional actuator, solenoid, linear variable displacement transducer, or gear set, preferably self-locking, having a minimal size and cost. Output torque and speed are not significant factors, as the minimal amount of movement required could be effected prior to release of coins to the interface module 160.

The output of the interface module 160 may also be advantageously configured to impart a spin in a preferred direction to the coins output thereby, such as by passing the coin across an opening having one or more rotating rollers biased into contact with the coin periphery. The spin and increased angular momentum may help coins striking a stack edgewise to deflect toward a more horizontal position. The spin may also be achieved using a stationary member, which may be rigid, or may be flexible, such as a brush or bristles, to impart a bias to a preferred portion of a coin contacting such member. The stationary members could be provided in the interface module 160 itself and/or in or on the collector point distribution member.

In another aspect, a module cover (not shown) or adapter could be attached or removably attached to the coin tray 150 (e.g., coin tray, cassette, canister, tube, paper roll, etcetera) to facilitate placement of coins into the coin tray. In one aspect thereof, the module cover could cover the front of the coin tray and complete the cylinder geometry of the coin tray, if necessary, to facilitate the coin filling operation. The module cover could assume any configuration to guide coins from the interface module 160 to the top part of the coin tray 150 and into the individual denomination stacks. In another aspect, the module cover or adapter could be attached or removably attached to the interface module 160 to facilitate placement of coins into the coin tray, such as by extending the length and/or configuration of the funnel output. The module cover interfaces with one or more particular design of coin trays 150 and serves to facilitate movement of the coins to a predetermined location and/or serves to guide the coins in a manner which facilitates output of the coins in a substantially predetermined orientation.

In one aspect thereof, the physical configuration or geometry of the module cover could direct the coin to a specific orientation by supporting the coin at particular point(s) to enable external forces (resiliency of a resilient member, gravity, air pressure, friction, rotational forces imparted by rollers, forces of external objects such as brushes, etc.) to direct the coin into a particular orientation. This could include, for example, ramps, rails or wireforms. The application of external forces to achieve a desired orientation of coin may include, for example, opposing brushes defining a gap therebetween through which coins may pass. An additional brush could be provided along an axis perpendicular to the opposing brushes so as to constrain a coin passing therethrough to lay flat against a surface opposed to the additional brush (e.g., a slide or ramp). Such brushes, although noted in regard to the interface module 160 and the module cover (not shown), could be provided at any point in the system (e.g., dispenser output, collection point distribution 130, etc.) to control or influence the orientation of the coins.

In still another aspect, at least one of the module cover (not shown), coin tray or dispenser tray 150, and/or coin interface tray 170, may comprise one or more transducers, actuators, piezoelectric elements, or the like outputting an impulse and/or vibration so as to avoid stacking of coins within the dispenser tray 150 and/or to dislodge coins misaligned within the dispenser tray. Alternatively, one or more transducers, actuators, piezoelectric elements, or the like outputting an impulse and/or vibration may be provided adjacent the dispenser tray 150, module cover, and/or coin interface tray 170 to the same end. In yet another aspect, a pneumatic nozzle or pneumatic output device(s) may be coupled to a pneumatic supply and positioned (e.g., statically or movable along one or more axes) adjacent an opening or openings in the dispenser tray to blow a stream or pulse of high pressure air to dislodge or reorient misaligned coins.

In accord with the above, interface module 160 may be configured to provide a specific orientation of a coin during the placement of coin in the tray, cassette, hopper or canister.

In one aspect, the collection point distribution 130 is fixed and the interface module 160 translates relative thereto to dispose the output opening or spout of the interface module 160 in an appropriate position and/or orientation to output the selected denomination of coin into the proper dispenser tray 150 coin channel. This translation of the interface module 160 may be accomplished using any conventional drive mechanism including, but not limited to, a belt drive or a stepper motor. In this configuration, such as shown in FIGS. 2(*a*)-2(*d*), the base or top portion of the interface module 160 should be wide enough so that at either lateral extreme (i.e., left or right limit) of the interface module travel, the opening of the interface module is still positioned beneath the output of the collection point distribution 130 to receive coin therefrom. Thus, the dispensers 120*a*-120*d* collectively feed into a collector point distribution 130 where they are passed to interface module 160, which is configured to interface with at least one dispensing tray canister or cassette 150 for a given manufacturer, brand, and model number. It is preferred that the discharge opening of interface module 160 be configured to interface with more than one dispensing tray canister or cassette 150 for a given manufacturer, brand, and model number or, still more preferably, a range of dispensing tray canisters or cassettes for a number of given manufacturers, brands, and models.

In an alternate configuration, the collection point distribution 130 may itself translate laterally relative to the coin dispenser structure. This translation of the collection point distribution 130 may be accomplished using any conventional drive mechanism including, but not limited to, a belt drive or a stepper motor. The collection point distribution 130 may travel as a unit with the interface module 160 or may translate separately therefrom. In still another configuration, the base or rear of the collection point distribution 130 may rotate through a predetermined arc about a pivot point with the interface module 160 traveling an associated chord of the arc under the power of an appropriate conventional rotational drive system, such as a motor with an optional gear system or gear set. In this aspect, the depth of the interface module 160 should accommodate the varying extent of the collection point distribution 130 within the opening to the interface module 160. In additional configurations, the collection point distribution 130 may itself comprise a plurality of separate paths utilizing either conventional gravity or mechanical feed mechanisms to output coins to the interface module 160. In any of the above aspects, the tray 150, canister, or cassette may also be configured to translate, rotate, pivot, move, and/or vibrate relative to the collection point distribution 130 or interface module 160 to speed or facilitate the filling operation.

In yet another configuration, the collection point distribution 130 may comprise a plurality of separate paths utilizing either conventional gravity or mechanical feed mechanisms to output coins to an equal plurality of interface modules 160. In this latter aspect, each denomination of coin could have a separate reservoir, dispenser, collection point distribution and interface module 160, or each of these components may be integrated into one or more units having the same functions. The components could therefore be made stationary, which eliminates the need to include moving parts, motors, belts, separate actuators and the like and reduces system cost and maintenance. Each interface module 160 therein could be optionally manually movable along an x-axis, y-axis, and/or z-axis or any other defined axis or axes to accommodate trays, canisters, or cassettes of different configurations and sizes to enable the system to flexibly adapt to any such tray, canister, or cassette in the market or the majority thereof.

The coin interface tray 170 is a modular coin cassette which may be advantageously adapted to receive a specific tray brand and model number (e.g., a Telequip 2+ coin tray). In many instances, an end user will use a single type of coin dispenser and associated canister, cassette, or tray in multiple check-out locations and will need coin interface tray 170 for such specific canister, cassette, or tray. Thus, in one embodiment, the coin dispenser 100 can be pre-configured to correspond to a particular tray brand and model number, but could later be mechanically adjusted or adapted to receive another tray brand and/or model number, whether by manipulation of components in the automated coin dispenser 100 (e.g., repositioning movable rails or replacing interchangeable rails with new rails), alteration of the angle of the coin interface tray 170 relative to the housing, or by purchase of a replacement coin interface tray 170. Regarding the alteration of the angle of the coin interface tray 170 relative to the housing, the coin interface tray may be optionally arranged to assume any one angle in a predetermined range of angles, which may be positive, neutral, or negative with respect to the interface module 160 output. FIGS. 2(*a*)-2(*d*) show that the coin interface tray 170 is positioned with a slight positive angle relative to the interface module 160 output. In an embodiment wherein the coin interface tray 170 is configured to accept a coin tray of a predetermined make and model, coin channel information, such as the home position (coin denomination center position), maximum coin count per position, denomination sequence for successive coin channels, number of coin channels, etcetera, is known.

The automated coin dispenser 100 may be configured to not only rotate and/or pivot the coin interface tray 170 to adjust an angle thereof with respect to the vertical or other defined reference axis, but may also be configured to translate the coin interface tray laterally (e.g., along a x-axis), vertically (e.g., along a y-axis), and/or along any other defined axis or axes by means of a drive system 200, which may comprise a single drive system or a plurality of drive systems. This translation along one or more axes may be manual, wherein an operator inserting a coin tray 150 to be filled adjusts the lateral and/or vertical position of the coin interface tray 170 and coin tray 150, if necessary, to an appropriate position under the interface module 160. This translation along one or more axes may also be automated, wherein a drive system 200, such as one or more actuators or a belt drive adjusts, under instruction from the computer or processor 210, the lateral and/or vertical position (and/or along any other defined axis or axes) of the coin interface tray 170 and coin tray 150, if necessary, to a designated position under the interface module 160. As noted above, the computer or processor 210 may be "informed" of the particular coin tray 150 disposed for filling within the automated coin dispenser 100 by operator data entry using a conventional data entry device. In still another aspect, the automated coin dispenser 100 may comprise a vibrator (not shown) or actuator to vibrate or shake the coin interface tray 170 at one or more pre-selected frequencies and/or amplitudes or to cycle the coin interface tray through a range of selected frequencies and/or amplitudes to facilitate jogging of coins that are improperly disposed within the coin tray 150 into a preferred orientation.

In another aspect, the coin interface tray 170 may comprise "N" separate conductor surfaces, features (e.g., cavities/protrusions), or components defining switches. Each switch defines an information state, "on" or "off." In various non-limiting aspects, the coin interface tray 170 switches may comprise surface-mounted pressure switches, exposed physical contacts, or exposed conductors configured to contact exposed conductors on a coin tray, cassette, or canister to be received by the coin interface tray. The switches may also comprise non-contact devices, such as a plurality of light sources (e.g., laser diodes) arranged to output a beam toward a portion of a coin tray, cassette, or canister received by the coin interface tray 170 and light sensors (e.g., CCDs) arranged to measure a reflected light or an incident light (e.g., light through holes in the coin tray 150), depending on the configuration, from a respective portion of the coin tray, cassette, or canister. In this latter example, the intensity of the reflected light could be correlated to an "on" or "off" state. Alternatively, the light sensors may be configured to sense an absence of light output from a continuous, intermittent, or ambient light source (e.g., which light source becomes partially or fully occluded or blocked by a coin in the coin tray) and output a signal corresponding thereto.

The switches, whatever the form, could be pre-selected in number and location to define, in combination, a sufficient number of discrete states to uniquely define a specific manufacturer and model of coin tray, cassette, canister, or the like, inserted adjacent thereto. In one aspect, the switch remains in a first state (e.g., an "off" state), such as by having opposing switch elements being electrically disconnected from one another and assumes a second state (e.g., an "on" state) when the opposing elements of the switch are forced into electrical contact, or are otherwise electrically connected, by insertion of a coin tray, cassette, or canister having a feature to interact with the selected switch configuration. The switches may be directly connected to inputs of a processor, computer, or logic circuit or may be routed through a conventional multiplexer, I/O device, or register. In combination, a plurality of switches defines $2^N$ separate information states such that 4 switches (N=4) yields 16 discrete states and 8 switches (N=8) yields 256 discrete states. For a given population of coin trays or cassettes 150 desired to be associated with the automated coin tray refill system 100, the population will possess a variety of physical, electrical, magnetic, or optical characteristics, which permit configuration of the switches to uniquely identify each of the coin trays in the population. These characteristic data are stored in a conventional library or data base addressable by an address or pointer. The library or data base may be stored in a conventional memory device such as, but not limited to a ROM, solid-state memory device, hard-disk, floppy-disk, or CD-ROM drive.

Thus, for different pre-determined combinations of "N" switch states, the system 100 may access all necessary information regarding a coin tray or cassette 150 input into the coin interface tray 170 such as, but not limited to, coin tray or cassette home position, coin denomination center position, maximum coin count per position and/or denomination, coin tray or cassette denomination values, and coin tray center-coordinates relative to a predetermined reference point. In an example wherein the Telequip 2+ coin tray is inserted into the coin interface tray 170, pressure switches 1, 2, 4, 6, and 7 may be "on", while pressure switches 3, 5 and 8 may be "off". The computer or processor, upon accessing the library, matches these switch states with a pre-determined set of switch states uniquely assigned to the Telequip 2+ coin tray. Based on this unique association, the processor and computer code or instruction set will automatically set each system variable (e.g., home position, maximum coin count per position, coordinates of each coin tray, required positions of interface module 160, etc.) to accommodate the identified coin tray (e.g., Telequip 2+ coin tray). Thus, coin interface tray 170 may be a generic tray suitable to receive any one of a plurality of different coin trays 150, cassettes, canisters, or the like, from a variety of different manufacturers, whereupon the automated coin refill system is cooperatively associated with a memory device storing state information for such plurality of coin receptacles to enable the system to appropriately identify the type, style, manufacturer, and configuration of each coin receptacle.

In another aspect, the aforementioned switches are omitted and, instead, the user of the system is requested to input, such as through a touch screen display 190, the manufacturer and model number of a coin tray 150 to be filled. The information regarding such coin tray 150 (e.g., denominations, counts, spacing, etc.) is then accessed for use by the processor 210 and associated software and controls. In still another aspect, a single known coin tray 150 may be used and a coin interface tray 170, as such, is not required. The switches are merely one optional aspect of implemented a universal, automated coin filling system, but such a universal breadth is not a necessary part of the present concepts.

The automated coin tray refill system 100 may comprise a display 190, as shown in FIGS. 2(*a*)-2(*d*) and at least one data input device (e.g., display 190 may be a touch screen display) or, alternately, may comprise one or more conventional I/O ports to accept such devices. Display 190 is provided to provide visual feedback to an operator of the refill system 100. The computer 210 may be configured to display, upon execution of an appropriate code or instruction set, on display 190 information to notify the operator of a low count in any specific coin dispenser reservoir, indicate residual coin value per column, provide display for dispensing count and value per column, display day totals, tray totals and tray filling transactions, or alert the operator to an error in the system, such as a coin jam. The data input devices (e.g., touch-screen display 190) may also be adapted to require entry of an employee ID or code to track activity on the system 100, to limit access thereto, and to regulate functions accessible to various categories of users or operators.

In lieu of the aforementioned means by which the automated coin tray refill system 100 may automatically determine an exact make and model of a coin tray 150 inserted therein, a user of the automated coin tray refill system may, in one aspect, be prompted by an instruction on display 190 from the computer or processor 210 to enter the identifying information for a particular coin tray 150, such as the manufacturer name, model number, configuration, etc., through an appropriate input device such as, but not limited to, a keyboard, touch screen display, mouse, microphone, bar code scanner, or soft key. This arrangement utilizes existing system components, such as the processor 210 and display 190, to simplify the system architecture and reduce cost.

A conventional coin reader 180 is provided to provide to count the coins present in a specified stack or column of a coin tray. In one aspect, a single coin reader 180 is movably provided to translate or rotate between columns or trays of the coin tray 150 to determine a height of a coin stack therein. This translation of the coin reader 180 may be accomplished using any conventional drive mechanism including, but not limited to, a belt drive or a stepper motor. Alternatively, a plurality of movable coin readers 180 may be provided with an associated plurality of drive systems. In another aspect, a plurality of stationary coin readers 180 of an appropriate configuration may be provided. The coin reader(s) 180 is (are) configured to sense a coin height (or conversely a remaining height to be filled), with or independently of a processor, using conventional sensing arrangements including but not limited to, digital tape measures, fixed measurement tools, encoders (e.g., linear, rotatary, optical, etc.), mechanical switches, reflective sensors adapted to measure a reflected light from a LED or other light source or to measure a reflected acoustic or sound signal, Or electrical resistance, capacitance, or hall effect position sensors (e.g., Honeywell SS400 series Hall effect digital position sensors), or even scales to measure a collected mass of coins. Any conventional coin reader or position sensor may be used in accord with the present concepts. The sensor or sensors may be positively or negatively configured to sense the presence of a sensed characteristic or, correspondingly, the absence of a sensed characteristic (i.e., sensing the presence of coins, or the absence or coins; sensing the activation of a switch or the non-activation of a switch), as desired. In combination with the computer or processor 210, the signals output by the coin reader(s) 180 are used to determine, for example, a residual coin count, a running coin count, and a final count.

In lieu of a coin reader 180 able to continuously monitor the exact number of coins present in (or coins absent from) a stack, one or more sensors or switches may be disposed at a position or more than one position to regulate the filling of the corresponding stack. For example, a sensor could be disposed at a 25% full point, a 50% full point, a 75% full point, a 95% full point and a 100% full point, or any other selected point or points, and the processor 210 in combination with associated software and controllers regulating the dispensing of coins from dispensers 120*a*-120*d*, could adjust the rate of flow so as not to overfill the tray or retain excess coinage in the interface module or other system components. In the event the combination of the control system components and sensors are not fast enough to prevent discharge of too many coins from the dispensers 120*a*-120*d*, a conventional bypass could be provided in the interface module 160 or collector point distribution member 130 to route excess coins into a holding area or escrow. As another option, the automated coin refilling system 100 may simply be configured to discharge a discrete predetermined amounts of coins, such as by offering a limited selection of options on display 190. For example, a user of the system may be offered the selection between $1, $2, $5. $10, $20, $30, $40, $50, etc. or any other value or increment, of any selected coin (e.g., penny, nickel, dime, quarter, etc.). These variables may clearly include any conventional denomination and container amount (e.g., a standard 40-quarter roll would take a $10 fill). Alternately, the user of the system may be offered the selected to dispense a selected quantity of coins of a selected denomination.

When a coin tray 150 is inserted into the coin interface tray 170 and is recognized by the automated coin tray refill system, or when such identifying information is entered by a user using an appropriate data input device, the computer or processor 210 may utilize the signals output by the coin reader 180 for each tray or stack of the coin tray to determine an initial state of the coin tray (e.g., full, empty, partially filled, etc.). For example, the coin reader 180 may output signals for each of the Telequip 2+ coin trays to the computer 210 which, upon accessing of the library information regarding the Telequip 2+ coin tray, can determine that the signals output by the coin reader 180 correspond to a 1¢ tray that is 20% full, an empty 5¢ tray, a 10% full 10¢ tray, and an empty 25¢ tray. The computer 210 can then to provide count and denomination instructions to the dispenser system.

In one aspect, the computer or processor 210 comprises a code chip and a library chip, which may be separate chips, partitioned portions of a single chip, or different logical units. The code chip comprises or is operatively associated with an instruction set or coding which, upon execution, interprets data output from the coin interface tray 170, compares that interpreted data to data stored in a library address, and separately stores or outputs the data of a library address found to correspond to the interpreted data. The code chip also interfaces with the display 190 and, upon execution of an appropriate code or instruction set based upon a corresponding signal from the code chip, issues a low coin alert for a specified denomination reservoir 110(*a*)-110(*d*).

The code chip further interfaces with the dispensers 120(*a*)-120(*d*) and coin reader 180 and, upon execution of an appropriate code or instruction set based upon a corresponding signal from the code chip, reads an existing coin count and value per column in the coin tray 150 tray or reads the dispensed value and coin count per column. The code chip is also configured to compile information including, for example, denomination totals and errors for individual filling sessions or for cumulative periods, such as day totals.

In various aspects, the code chip reads output signals from the respective drive systems and/or actuators which might employ position encoders (e.g., linear encoders, rotary encoders, incremental encoders, magnetic encoders, optical encoders, etc.) or other mechanisms or devices to provide an indication of incremental movement or step of the associated drive system or actuator, such as drive systems controlling the dispensers 120(*a*)-120(*d*), interface module 160, coin reader 180, and/or coin interface tray 170. The output signals from the respective drive signals and/or actuators provide information which may be correlated to the position of the drive system, such as the distance of a selected drive system component reference point from a home position. The code chip is also able to analyze thermal signals, such as might be output by a motor thermal overload circuit, and provide output signals with an appropriate pre-programmed response, such as to shut down an overheating motor and to display an error or warning message on display 190.

The code chip is also configured, by means of appropriate instructions sets and/or coding, to analyze electrical contact signals from the switches or other like components and access a library or data base to compare the plurality of switch states to known switch states for specified coin trays 150. The code chip is also configured, by means of appropriate instructions sets and/or coding, to analyze output signals from coin reader 180 to provide a current coin count or to calculate a residual coin depth/position (defining existing coin count or remaining coin count) and to correspondingly output a signal to the coin dispensers 120(*a*)-120(*d*) to output a number of coins needed to fill the coin tray 150 denomination, as well as to calculate sums, day totals, perform other similar types of calculations and write them to files for later access.

Figure 3:
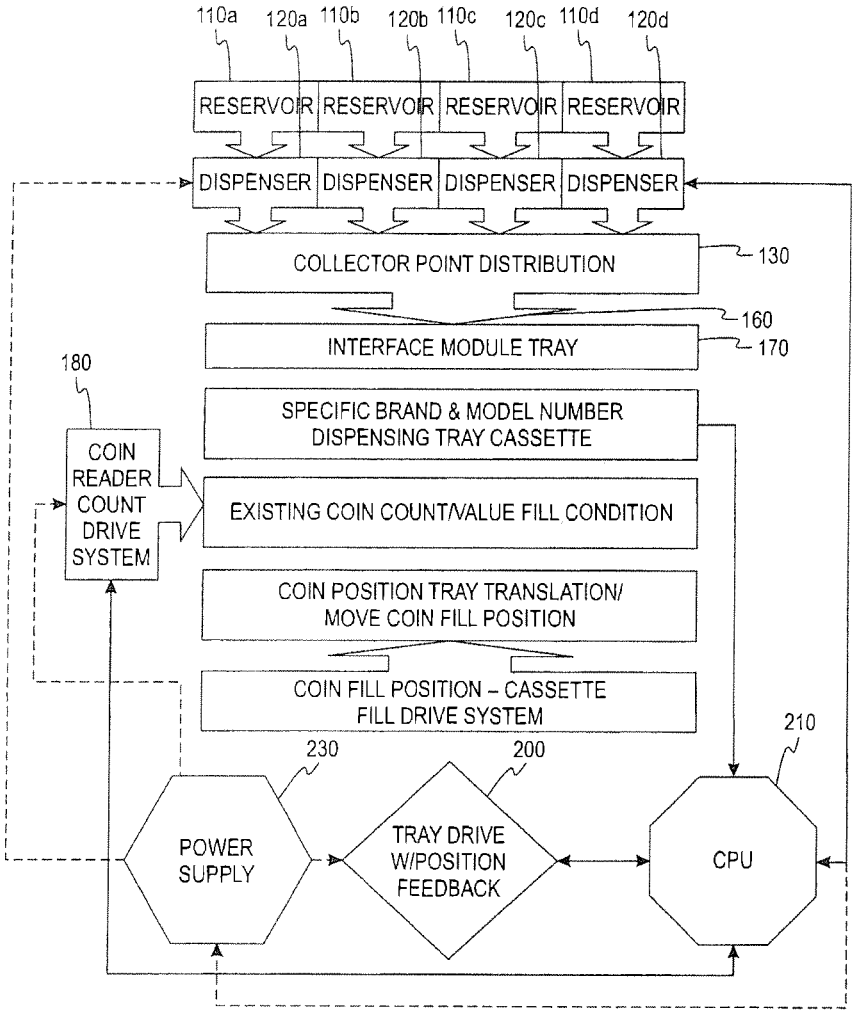
FIG. 3 shows a block diagram illustrates one aspect of a system for automated refill of a coin tray in accord with the present disclosure.

FIG. 3 shows a block diagram of a coin dispenser 100 in accord with the present concepts illustrating the relationship between some of the expected systems in the implementation herein described. FIG. 3 illustrates one approach to the automated method of filling coin trays, cassettes, hoppers, bags, and canisters in accord with the presently disclosed concepts and this depicted conceptual framework outlines some features characteristic of one aspect of automated coin tray refill device 100.

FIG. 3 shows, in block diagram form, a plurality of reservoirs 110*a*-110*d*, each reservoir feeding into a respective plurality of dispensers 120*a*-120*d*. The output from dispensers 120*a*-120*d* feeds into the collector point distribution 130 and then to the interface module tray 170 through an appropriate distribution device (e.g., a funnel, chute, or belt). A coin tray 150 of a specific brand and model number is disposed in the interface module tray 170 and switches or other identifying features (or operator input) are used to provide signals to the computer 210 to inform the automated coin tray refill device 100 of the particular characteristics of the coin tray. This characteristic information data is stored in a data base or library accessible to the computer 210. Once the coin tray 150 configuration is known, the computer 210 may then control, for example, a coin tray drive or coin interface module tray 170 drive and/or the coin reader 180 drive to position the coin tray 150 and/or coin reader 180 for initial inventorying or reading of the tray position. Such drive systems would advantageously comprise encoders adapted to provide position feedback signals to the computer 210. The computer 210 controls the output from the dispensers 120(*a*)-120(*d*) and monitors, for example, the coin fill position, coin count, and value fill conditions using the coin reader 180.

It is to be noted that the processor 210 and associated software and instructions may be configured to vary any of the above noted variables (e.g., position and/or rotational orientation of the coin tray; configuration of funnel output; rate of dispensing of coins from dispensers 120*a*-120*d*; movement, rotation, vibration, and/or operating speed of collector point distribution member 130, as applicable, etc.) dynamically during any portion of the refilling process. For example, the coin interface tray 170 angle with respect to the interface module 160 may vary between a pre-selected range of angles and/or the output configuration of the interface module output may be adjusted during filling of a giving denomination to take into account the particular characteristics and behaviors of each type of coin throughout the filling process.

While the present concepts have been described with reference to one or more particular embodiments, those skilled in the art will recognize that many changes may be made thereto without departing from the spirit and scope of the concepts presented herein. For example, although the disclosure discusses the example wherein the coin tray 150 channels are sequentially filled, the coin dispenser 100 could be configured to fill a plurality of channels simultaneously, such as in the aspect of the disclosure wherein a plurality of interface modules 160 and/or a plurality of collector point distribution members 130 are provided. Moreover, a plurality of coin trays 150 could also be processed and filled simultaneously with appropriate multiplication of coin tray receiving areas and interface modules. In one aspect thereof, a single coin source (e.g., a coin reservoir or a coin sorting machine) may dispense coins to a plurality of affixed coin trays (e.g., quarters to one tray having multiple quarter coin channels, dimes to another tray having multiple dime coin channels, a mixture of quarters, nickels, dimes to yet another coin tray, etc.).

In still other potential modifications, the output of the interface module 160 could be configured, via a conventional mechanical connection device (e.g., a threaded portion), to receive any one of a plurality of different adapters configured to correspond to a specified coin tray. Such adapters could be particularly useful to fill individual coin tubes or paper roll tubes. In still another example, the coin interface tray 170 and the coin tray 150 could be integrated into a single unit.

In accord with another aspect, a method for automatic filling of a coin receptacle comprises the steps of providing an automated coin tray refilling system having at least one coin reservoir and providing at least one coin dispenser for regulating the dispensing of coins. The method also includes providing a collector point distribution member adapted to receive coins from coin dispenser(s) at one portion thereof and to output the coins at another portion thereof. The method further includes the step of providing an interface module having an input end disposed to receive coins output from the collector point distribution member and having an output end for dispensing coins, as well as a coin interface tray adapted to receive a coin tray, paper coin roll, and/or coin tube. The method further includes the step of providing a processor(s), wherein the interface module and/or coin interface tray comprise a drive system configured to move a respective one of the interface module and coin interface tray. The method also includes the steps of disposing a coin tray in the coin receiving area and activating the automated coin dispenser.

Each of these embodiments and obvious variations thereof is contemplated as falling within the spirit and scope of the disclosure, set forth in the following claims. For example, the individual coin channels in the dispenser trays 150 may be filled sequentially or non-sequentially and may be filled single or in plural (i.e., more than one coin channel (e.g., some, all) being filled substantially simultaneously). Further, various components described herein may be combined without departing from the concepts presented herein such as, but not limited to, the interface module 160 may be integrated with the collector point distribution 130 or the collector point distribution may be integrated with the dispensers 120*a-d*.

Figure 5:
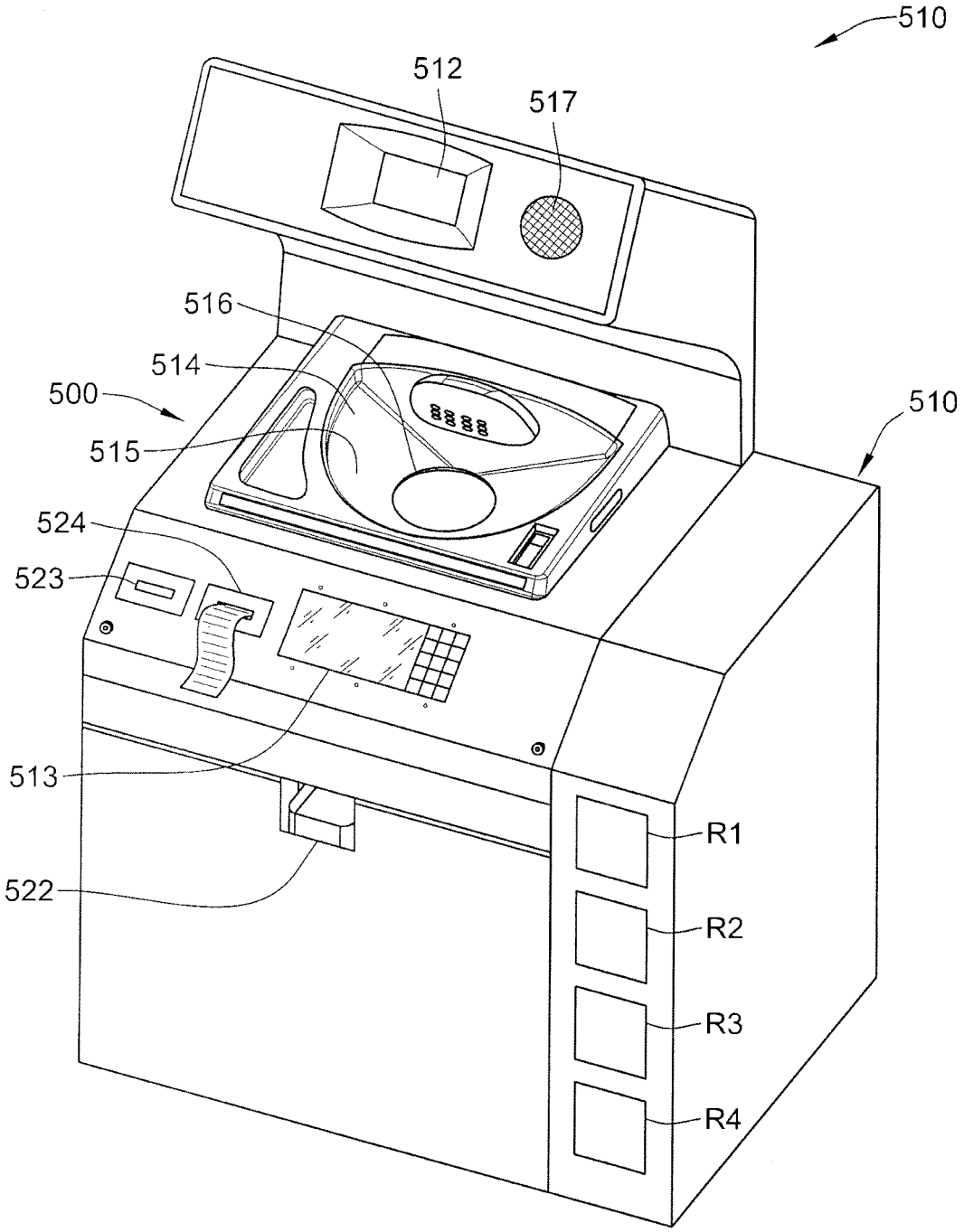
FIG. 5 is a perspective view of a self-service machine comprising a coin repurposer in accord with at least some aspects of the present concepts.

FIG. 5 shows one example of a self-service machine 510 in accord with at least one example of an aspect of the present concepts. The self-service machine 510, as shown, comprises a coin processing module 500 and a repurposing module 570, but may optionally include additional modules to perform other functions (e.g., a value card dispensing module, a check processing module, a bill processing module, etc.).

Figure 10:
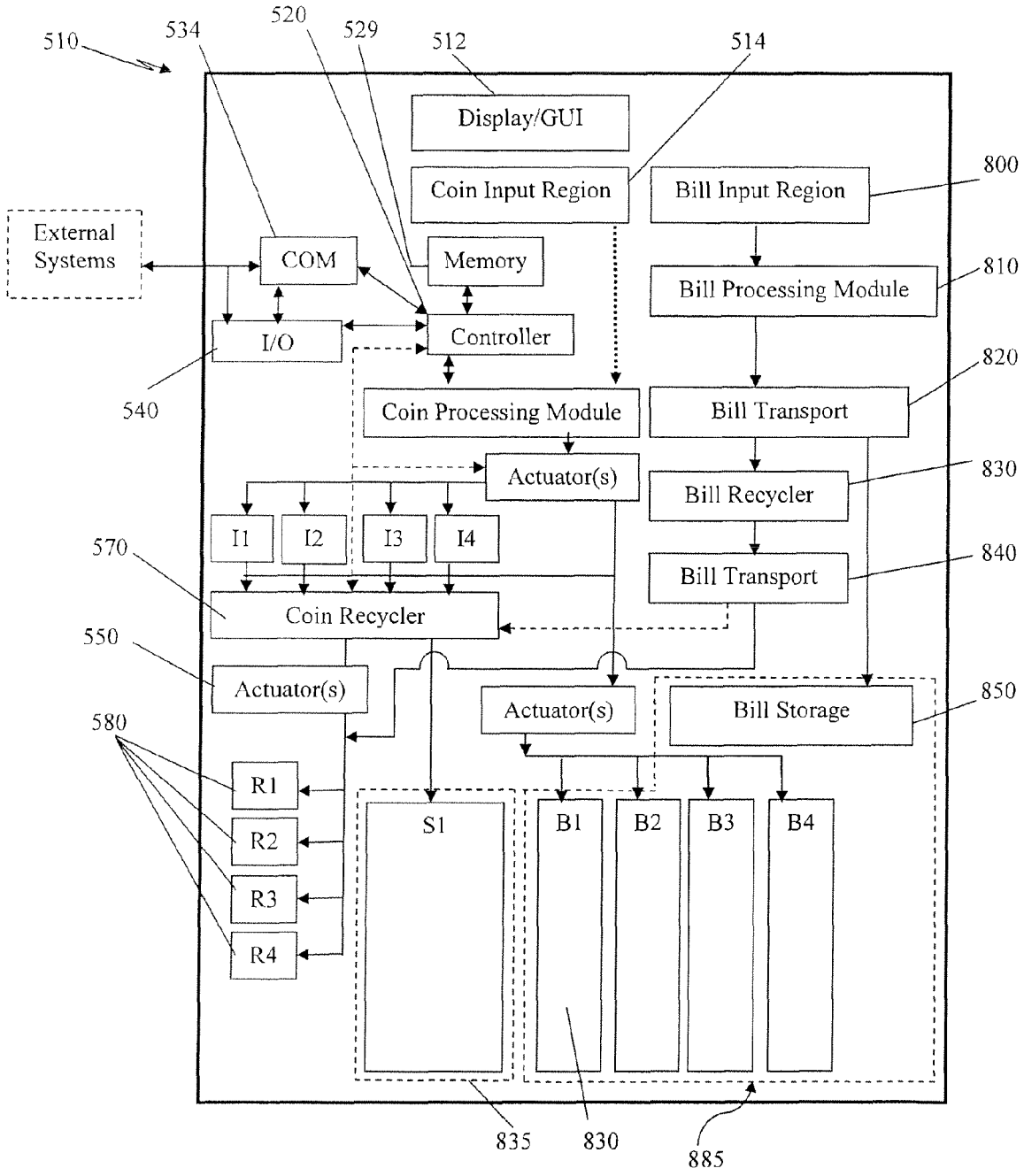
FIG. 10 illustrates another self-service machine in accord with at least some aspects of the present concepts.

The repurposing module 570 comprises a coin repurposing module ("coin repurposer") in at least some aspects of the present concepts. In other aspects, the repurposing module may comprise both a coin repurposing module and currency bill repurposing module, such as is represented in FIG. 10.

In the embodiment of the self-service machine 510 shown in FIG. 5, the self-service machine 510 includes a touch screen 512 and/or other user interface(s) 513 to receive inputs from a user and to display information and prompts or queries to the user. While the touch screen 512 provides one mode of instruction entry from the user of the self-service machine 510, the self-service machine may additionally comprise other devices permitting input of instructions such as, but not limited to, a keypad, keyboard, and/or push-buttons (represented by reference numeral 511) or a microphone 517.

For typical, direct use of the self-service machine 510 by a user to process coins, the user is permitted to input instructions by selection of presented options and interfaces before, during or after processing of the bulk coin, as appropriate. For example, following processing of a batch of coins, the user may be prompted to confirm that the transaction is complete or to confirm that additional coins are to be included with the previously input batch of coins.

A data media processing device 523, such as but not limited to a card reader, is also advantageously, but optionally, provided to enable the self-service machine 510 to read data borne by a data media, such as the magnetic strip of a user's credit card, bank card, ATM card, debit card, retail card (such as Target, or Jewel, etc.), identification card, employee card, etc. and/or to read data borne by a card based data storage medium (e.g., optical card, smart card, etc.). In addition or in the alternative, the data media processing device 523 may be configured to accept and process other types of data media such as, but not limited to, electronic purses or wallets, fob devices, RFIDs, solid state devices, or RF or near field devices.

As noted above, the self-service machine 510 includes a coin processing module 500, which comprises a coin input area 514 configured to receive a batch of coins of a single denomination or mixed denominations from a user for processing such as sorting, discriminating, counting, and/or repurposing. Once processed, the value of the batch of coins may be determined and the value converted to another medium, as described herein.

In the example of FIG. 5, the coin processing module 500 coin input area 514 is of a "gravity-feed" type having sloped or funnel-shaped surfaces 515 to direct coins to a coin processing area within the coin processing module. Alternatively, the coin input area 514 could utilize a pivoting coin tray such as, but not limited to, the pivoting coin tray shown in U.S. Pat. No. 4,964,495 or U.S. Pat. No. 6,976,570, which are each incorporated herein by reference in their entirety. Such pivoting coin trays permit movement of the tray from a first position (e.g., a substantially horizontal position or a declined position), which retains the coins in the coin tray until such time as the user is ready to process the coins, to a second position, wherein the coin tray is inclined so as to cause the coins to slide downwardly under the force of gravity through the opening 516 and into the coin processing module 500. Alternatively, any other input device employing any alternative means of conveyance may be utilized in accord with the present concepts including, but not limited to a conveyance system (e.g., conveyor belt(s), a rotating disc, or a plurality of counter-rotating discs, etc.).

The self-service machine 510 optionally includes one or more dispensing slot(s), port(s) or the like 524 for providing a user (e.g., a patron, an employee, an armored carrier, etc.) with a record of a transaction performed at the self-service machine or a machine-related record (e.g., transaction record, transaction history, service-related record, machine status information, machine sub-system status information, etc.), as appropriate to the user. In addition thereto, or in the alternative, one or more media read/write device(s)(not shown) are provided to receive and/or dispense media via a media port (not shown) and/or to output an electronic record of a transaction performed at the self-service machine or a machine-related record. For example, the self-service machine 510 can automatically provide a printed receipt to a patron via the paper dispensing slot 524 or a patron may optionally request that an electronic receipt be transmitted to the user's personal electronic device (e.g., cell phone, electronic purse, etc.) be given the option to forgo receipt of a printed receipt.

Figure 6:
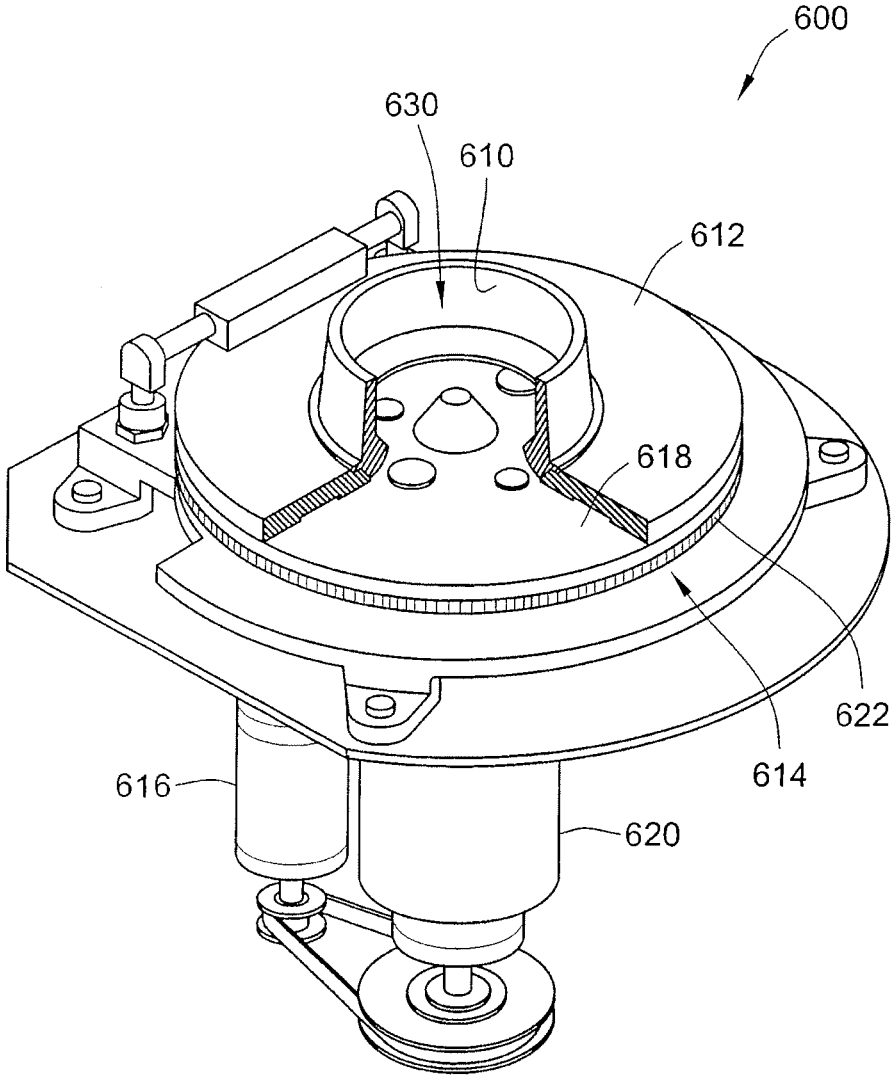
FIG. 6 shows an example of a coin processing device utilizable in accord with at least some aspects of the present concepts.

FIG. 6 shows an example of a disk-type coin processing unit 600 that can be used in the coin processing module 500 of the self-service machine(s) 510 disclosed herein. The opening 116 of the coin input area 514, shown in FIG. 5, leads to a hopper 610, a portion of which is shown in FIG. 6, for receiving the mass of coins input into the coin input area 514 of FIG. 5. The hopper 610 channel feeds the coins through a central opening 630 in an annular, stationary sorting head 612. As the coins pass through this opening, the coins are deposited on the top surface of a resilient pad 618 disposed on a rotatable disk 614.

This rotatable disk 614 is mounted for rotation on a shaft (not shown) and driven by an electric motor 616. The rotation of the rotatable disk 614 of FIG. 6 is slowed and stopped by a braking mechanism 620. The disk 614 typically comprises a resilient pad 618, preferably made of a resilient rubber or polymeric material, bonded to, fastened on, or integrally formed with the top surface of a solid disk 622. The resilient pad 618 may be compressible such that coins laying on the top surface thereof are biased or otherwise pressed upwardly against the bottom surface of the sorting head 612 as the rotatable disk 614 rotates. The solid disk 622 is typically fabricated from metal, but it can also be made of other materials, such as a rigid polymeric material or composite material.

The underside of the inner periphery of the sorting head 612 is spaced above the pad 618 by a distance which is approximately the same as or, in some embodiments, just slightly less than the thickness of the thinnest coin. While the disk 614 rotates, coins deposited on the resilient pad 618 tend to slide outwardly over the top surface of the pad 618 due to centrifugal force. As the coins continue to move outwardly, those coins that are lying flat on the pad 618 enter the gap between the upper surface of the pad 618 and the lower surface of the sorting head 612. As is described in further detail below, the sorting head 612 includes a plurality of coin directing channels (also referred to herein as "shaped regions" or "exit channels") for manipulating the movement of the coins from an entry area to a plurality of exit stations where the coins are discharged from the coin processing unit 600. The coin directing channels may sort the coins into their respective denominations and discharge the coins from exit stations in the sorting head 612 corresponding to their denominations.

Figure 7:
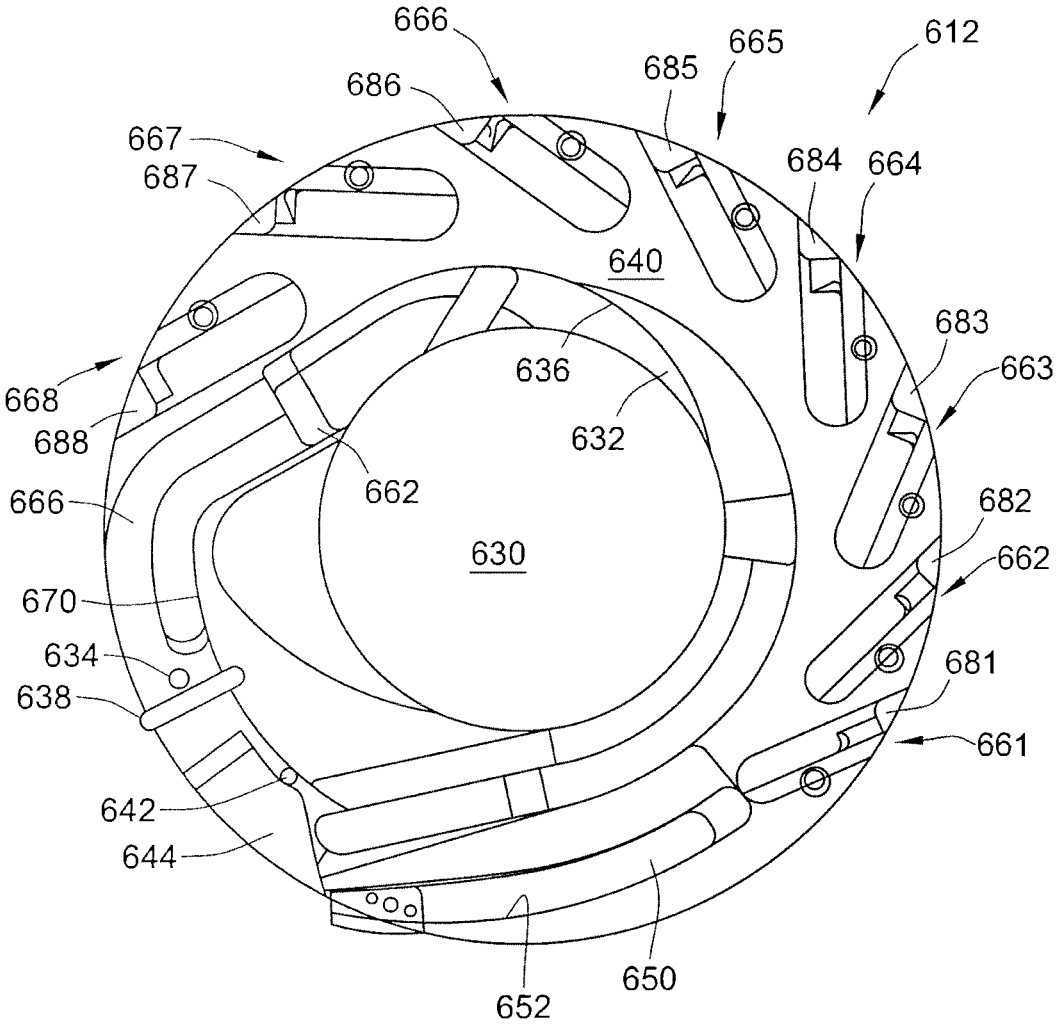
FIG. 7 shows an example of a coin processing device stationary sorting head utilizable in accord with at least some aspects of the present concepts.

Referring now to FIG. 7, the underside of the sorting head 612 is shown. The coin set for a given country can be sorted by the sorting head 612 due to variations in the diameter of the individual coin denominations. The coins circulate between the stationary sorting head 612 and the rotating pad 618 on the rotatable disk 614, as shown in FIG. 6. Coins that are deposited on the pad 618 via a central opening 630 initially enter an entry channel 632 formed in the underside of the sorting head 612.

An outer wall 636 of the entry channel 632 divides the entry channel 632 from the lowermost surface 640 of the sorting head 612. The lowermost surface 640 is preferably spaced from the pad 618 by a distance that is slightly less than the thickness of the thinnest coins. Consequently, the initial outward radial movement of all the coins is terminated when the coins engage the outer wall 636, although the coins continue to move more circumferentially along the wall 636 (e.g., in a counterclockwise direction in FIG. 7) by the rotational movement imparted to the coins by the pad 618 of the rotatable disk 614.

While the pad 618 continues to rotate, those coins that were initially aligned along the wall 636 move across the ramp 662 leading to a queuing channel 666 for aligning the innermost edge of each coin along an inner queuing wall 670. The coins are gripped between the queuing channel 666 and the pad 618 as the coins are rotated through the queuing channel 666. The coins, which were initially aligned with the outer wall 636 of the entry channel 632 as the coins move across the ramp 662 and into the queuing channel 666, are rotated into engagement with inner queuing wall 670. As the pad 618 continues to rotate, the coins which are being positively driven by the pad move through the queuing channel 666 along the queuing wall 670 past a trigger sensor 634 and a discrimination sensor 638, which is operable for discriminating between valid and invalid coins. In some embodiments, the discrimination sensor 638 is also operable to determine the denomination of the coins. The trigger sensor 634 sends a signal to the discrimination sensor 638 that a coin is approaching.

Figure 4:
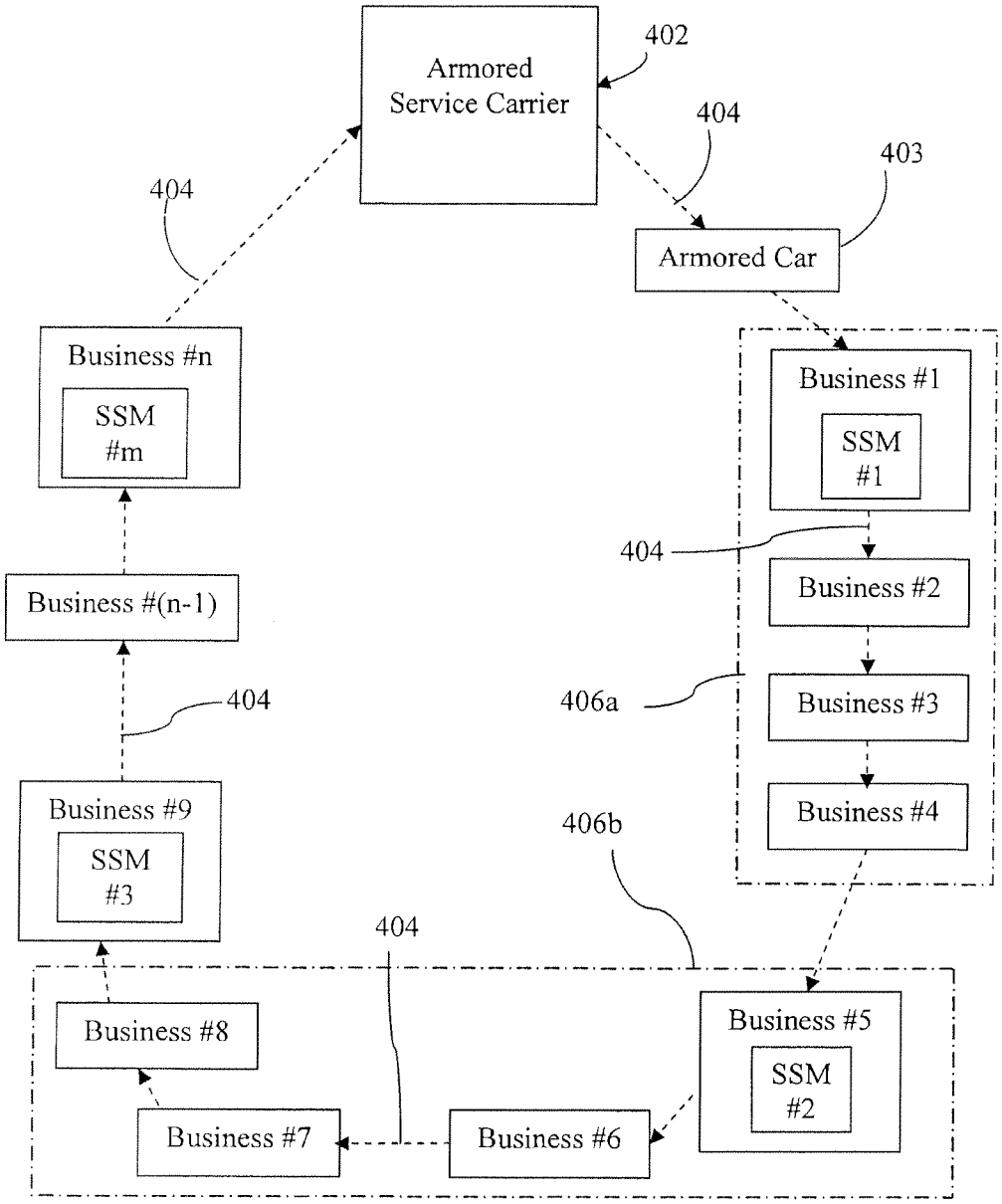
FIG. 4 (Prior Art)
FIG. 4 is a representation of a prior art system for repurposing of coins from self-service machines.

In the illustrated example, coins determined to be invalid are rejected by a diverting pin 642 that is lowered into the coin path such that the pin 642 impacts the invalid coin and thereby redirects the invalid coin to a reject channel 644. The reject channel 644 guides the rejected coins to a reject chute that returns the coin to the user (e.g., rejected coins are routed to the coin reject receptacle 522 of FIG. 5). The diverting pin 642 depicted in FIG. 7 remains in a retracted "nondiverting" position until an invalid coin is detected. Those coins not diverted into the reject channel 644 continue along inner queuing wall 670 to a gauging region 650. The inner queuing wall 670 terminates just downstream of the reject channel 644; thus, the coins no longer abut the inner queuing wall 670 at this point and the queuing channel 666 terminates. The radial position of the coins is maintained, because the coins remain under pad pressure, until the coins contact an outer wall 652 of the gauging region 650. The gauging wall 652 aligns the coins along a common outer radius as the coins approach a series of coin exit channels 661-668 which discharge coins of different denominations through corresponding exit stations 681-688. The first exit channel 661 is dedicated to the smallest coin to be sorted (e.g., the dime in the U.S. coin set). Beyond the first exit channel 661, the sorting head 612 shown in FIGS. 3-4 forms seven more exit channels 662-668 which discharge coins of different denominations at different circumferential locations around the periphery of the sorting head 612. Thus, the exit channels 661-668 are spaced circumferentially around the outer periphery of the sorting head 612 with the innermost edges of successive channels located progressively closer to the center of the sorting head 612 so that coins are discharged in the order of increasing diameter. The number of exit channels can vary according to alternative embodiments of the present disclosure and could advantageously utilize a single exit channel.

The innermost edges of the exit channels 661-668 are positioned so that the inner edge of a coin of only one particular denomination can enter each channel 661-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 618. To maintain a constant radial position of the coins, the pad 618 continues to exert pressure on the coins as they move between successive exit channels 661-668.

Suitable coin processing modules utilizable in accord with the present concepts, such as the coin processing module 500 described in relation to FIGS. 5-7, may comprise, for example, but are not limited to, those disclosed in U.S. Pat. Nos. 8,229,821 B2, 8,042,732 B2, 8,023,715 B2, 7,980,378 B2, 7,963,382 B2, 7,949,582 B2, 7,946,406 B2, 7,886,890 B2, 7,778,456 B2, 7,743,902 B2, 7,658,270 B2, 7,552,810 B2, 7,551,764 B2, 7,438,172, B2, 7,427,230 B2, 7,349,566 B2, 7,337,890 B2, 7,269,279 B2, 7,243,773 B2, 7,188,720 B2, 6,996,263 B2, 6,896,118 B2, 6,892,871 B2, 6,810,137 B2, 6,755,730 B2, 6,748,101 B1, 6,731,786 B2, 6,724,926 B2, 6,678,401 B2, 6,637,576 B1, 6,603,872 B2, 6,579,165 B2, 6,318,537 B1, 6,171,182 B1, 6,068,194, 6,039,645, 6,021,883, 5,997,395, 5,982,918, 5,943,655, 5,905,810, 5,743,373, 5,630.494, 5,564,974, and 5,542,880, or those disclosed in U.S. patent application Ser. No. 13/327,900, titled "Coin Processing Systems, Methods and Devices" (published as US 2012-0156976 A1) or 61/695,616, titled "Disk-type Coin Processing Unit with Angled Sorting Head," each of the preceding being assigned to the present applicant and each of which is incorporated herein by reference in its entirety. Alternatively, the coin processing module 500 may comprise a gravity rail sorter, such as that disclosed by Molbak in U.S. Pat. No. 6,976,570, which is incorporated herein by reference in its entirety, a powered rail sorter, a multi-disc or disc-to-disc sorter, or any other type of bulk coin processing mechanism or system without limitation.

Figure 8:
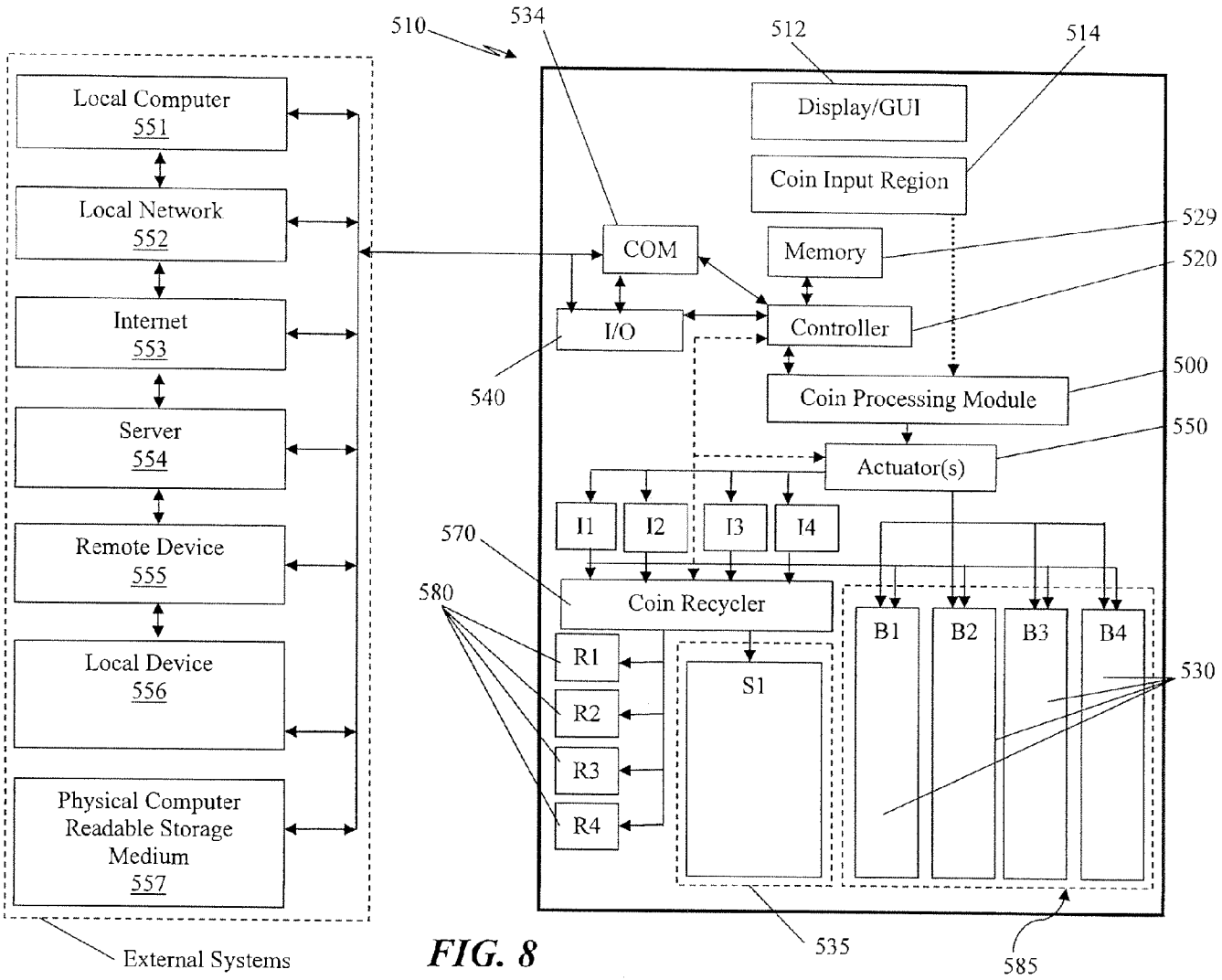
FIG. 8 illustrates a self-service machine comprising a coin repurposer communicatively coupled to a plurality of remote devices or nodes in accord with at least some aspects of the present concepts.

In accord with aspects of the present concepts, such as that represented in the self-service machine 510 of FIG. 5 and FIG. 8, the coin processing module 500 is functionally associated with a coin repurposing module 570 ("coin repurposer") and selectively outputs coins thereto for packaging and repurposing/distribution.

As shown in FIG. 8, the self-service machine 510 includes a controller 520 communicatively coupled to a memory 529 and a coin processing module 500 and being configured to control the coin processing module as well as other systems and components (e.g., actuator(s) 550, coin repurposer 570, etc.). The controller 520 receives input signals from, and outputs signals (e.g., control signals, instructions, etc.) to, the various components and systems of the self-service machine 510 (e.g., coin repurposing module 570, actuators 550, electronically/magnetically controlled access panels 580 of repurposed currency retrieval areas R1-R4, etc.) through internal buses, connections, and input/output circuits (not shown).

The controller 520 is configured to communicate with external systems via communication device 534 and/or I/O 540 (e.g., a serial port, parallel port, USB port, ECP port, IEEE 1394 port, broadband device, Ethernet port, wireless device (e.g., Bluetooth, WLAN, IrDA, RF, IR, ZigBee, Wireless USB, and IEEE 802.11), modem, land line (POTS) cellular or mobile phone, and/or other communication device) and an associated communication pathway(s) appropriate to the type of communication needed (e.g., hardwired connection, wireless connection, etc.). The communication device 534 and/or I/O 540 are, via the communication pathway(s), connectable to, for example, a dedicated local computer or computers 551, a network 552 (LAN, WAN, etc.), the internet 553, a server 554, a remote device 555 (e.g., cell phone, computer, etc.), a local device 556 (e.g., cell phone, key fob, tablet computer, etc.), and/or a local or remote physical computer-readable storage medium 557 (e.g., a flash memory device, a hard drive, a solid-state memory device, a magnetic memory card, a magnetic disk, an optical disk, memory chip, memory card, USB flash drive, etc.). It is to be understood that the controller 520, as used herein, may comprise one or more processors and any combination of associated hardware, software, and/or firmware disposed or resident inside and/or outside of the self-service machine 510, either non-distributed or distributed, configured to control internal and external processes and communications self-service machine.

A host system (e.g., a dedicated local computer 550 or remote computer 555) is optionally communicatively coupled to a plurality of self-service machines 510*a*, 510*b*, . . . 510*n* to communicate with each of the self-service machines 510 for tracking the various transactions (e.g., deposits) occurring therein and/or monitoring a status of the self-service machines, or sub-systems or components therein. By way of example, the self-service machines 510 send signals to the host system 550, 555 when a fault condition (e.g., a coin jam, coin bag is full, etc.) is encountered.

In one example of communications between the self-service machine and external systems, a store (e.g., Business #1 in FIG. 9) may input a threshold condition (e.g., mixed coin receptacles B1-B3 full, mixed coin receptacle B4 75% full) for the self-service machine 510 controller 520 to initiate communication via communication device 534 and/or I/O 540 and associated communication pathway(s) to a remote computer 555 associated with the armored carrier service and place a request for the armored carrier service to pick up coins from the self-service machine 510.

In another example of communications between the self-service machine 510 and external systems, and as discussed elsewhere herein, a store (e.g., Business #2 in FIG. 9) or a user (e.g., User #1 in FIG. 9) may input a request for coins (e.g., via a remote computer 555 or remote user interface 556) of a specific total and/or mix. The self-service machine 510 controller 520, during one or more subsequent coin processing operations, then controls the actuator(s) 550 to distribute the specific total and/or mix to one of the intermediate coin holding areas I1-I4 shown in FIG. 8, with the balance of the coins processed during the one or more subsequent coin processing operations being deposited in one or more of the coin receptacles B1-B4 (e.g., coin bins, coin bags, etc.), as appropriate to the receptacle (e.g., single denomination, mixed denomination, etc.). As shown in FIG. 8, the coin receptacles B1-B4 are disposed within a secured area 585 (represented by a dashed line) accessible by authorized personnel, such as an armored carrier service or business employee (e.g., where the business is a financial institution).

Alternatively, responsive to the coin order from the business or user, the self-service machine 510 controller 520, during one or more subsequent coin processing operations, controls the actuator(s) 550 to distribute the specific total and/or mix to more than one of the intermediate coin holding areas I1-I4 shown in FIG. 8, with the balance of the coins processed during the one or more subsequent coin processing operations being deposited in one or more of the coin receptacles B1-B4 (e.g., coin bins, coin bags, etc.), as appropriate to the receptacle (e.g., single denomination, mixed denomination, etc.). In this latter example, a user may specify coins of different denominations to be separately packaged and, rather than a single intermediate coin holding area (e.g., I1) being temporarily dedicated to the order placed by the business or user (e.g., mixed coins of the specified total and/or mix), a plurality of intermediate coin holding areas (e.g., I1-I2) are temporarily dedicated to the order placed by the business or user (e.g., mixed coins of the specified total and/or mix), with one of the intermediate coin holding areas designated to hold coins of a single denomination. In yet another example, one or more of the intermediate coin holding areas can each be designated to receive and dispense a single denomination (e.g., I1 (quarters), I2 (dimes), I3 (nickels), I4 (pennies)). In such example, the intermediate coin holding areas I1-I4 may comprise, by way of example, a Suzo Cube Hopper MK2®, Suzo Excel™ hopper, Suzo Evolution Hopper, Asahi Seiko SH-400 Mini Coin Hopper, and/or Asahi Seiko WH-2 or WH-3 Coin Hopper, which are single denomination hoppers configured to hold and discharge coins of a single denomination. Of course, the intermediate coin holding areas I1-I4 may comprise any coin storage and dispensing device, or any combination of different coin storage and dispensing device (i.e., different intermediate coin holding areas may comprise different coin storage and dispensing devices), including, by way of further example, coin hoppers described in U.S. Pat. Nos. 5,017,176, 6,626,752 B2, 6,776,703 B2, 6,991,530 B2, 7,163,454 B2, 7,429,213 B2, and 7,771,258 B2, each of which is incorporated herein by reference in its entirety.

Of course, the representation of the self-service machine 510 in FIG. 8 is exemplary and more (or less) coin receptacles or intermediate coin holding areas may be provided within the self-service machine 510 or appurtenant structures. For example, five coin receptacles (e.g., B1-B5) are provided with the coin receptacles being configured to receive quarters, dimes, nickels, pennies and mixed denomination, respectively. In another configuration, ten coin receptacles (e.g., B1-B10) are provided with one or more coin receptacles being configured to receive each of quarters, dimes, nickels, and pennies, and one or more coin receptacles being configured to receive mixed denominations (e.g., overflow). Such "overflow" permits diversion of coins from a single-denomination receptacle or intermediate coin holding area that has reached its limit. The overflow receptacle would contain mixed denomination coins that would need to be sorted during a post-sorting operation, which could include a coin-repurposing operation later conducted within the self-service machine 510. Utilization of one or more overflow receptacles extends the time between coin receptacle changes (e.g., armored carrier pickup) and reduces the potential for machine service interruption. Likewise, additional intermediate coin holding areas could be provided (e.g., eight intermediate coin holding areas I1-I8) with one or more coin receptacles being configured to receive and output each of quarters, dimes, nickels, and pennies.

In at least some embodiments, one or more actuators or actuated devices 550, as represented in FIG. 8 and FIG. 10, are utilized within the stationary sorting head and/or outside of the stationary sorting head to control the movement of the coins within the coin processing module or outside of the coin processing module. For example, in some embodiments, coin counting sensors are disposed in each of the coin exit channels (e.g., exit channels 661-668 of FIG. 7) of the sorting head 612 or are disposed just outside the periphery of the sorting head. Alternatively, a single counting sensor can be employed (e.g., discrimination sensor 638 can be utilized as a counting sensor where a valid coin signature is counted as a valid coin of a particular identified denomination). However configured, as coins move past the counting sensor(s), the controller 520 receives a signal from the counting sensor(s) for each valid coin output from the sorting head 612 and adds one to a counter maintained in the physical memory 529 for that particular denomination (or maintained in a remote physical memory (e.g., reference numeral 557 in FIG. 8)).

As noted above, the self-service machine 510 comprises one or more coin receptacles B1-B4 such as, but not limited to, one or more coin bin(s), one or more coin bag(s) (of any size), one or more coin cassette(s), etcetera, to receive coins output from the coin processing module 500.

In accord with the present concepts, selected coins output from the coin processing module 500 are output to a coin repurposer 570 wherein the coins are packaged and preferably, but optionally, sealed, in a deliverable coin package (e.g., fabric bag, plastic bag(s), plastic wrap, shrink-wrap, sealed container, plastic coin tube, paper coin tube, etc.). The deliverable coin package may comprise, for example, one or more sealable bags that are sealed, in the coin repurposer or external to the coin repurposer, using one or more of an adhesive seal, an ultrasonic seal, a heat seal, a mechanical sealing device (e.g., crimping, metal band, etc.), and/or other conventional sealing device.

The coin packages formed by the coin repurposer 570 are output to a secured repurposing location within the self-service machine 510 (e.g., small to medium repurposed currency retrieval areas R1-R4 or large repurposed currency retrieval area S1 in accessible region 535 (represented by a dashed line)) where they are accessible to designated personnel or customers. As noted above, the coin receptacle(s) B1-B4 are configured to either receive a single denomination of coin (e.g., quarters only) or to receive any combination of mixed denominations of coins (e.g., quarters and dimes in a mixed receptacle). In accord with various aspects of the present concepts, one or more coin receptacles (e.g., B1-B4 in FIG. 8) are utilized to store coins deposited by users, for eventual pickup by an armored carrier, and the coin repurposer(s) 570 is utilized to package coins deposited by one or more users of the self-service machine 510.

In at least some aspects of the present concepts, one or more intermediary coin storage units (e.g., I1-I4 shown in FIG. 8) are disposed between the coin processing module 500 and the coin repurposer(s) 570 to regulate flow between the coin processing module 500 and the coin repurposer(s). When the intermediary coin storage units, individually or collectively, bear enough coins to satisfy an order for a specific coin total and/or mix, the intermediary coin storage unit(s) output coins corresponding to the specific coin total and/or mix to the coin repurposer 570 to package the coins in a deliverable coin package (e.g., plastic bag, plastic wrap, shrink-wrapped container, sealed container, plastic tray, etc.). In at least some aspects of the present concepts, the self-service machine 510 is configured to discharge processed coins to the one or more intermediary coin storage units until the one or more intermediary coin storage units are full, at which time the controller 520 diverts processed coins to the one or more coin receptacles (e.g., B1-B4 in FIG. 8) designated for pickup by an armored carrier. In other aspects, the self-service machine 510 is configured to discharge processed coins to the one or more intermediary coin storage units until such time as a set partially full condition (e.g., 50% full, 75% full, etc.) has been satisfied, at which time the controller 520 diverts processed coins to the one or more coin receptacles (e.g., B1-B4 in FIG. 8) designated for pickup by an armored carrier.

In at least some aspects, the deliverable coin package could comprise one or more bags disposed within another bag. For example, one or more bags of each of pennies, nickels, dimes and quarters are able to be provided within one larger bag. As another example, the deliverable coin package comprises one bag having disposed therein a plurality of separate, single-denomination bags that collectively form a pre-determined (e.g., determined by the business in which the self-service machine 510 is disposed, programmed, selected from a menu, input into data entry fields, etc.) coin mix for a cash register drawer. Thus, at the beginning of a cashier's shift, the cashier can retrieve a single bag from the self-service machine 510 (e.g., accessing a designated repurposed currency retrieval area using an employee code), take an empty till and fill it with the provided coins. Similarly, if the self-service machine 510 comprises a currency bill module, currency bills may optionally be packaged together with the coins in the deliverable coin package (e.g., a defined "cashier till mix" comprising a predetermined number of 20-dollar bills, 10-dollar bills, 5-dollar bills, one-dollar bills, quarters, dimes, nickels, and pennies). Where the self-service machine 510 comprises a currency bill module, a strapping module or other currency bill packaging module may optionally be provided to strap or wrap the currency bills together in a mixed-currency bundle or may strap or wrap the currency bills separately by denomination.

As noted above, a business in which the self-service machine 510 (or other requestor) can control a quantity of coins, denominations of coins, and packaging (e.g., mixed coin or coin separated by denomination) for each deliverable coin package or packages. In one example, a business (e.g., a store, a grocery store, a "big box" store, etc.) instructs the self-service machine 510 to produce quarter bags each having two hundred quarters for self-checkout stations of the business because those stations have larger coin hoppers that require greater volumes of quarters than the cashier's tills. In other words, the repurposing feature of the self-service machine 510 is advantageously programmable by a user of the self-service machine 510 such as by, for example, selection of inputs (e.g., selectable buttons, soft buttons, etc.) from a self-service machine GUI or by selection of inputs from a computer or device (e.g., a POS system, a cashier terminal, a tablet computer, a smart phone, a wireless device, local computer, remote computer, etc.) communicatively coupled to the self-service machine.

To illustrate one potential GUI, a smart phone application links a cellular phone to the self-service machine and displays, on the smart phone GUI, an interface adapted to receive an input of an amount requested (e.g., $55), following which successive inputs define how the amount requested is to be allocated as to denomination(s). Alternatively, the smart phone GUI interface is adapted to directly receive inputs of numbers of one of more available coin denominations, numbers of one of more available coin denominations of bills, or numbers of both one of more available denominations of both coins and bills, as applicable to a particular self-service machine 510. Following input of the requested amount of the deliverable currency package to be formed by the self-service machine 510, the smart phone GUI then guides the user through various options that may be available regarding form of packaging (e.g., different classes of users may be afforded different options for packaging), labeling of the deliverable currency package(s), and other transaction variables (e.g., expected time for pick-up, etc.). The controller(s) 520 of the self-service machine may optionally inform the user, via the smart phone GUI, as to whether or not the order for the requested deliverable currency package(s) can be immediately filled via currency physically residing in the self-service machine 510 or whether the order will require additional time to fulfill. Optionally, the smart phone GUI displays to the user potential alternative formulations of the requested amount that could be immediately satisfied by the self-service machine or other amounts that could be immediately satisfied by the self-service machine. Ultimately, the user is guided by the smart phone GUI to a payment screen where the user makes payment for, or accounting for, the deliverable currency package(s) to be formed by the self-service machine 510. Of course, this functionality would also available through the self-service machine GUI.

The programmable features include, without limitation, inputs facilitating selection of a specified mix of currency (e.g., coins, currency bills, or both, of specified numbers and denominations), selection of a specified type of packaging selected from a plurality of packaging options, selection of a specified label or labels for the packaging selected or for a default package, selection of a specified output designation (e.g., repurposed currency retrieval area(s), intermediary coin storage unit(s), etc.), selection of different forms of notification to the person ordering the repurposed currency (e.g., email, text, phone message, etc.). Additionally, the programmable features advantageously include provision for allowing a user to specify different standing orders for different times of the day and/or for different days with corresponding standing provisions for payment for such orders. By way of example, coin requirements of a business utilizing a high volume of coins in the cash tills may be greater on a Friday or Saturday than on a Monday and the business's schedule for utilizing repurposed coins from a store-based self-service machine 510 (or a self-service machine 510 located in another store or other nearby location) may reflect varying needs over a day or over days of the week.

After formation of the deliverable coin package, the coin repurposer 570 then outputs the deliverable coin package to a repurposed currency retrieval area R1-R4 for pickup by the business or by the user submitting the coin order or an agent thereof, as appropriate. The repurposed currency retrieval areas R1-R4 may be of the same size or volume or may comprise more than one different size or volume. Moreover, a greater number or a lesser number of repurposed currency retrieval areas R1-Rx may be provided, where x is any integer.

In the event that a requested order has the potential to exceed a storage capacity of a repurposed currency retrieval area, the self-service machine 510 can be configured to automatically divide the order into separate deliverable coin packages and dispense such separate deliverable coin packages to two repurposed currency retrieval areas.

In at least some aspects, the one or more intermediary coin storage units (e.g., I1-I4 shown in FIG. 8) are maintained with a predetermined level of coins (e.g., full, 90% full, 80% full, etc.) so as to be able to rapidly fill orders for coins. Further, the one or more intermediary coin storage units (e.g., I1-I4 shown in FIG. 8) are configured to dispense not only to respective repurposed currency retrieval area(s), but are optionally configured to dispense to coin receptacle(s) B1-B4, as represented by the arrows in FIG. 8 from intermediary coin storage units I1-I4 to the coin receptacles B1-B4 to provide an alternative means to discharge the intermediary coin storage units I1-I4 if desired or needed (e.g., for coin pick up by armored service).

In another example, the requestor (i.e., the business submitting the coin order or the user submitting the coin order) could be required by the self-service machine 510 to pre-authorize an employee of the business in which the self-service machine 510 is disposed to pickup and hold the coin package (e.g., in a back room, at a service desk, etc.) on behalf of the requestor so as ensure that at least one repurposed currency retrieval area is always available for a new order. Thus, using the example of FIG. 9, a designated business employee of Business #1 in FIG. 9 could be authorized to retrieve coin packages from one or more of repurposed currency retrieval area(s) R1-R4, or other repurposed currency retrieval area(s) of SSM #1, as applicable, and hold such packages in a secure area for later pickup by the requester.

As noted above, in some aspects of the present concepts, the order may be placed by a user or business via a remote computer 555 or remote user interface 556 located remotely from the self-service machine 510. In other aspects of the present concepts, the order may be placed by a user of the self-service machine 510 to receive back, via the coin repurposer 570, a portion of the input coins in the form of the noted deliverable coin package. For example, a user may have a large volume of coins to process, but the user does not want to pick through the coins to remove all of the quarters and the user wants to keep the quarters while depositing the remainder of the coins (e.g., to receive cash or value card in return therefor, to transmit the deposited amount to an account, etc.). The user could therefore instruct the self-service machine 510 to package all quarters and return them to the user following processing. The coin package formed of all of the processed quarters is then discharged to a repurposed currency retrieval area R1-R4, where it may be retrieved by the user, and the user is instructed (e.g., via display 512, lights (not shown), etc.) as to which repurposed currency retrieval area bears the package. The repurposed currency retrieval areas R1-R4 each advantageously comprise a controlled access panel 580 comprising a lock (e.g., an electromagnetic lock, an electromechanical lock, etc.) controllable by the controller 520, the controller enabling temporary access to a specified access panel 580 responsive to entry of a secure code, ID, biometric characteristic or the like into the self-service machine 510 (e.g., an entry in the touch screen 512 and/or other user interface(s) 513, transmission to or input to data media processing device 523, etc.). Where a user is requesting a coin package contemporaneously with a processing transaction, such as the above-noted example wherein a coin package formed of all of the user's processed quarters is discharged to a repurposed currency retrieval area (e.g., R1), the controller unlocks the magnetically-controlled access panel 580 corresponding to that repurposed currency retrieval area to permit access thereto by the user (e.g., the access panel could be enabled to rotate about a hinge when pressed, the access panel could be configured to automatically slide to an open position, the access panel door could be actuator-driver responsive to controller 520, etc.).

In at least some aspects, a transaction-specific label, receipt, record, ticket, or device (e.g., RFID) is affixed to the package produced by the self-service machine 510. In other aspects, such transaction-specific label, receipt, record, ticket, or device is incorporated into the package or deposited into the repurposed currency retrieval area together with the package. The self-service machine 510 printer (not shown) may comprise, for example, a conventional laser printer, an ink-jet printer, impact dot matrix printer, or a thermal printer. The descriptive label, receipt, or record could include, but is not limited to, any combination of order date, order request, remote computer or remote device ID, ordering entity or person, number of coins for each denomination, total amount for each denomination, service fees, date and time of deposit to repurposed currency retrieval area, code(s)(e.g., alphanumeric text and/or computer-readable image such as a 2-D or 3-D bar-code for security or identification), or other transaction-related information.

In at least some aspects of the present concepts, the packaging could be omitted entirely and the coins of the specified total and/or mix simply discharged to a repurposed currency retrieval area R1-R4 for the user's removal. By way of example, this could be a suitable option if the number of coins to be returned to the user does not require packaging (e.g., a small number of coins, such as 20 quarters or 50 dimes, could be removed by hand and transferred to a pocket).

The self-service machine 510 is configurable to require advance payment for coin packaging, whereupon the requestor pays in advance when placing the coin packaging order (or other packaging order specific to the self-service machine capabilities such as, but not limited to, coins and bills, coins and value cards, bills and cards, etcetera). The requester is then provided with a security code to enter into the self-service machine 510 to access the repurposed currency retrieval area in which the coin package is held. In other aspects, a requester may be optionally permitted to fill an order for coins (or other currency package) and, following identification of the package to the self-service machine 510, at a later time, input payment to the self-service machine 510. In still other aspects, a requester may be optionally permitted to fill an order for coins (or other currency package) that is picked up by an authorized employee of the business in which the self-service machine 510 is disposed and held for pickup by the requestor and payment by the requestor.

In at least some aspects of the present concepts, the self-service machine 510 comprises a currency dispensing module (not shown) configured to dispense, from a currency dispenser (e.g., a cassette dispenser or multi-cassette dispenser such as, but not limited to, Fujitsu F53, F56, F400, or F510e multi-cassette media dispensers), one or more currency bills of one or more denominations. The dispensed currency may be selectively directly to a user singly or as a stack of currency bills, as a conventional ATM, or may optionally be output to a currency repurposer, functioning similarly to the coin repurposer, for packaging or, as yet another alternative, output to the coin repurposer for packaging with a coin order.

In at least some aspects of the present concepts, the plurality of self-service machines 510*a*-510*n* (not shown) are linked to a host system (e.g., remote compute 555) that communicates with each self-service machine 510*a*-10*n* and tracks the transactions occurring therein. The self-service machines 510*a*-510*n* are advantageously configured to send signals to the host system to communicate system information, such as, but not limited to, signals indicating that one or more coin receptacles B1-B4 are full or past a predetermined limit, one or more repurposed currency retrieval areas R1-R4 have currency packages ready for pickup, or a fault condition (e.g., a coin jam, actuator malfunction, dispenser error, etc.) of the self-service machine 510.

If the self-service machine 510 is, for whatever reason, not able to immediately fill a coin order (or any combination of currency and/or value media), such as by one or more intermediary coin storage units (e.g., I1-I4 in FIG. 8) having a coin quantity less than that requested, the controller 520 can inform the requester that the package will not be ready for immediate pickup. In such situations, the controller 520 can inform the requester that the controller 520 will contact the requester when the package is ready for pickup and/or with an estimate of when the package will be ready for pickup, as desired. An estimated time of order completion is calculated, for example, based on a processing history at the self-service machine 510 in view of the requester's requirements and current status of the one or more intermediary coin storage units (e.g., I1-I4 in FIG. 8).

Businesses may also elect to place standing orders for coin packages, to be filled on a recurring basis, with pickups arranged at either the self-service machine 510 or at a service counter of a business in which the self-service machine is disposed. In fact, the business in which the self-service machine 510 is disposed may itself elect to place its own coin orders so that the coins brought into the business by the public and processed in the business can be packaged and used by the business in which the self-service machine is disposed to recirculate the coins therein with less recourse to purchase of coins from armored car services. Thus, the self-service machine 510 enables coin recirculation both within the business and for other parties.

As previously noted, repurposing features of the self-service machine 510 permit the business in which the self-service machine 510 is disposed to not only avoid the cost of ordered coins on a routine basis from an armored service, but also to provide an efficient and timely means to obtain coin in a readily usable form.

In one aspect, the self-service machine 510 is communicatively linked to the businesses' point-of-sale (POS) system or network such that the POS system itself places orders with the self-service machine 510 when coins or needed, in advance of an anticipated need by a fixed or selectable amount, or on a schedule (e.g., based on time-based historical data). By way of example, the POS, either singly or in combination with the self-service machine 510, or the self-service machine 510 independent of the POS, could be set to predict an upcoming coin shortage and start packaging coins in advance of the anticipated time of need (e.g., to fill the cash register drawers).

Although the prior examples described situations in which the self-service machine 510 is truly a self-service machine disposed in a publicly accessible location, the self-service machine is semi-assisted in another optional configuration. Thus, a self-service machine 510 can be integrated into a businesses' self-service counter and an authorized attendant is required to assist a customer with the processing and/or retrieval operations. In one aspect of this configuration, the repurposed currency retrieval areas are advantageously disposed to be rearwardly facing, relative to the front of the self-service machine 510, to provide access to such authorized attendant, but not to the public. In this manner, only an authorized attendant is able to retrieve a deliverable currency package (e.g., a deliverable coin package, a deliverable currency bill package, or a combined deliverable coin and currency bill package) and disperse such package responsive to appropriate controls (e.g., scanning employee badge when providing a deliverable coin and/or currency package to a cashier at a shift's start, requiring a requestor to input an authorization code into the self-service machine 510 to open a designated repurposed currency retrieval area for the authorized attendant's access, etc.). By way of example, the large repurposed currency retrieval area S1 in accessible region 535 in FIG. 8 or FIG. 10 is configurable to face rearwardly in such a semi-assisted configuration.

In some aspects of the present concepts, the self-service machine 510 is configured to only process a single denomination of coin (e.g., quarters) or configurable to process only a single denomination. For example, where coins are already denominated, but need to be packaged and repurposed, such single denomination can be input into the self-service machine 510 and repurposed in a more convenient form defined by the user (e.g., a business).

In yet other aspects of the present concepts, a self-service machine 510 as described herein is advantageously utilizable not in a public location for public access, but by businesses such as armored carriers or Cash-In-Transit (CIT) businesses, which process currency bills and coins and which physically transfer currency bills and coins from one location to another. As incoming currency bills and coins (e.g., mixed coin bins, denominated coin, etc.) are input into the self-service machine 510 for processing (e.g., counting and verification), the CIT is able to input into the self-service machine an order for a specific deliverable package that is required to be delivered to a particular business, after which the self-service machine automatically produces and delivers the deliverable package comprising coin(s) and/or bill(s).

Figure 9:
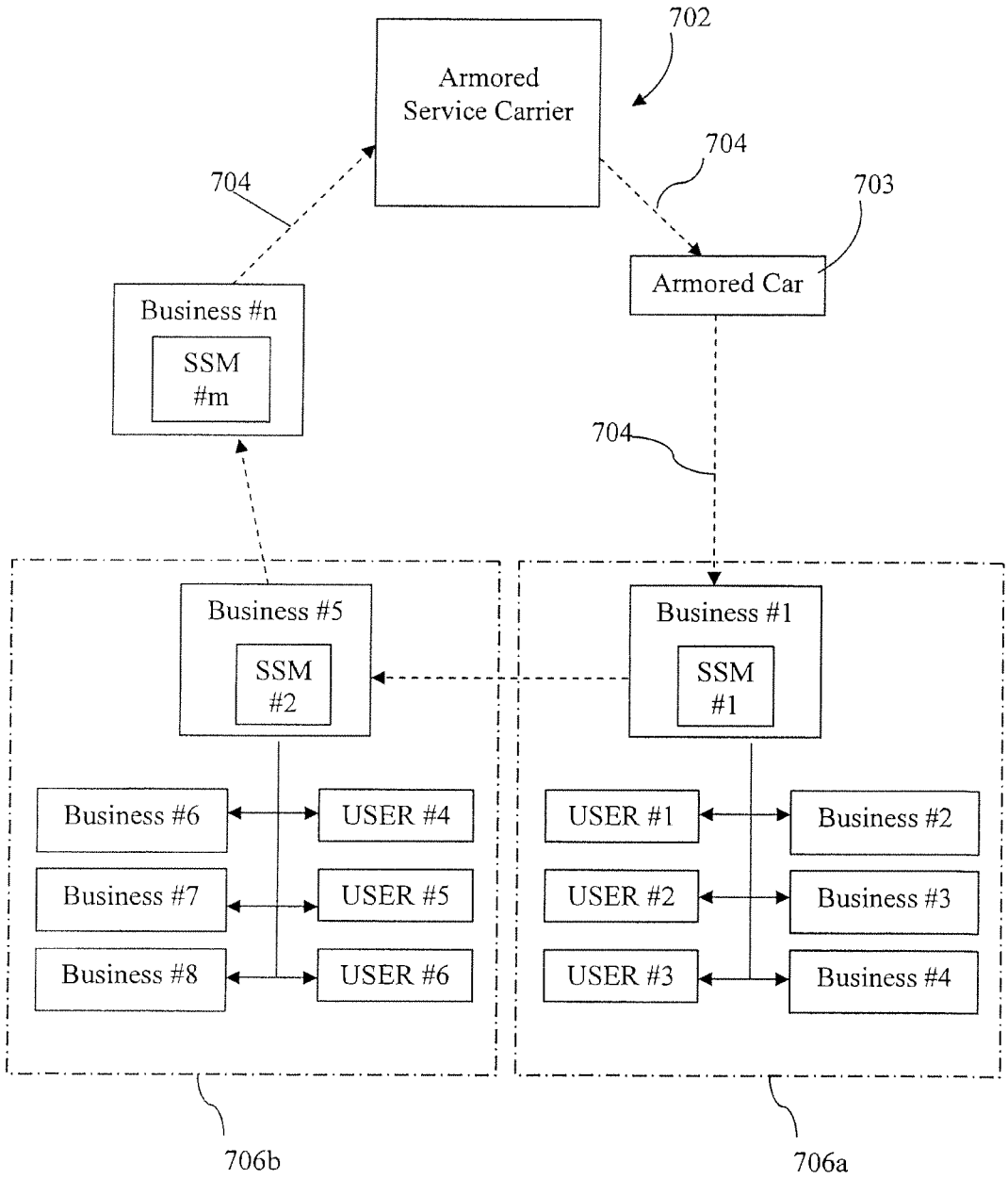
FIG. 9 is a representation of a system for repurposing of coins from self-service machines in accord with at least some aspects of the present concepts.

FIG. 9 is a representation of a system for repurposing of coins from self-service machines 10, in accord with at least some aspects of the present concepts, which is to be contrasted with the flow of the conventional practices and systems shown in FIG. 1. As with FIG. 1, an armored car carrier 702, armored vehicle 703, and route 704 are represented. However, instead of the armored vehicle 703 individually servicing each of the plurality of different businesses #1-*n* (where n represents any number) along the route, including those with one or more self-service machines SSM #1-#m (where n represents any number) disposed therein, FIG. 9 shows that Business #1 and Business #2 each utilize a self-service machine 510 comprising one or more currency repurposing modules (e.g., a coin repurposer 570 and/or a bill repurposer 830, described below) in accord with the present concepts. As shown, reference numeral 706*a* denotes an area where Businesses #1-#4 are in the proximity of one another and reference numeral 706*b* denotes an area where Businesses #5-#8 are in the proximity of one another. In FIG. 9, the armored car 703 route includes dropping off currency (e.g., wrapped or packaged coins and/or bills) and picking up currency (e.g., mixed coins) according to the requirements of Business #1, Business #5 and Business #9 (not shown)—Business #n (having SSM #m, where m is any integer), before returning to the armored service carrier 702.

Instead of being serviced by the armored service carrier, Businesses #2-#4 elect to pick up packaged coins and/or currency from SSM#1 at Business #1 and Businesses #6-#8 elect to pick up packaged coins and/or currency from SSM#2 at Business #5. To illustrate, a Jewel-Osco grocery store is Business #1, a SUBWAY® restaurant is Business #2, a pizza restaurant is Business #3, and a dry cleaner is Business #4, all of these businesses being located within a strip mall or the like. The SUBWAY® restaurant can place an order for coins and/or currency bills through the self-service machine 510 disposed in the Jewel-Osco and can pick up the deliverable repurposed currency package at the self-service machine. Thus, rather than ordered coins and/or currency from armored service carriers, Businesses #2-#4 can rely instead on a local currency provider, Business #1, for currency processing needs. Likewise, a similar dynamic may occur as between Business #5 and Businesses #6-#8. Of course, as noted above, non-commercial requestors of repurposed currency are represented in FIG. 10 by Users #1-#6.

As shown in FIG. 10, the self-service machine 510 may optionally include a currency bill input region 800, a currency bill processing module 810, a bill transport system or systems 820, a currency bill repurposing module 830 ("bill repurposer"), a bill repurposer bill transport 840, and a currency bill storage 850. FIG. 10 shows that the coin receptacles B1-B4 and the currency bill storage 850 are disposed within a secured area 585 (represented by a dashed line) accessible by authorized personnel, such as an armored carrier service. Although not shown in FIG. 10, the self-service machine 510 bill transport system or systems 820 may further distribute all of or a portion of the processed currency bills to one or more intermediate currency bill holding areas, preferably but not necessarily denomination specific (i.e., each intermediate currency bill holding area holding a single denomination) with the balance of the currency bills processed being deposited in one or more currency bill receptacles 850. The intermediate currency bill holding area(s) are disposed upstream of the currency bill repurposing module 830 so that the controller 520 has ready access to reserve currency bills to draw upon responsive to a request for a currency package. As shown in FIG. 10, the currency bill receptacle(s) 850 are disposed within the secured area 585 (represented by a dashed line) accessible by authorized personnel, such as an armored carrier service.

The currency bill input region or input device 800 is configured to accept currency bills either singularly, one-at-a-time, or in bulk (e.g., mixed denomination in a stack, single denomination in a stack, etc.) and pass them to the currency bill processing module 810. Exemplary references disclosing currency bill processing (e.g., discrimination and/or authentication) include, but are not limited to, U.S. Pat. No. 3,280,974 (magnetic flux), U.S. Pat. No. 3,870,629 (patterns of grid lines), U.S. Pat. No. 5,151,607 (security thread), U.S. Pat. No. 4,617,458 (magnetizable material), U.S. Pat. No. 4,593,184 (magnetic fields), U.S. Pat. No. 4,356,473 (denomination scans); U.S. Pat. No. 4,381,447 (density), U.S. Pat. No. 4,490,846 or 4,992,860 (color), U.S. Pat. No. 4,255,651 (length and thickness), U.S. Pat. No. 4,179,685 (reflectance and transmission); U.S. Pat. No. 5,122,754 (watermark, security thread); U.S. Pat. No. 3,764,899 (thickness), U.S. Pat. No. 3,815,021 (dielectric properties), U.S. Pat. Nos. 5,704,491, 5,790,693, 5,960,103, 6,351,551, 6,724,927, 6,778,693, and 7,016,767, 7,149,336, 7,191,657, 7,197,173, 7,200,255, and 7,201,320, each of which is assigned to the present assignee and each of which is hereby incorporated by reference in its entirety. Other features and characteristics of the currency media (e.g., currency bill, etc.) may also be used, without limitation, to perform a discrimination function appropriate to such media.

As noted above, currency bills input into the self-service machine 510 that are designated to be repurposed are packaged (e.g., bound, shrink wrapped, wrapped, tied, strapped, etc.) and transported by the repurposed currency bill transport 840 to a designated repurposed currency retrieval area (e.g., R1-R4). Optionally, if the repurposed currency bills are to be packaged together with repurposed coins, the repurposed currency bills may be transferred by the repurposed currency bill transport 840 to the coin repurposer 570 for combination (as represented by dashed line) or, alternatively, both the repurposed coins and the repurposed currency can be output from the respective coin processing module and currency processing module (or any optional intermediate coin and/or currency storage area(s), directly to a repurposer configured to process the combination of coin and/or currency.

In accord with at least some of the aspects of the present concepts disclosed herein both infra and supra, the currency processing device disclosed in U.S. Published Patent Application US 2012/0156976 A1, filed on Dec. 16, 2011, and entitled "Coin Processing Systems, Methods And Devices" and referred to hereinafter as the Money Machine 2 ("MM2") is advantageously utilized in combination with one or more the concepts presented herein (e.g., the self-service machine 510 of FIGS. 6 and 9-11 may comprise an MM2) and is incorporated herein by reference in its entirety. For example, the MM2 coin processing device is utilizable in accord with the present concepts to form a deliverable coin package of a specified quantity of and denomination(s) of coins using the coin repurposer 570 and to output the deliverable coin package (e.g., a sealed plastic bag of the requested coins) to a repurposed currency retrieval area (e.g., R1) for retrieval by an employee of the business, a user submitting the coin order, or an agent thereof, as appropriate.

Figure 11:
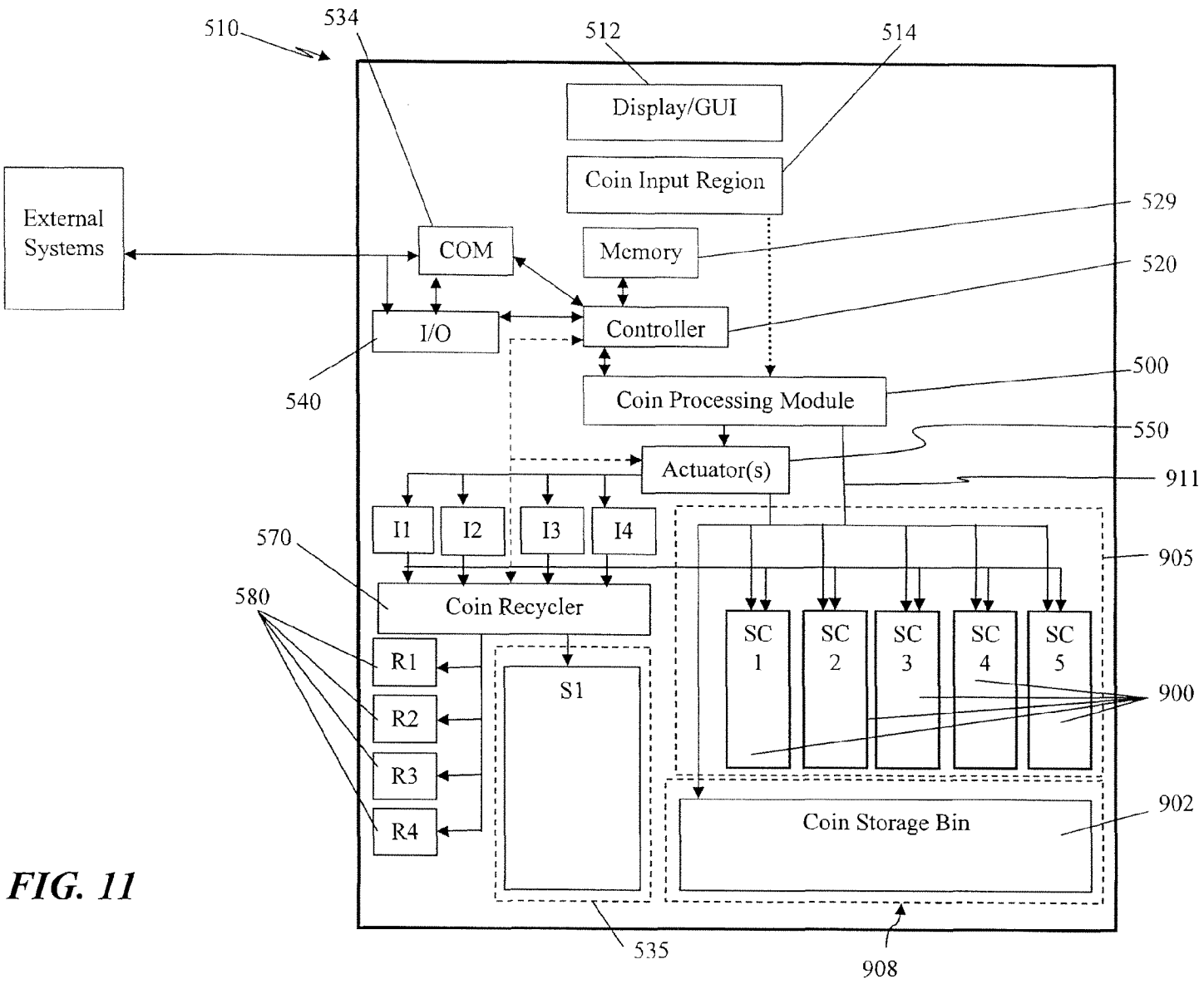
FIG. 11 illustrates yet another self-service machine embodiment in accord with at least some aspects of the present concepts.

In at least one aspect of the present concepts, further to the aforementioned coin repurposer 570, the self-service machine 510 comprises one or more secure, removable coin cassettes. An example is shown in FIG. 11, wherein five secure coin cassettes 900, identified by reference numeral SC1-SC5, are disposed to receive coins output from respective ones of the intermediate coin holding areas I1-I4 (e.g., via actuators disposed in or downstream of the intermediate coin holding areas I1-I4), output by one or more actuators 550 disposed downstream of the coin processing module 500, and/or output from the coin processing module 500 via an output path 911.

The size of the secure coin cassettes 900 (e.g., SC1-SC5 in FIGS. 11-12) may vary. By way of example, the secure coin cassettes 900 may have an internal volume dimensioned to hold ⅛ of a full federal bag limit for each denomination of coin, or as much as ½ or ¾ of a full federal bag limit for each denomination, or even a of a full federal bag limit for each denomination. Likewise, in foreign countries, generally equivalent dimensions may be utilized for corresponding fractions of standard coin bags (e.g., a fraction of a coin bag from the Deutsche Bundesbank, etc.). To facilitate portability of the secure coin cassettes 900, it is presently preferred that the secure coin cassettes 900 have an internal volume dimensioned to hold between about ⅛ to ¼ of a full federal bag limit. Secure coin cassettes 900 of varying sizes may be used in a single machine. For example, a self-service machine 510 may comprise a plurality of secure coin cassettes 900 that are ⅛ of a full federal bag limit and a plurality of secure coin cassettes 900 that are ¼ of a full federal bag limit. As another example, a self-service machine 510 may comprise a plurality of secure coin cassettes 900 that are ½ of a full federal bag limit and a plurality of secure coin cassettes 900 that are ¼ of a full federal bag limit. As another example, a secure coin cassette 900 can be configured to hold a certain number of coins (e.g., 2500 coins of a particular denomination) or range of coins.

In accord with any of the aspects of the secure coin cassettes 900 disclosed herein, the secure coin cassettes may be locked in a metal cage, a metal case, a room, a safe or a metal locker when not required or when a machine is not available to receive the secure coin cassettes.

When a secure coin cassette 900 reaches its limit, or reaches a pre-defined fill level, additional coins of the denomination processed by the coin processing module 500

(overflow) are routed to a coin storage bin 902, coin bag (not shown), or mixed-coin coin cassette 900. For example, where a secure coin cassette 900 has a limit of 2500 coins, for example, the 2,501$^{st}$ coin and subsequent coins of that denomination are discharged to coin storage bin 902.

In at least some aspects of the present concepts, each secure coin cassette 900 comprises a single denomination. In other aspects of the present concepts, one or more secure coin cassettes 900 can be advantageously used to store a plurality of coin denominations (e.g., a predetermined mix of coins, a cash till mix, a random mix, overflow coins, etc.) suitable for a particular business. By way of example, the secure coin cassettes 900 can be used as a deliverable coin package transportable between businesses. Businesses utilizing secure coin cassette 900 as deliverable coin packages can, for example, return "empties" back to the business from which it was obtained and exchange the "empties" for "full" secure coin cassettes 900.

In some aspects, the housing of the secure coin cassettes 900 is metal (e.g., 3003-H14 aluminum, 5052-H32 aluminum, 6061-T6 aluminum, Grade 304 stainless steel, etc.), plastic (e.g., thermoplastics, DuPont Delrin®, DuPont Zytel® HTN resins, Polyphthalamides, glass-fiber reinforced polymers, etc.), and/or composite of a suitable thickness or gauge (e.g., 8-11 gauge steel or aluminum, etc.) appropriate to the material to both maintain dimensional stability over time (e.g., little to deformation of the housing dimensions over an operational lifetime of the secure coin cassette, etc.) and to discourage and/or hinder access to an interior volume of the secure coin cassette through the housing.

The secure coin cassettes 900 are removably disposed within a secured area 905 of the self-service machine 510, such as within a docking station or docking port (not shown) having electrical connectors (e.g., power connector, USB connector, etc.) configured to matingly engage with electrical connectors on the secure coin cassettes (e.g., to enable the secure coin cassettes to be externally powered, such as to charge a rechargeable battery borne thereby, and/or to facilitate data connection between a controller 895 of the secure coin cassette and a controller of the machine to which the secure coin cassette is docked) and/or having physical connectors (e.g., docking posts, guide members, etc.) configured to physically guide and/or securely retain the secure coin cassettes in an operable position. In at least some aspects, the electrical connectors are configured so as not to require any plugging in or unplugging of cables to the secure coin cassette 900, so as to minimize difficulty of insertion or removal of the secure coin cassette.

In at least some aspects, the docking station or docking port (e.g., 916) is adapted to provide a "plug-and-play" type functionality wherein the device to which a secure coin cassette 900 is attached (e.g., a self-service machine 510) automatically recognizes and interacts with one or more secure coin cassettes. In at least some aspects of the present concepts, one or more docking stations or docking ports (e.g., 916) are configured to accept a plurality of secure coin cassette of the same coin type (e.g., multiple secure coin cassette of a single denomination, multiple mixed-denomination secure coin cassettes, etc.). The docking station/ports (e.g., 916) may discharge coins passed by the attached secure coin cassette 900 to one or more destinations. In various aspects, the output destination of the docking port 916 is a coin repurposer 570 (FIG. 17), coin processor 950 (FIG. 14), coin till 904 (e.g., FIG. 12, FIG. 16), or even directly to the coin storage bin 902 (e.g., bypassing additional processing).

Figure 13:
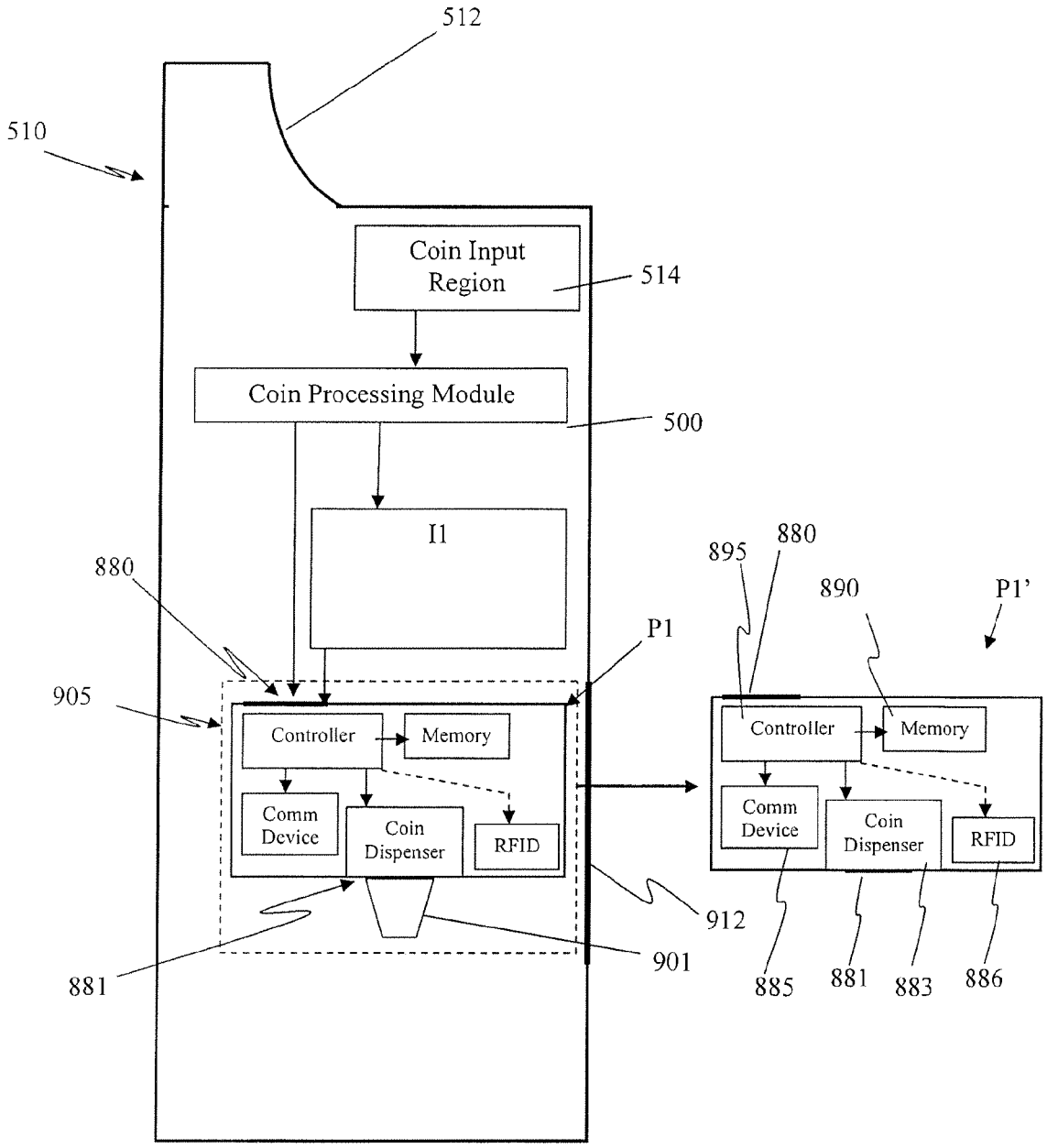
FIG. 13 illustrates yet another self-service machine embodiment in accord with at least some aspects of the present concepts wherein a secure coin cassette is removed from the self-service machine.

An authorized person (e.g., an employee of a business in which the self-service machine 510 is disposed) is able to access one or more of the secure coin cassettes 900 and remove them from the self-service machine 510, such as is represented in FIG. 13, where secure coin cassette "SC1" 900 is removed from a first position P1 (e.g., an operable position) in the self-service machine, following accessing of the secure coin cassette "SC1" through the access panel or door 912, and is moved to a position P1' outside of the self-service machine, as represented by the arrow. The self-service machine 510 optionally includes one or more locking doors or access panels configured to control access to one or more of the secure coin cassette 900. For example, in one embodiment, a single locking door is provided in the front or back of the self-service machine 510 and all secure coin cassette 900 in the accessible area 905 are accessible via the door 912. Where the self-service machine 510 is disposed with a front portion accessible to the public and a rear portion accessible only to a business secured area, the door need not necessarily be locked or lockable. In another embodiment, a plurality of locking doors are provided, in the front or back of the self-service machine 510, and one or more secure coin cassettes 900 in the accessible area 905 are accessible via the plurality of locking doors 912.

In at least some aspects of the present concepts, the secure coin cassettes 900 are only unlocked when disposed in an operable position within the self-service machine 510 or within another device in which the secure coin cassettes 900 are used to either receive and/or dispense coins. When removed from such machine or device, the secure coin cassettes 900 advantageously lock automatically. For example, the secure coin cassettes 900 are automatically locked (e.g., via latch(es), actuator(s), etc.) as they are removed from the self-service machine or device or in association with such removal (e.g., prior to removal). Likewise, the secure coin cassettes 900 are automatically unlocked as they are inserted into the self-service machine or in association with the insertion into the self-service machine (e.g., during an operability self-check, a self-service machine actuator or a coin cassette actuator unlocks the secure coin cassette before it is permitted to be placed into operation).

Figure 14:
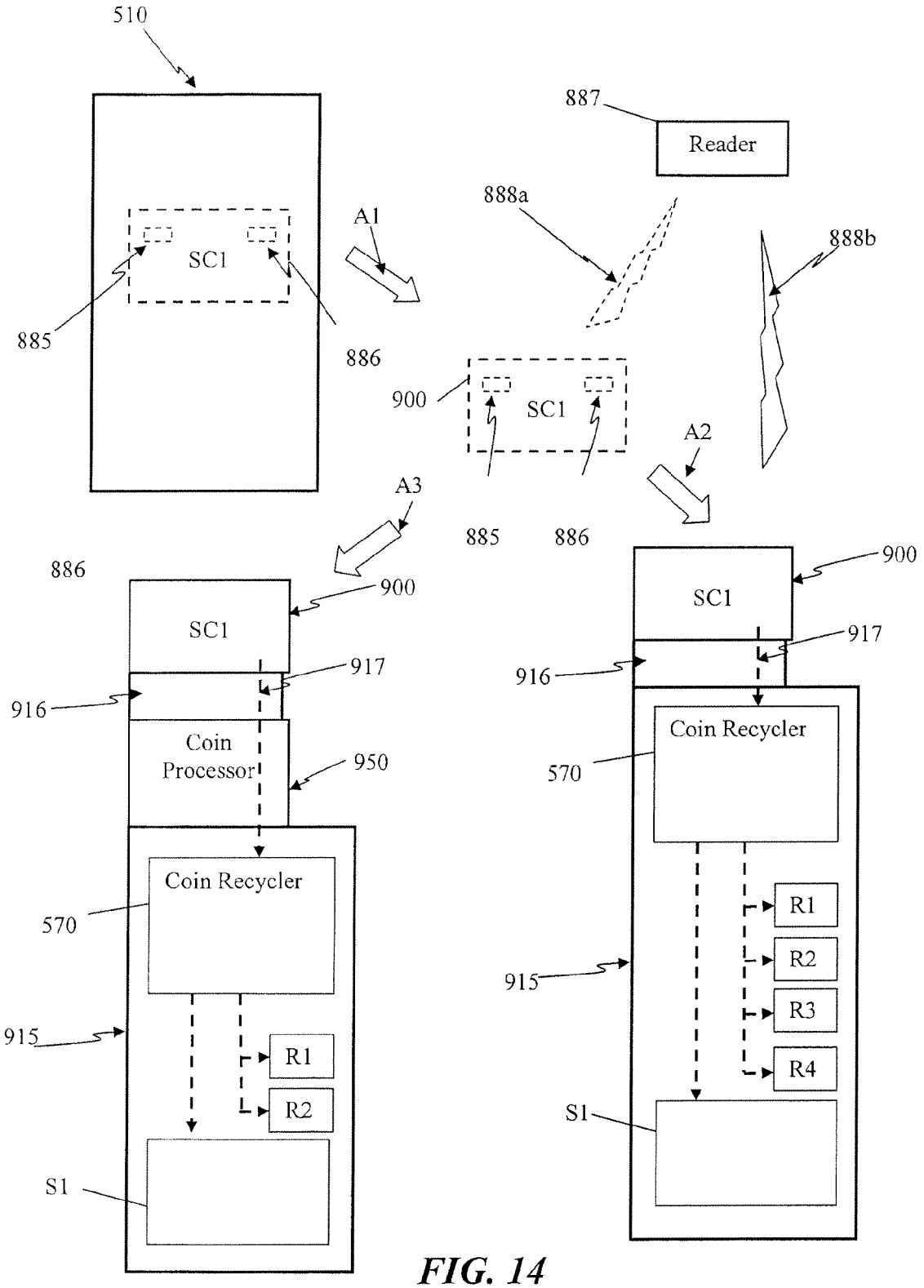
FIG. 14 illustrates movement of a secure coin cassette from a self-service machine and to other machines in accord with at least some aspects of the present concepts.
Figure 15:
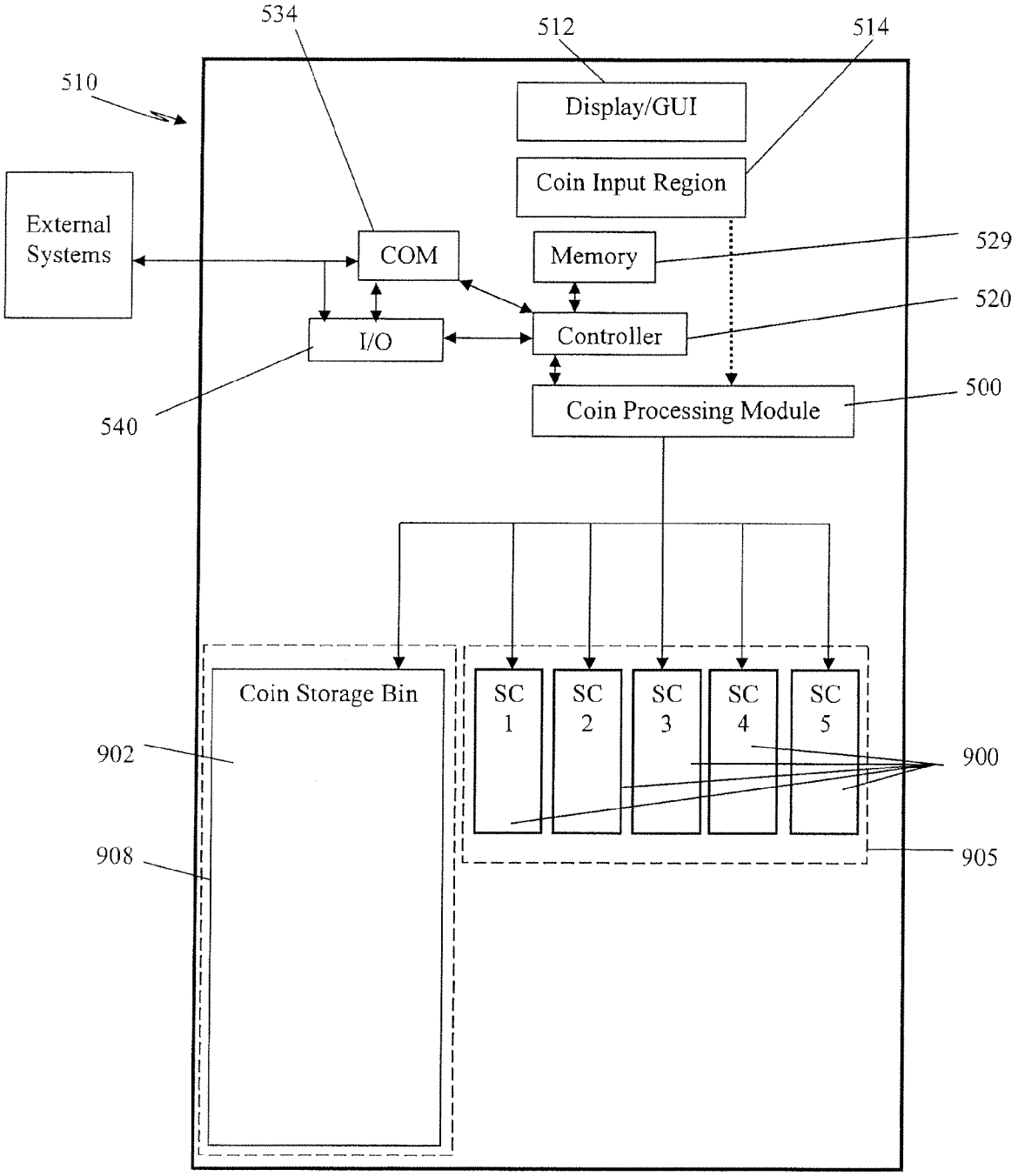
FIG. 15 illustrates yet another self-service machine embodiment in accord with at least some aspects of the present concepts.

When the secure coin cassettes 900 are removed from a self-service machine 510, such as is shown in FIG. 15, the secure coin cassette (e.g., SC1) must be maintained in a secure state during transportation, whether to a local device or location (e.g., a local separate coin repurposing station 915 as represented in FIG. 14) or a remote location. The security features utilized and/or enabled in association with the movement of the secure coin cassettes 900 may depend on (or be selected by) the business utilizing the secure coin cassette. For example, in an environment that is itself secure, such as behind the teller windows that separate the bank tellers from the public (e.g., wherein a front of the self-service machine 510 is positioned in a wall for public use and the back of the self-service machine opens to a controller area accessible only by bank employees, etc.), a business may not feel it necessary to automatically lock the coin input opening 880 and coin discharge opening 881 of the secure coin cassettes 900 in view of the ordinary security protocols (e.g., restricted access, video cameras, requirement of entry of employee codes to access interior of self-service machine 510, electronic monitoring of the contents of each secure coin cassette 900 by one of, or both of, the self-service machine controller 520 and secure coin cassette controller 895, etc.).

However, in an environment that is not secure (e.g., a self-service machine 510 disposed in a public area of a grocery store), the secure coin cassettes 900 are advantageously configured to automatically lock or otherwise secure the coin input opening 880 on the top portion of the secure coin cassette 900 and the coin discharge opening 881 at the bottom portion of the secure coin cassette to maintain the security of the contents of the secure coin cassette during movement. By way of example, the members used to occlude the openings 880, 881 are automatically locked in place by the secure coin cassette 900 controller 895 or the self-service machine 510 controller 520 (or other controller of another machine or device to which the secure coin cassette is operably associated) prior to or concurrent with removal of the secure coin cassette from the docking station in which or on which it is removably attached.

Accordingly, to simplify insertion and removal of the secure coin cassette 900 from machines or devices to which they are attached, the openings 880, 881 are optionally configured to automatically close prior to removal from a device in which or on which the secure coin cassette 900 is removably installed and, conversely, to automatically open following installation in or on a device in which the secure coin cassette 900 is placed in service. To accomplish the automatic locking of the openings 880, 881, one or more linear actuator(s), rotary actuator(s) and/or spring element(s) are disposed in the secure coin cassette 900 together with corresponding actuatable member s provided to fully occlude the openings 880, 881. In actuator-based embodiments, when the controller 520 of the self-service machine 510 registers the insertion of the secure coin cassette 900, controller 895 instructs the actuators to move the actuatable members from the openings 880, 881 to thereby place the secure coin cassette in condition for operation. Following movement of the actuatable members to the open or operable condition, the controller 895 registers such status and communicates the operability of the secure coin cassette to the controller 520 of the self-service machine. In another example, the docking ports of the self-service machine 510 are themselves configured with latches or members that interact with correspondingly configured latches or members in the secure coin cassette to cause retraction or movement of members occluding the openings 880, 881. For example, responsive to a force of pushing the secure coin cassette into an operable position in a docking station, latches in the docking station engage and move sliding plates, normally biased closed, in a direction opposite to the biasing force to thereby open the openings 880, 881. As the secure coin cassette is withdrawn from the operable position in the docking station, the latches no longer engage and hold the sliding plates and the sliding plates then automatically close under their normal bias to thereby close the openings 880, 881. Using mechanical and/or electromechanical measures such as these, the employees handling the secure coin cassettes 900 are required to take minimal steps to effect a transfer to the secure coin cassettes 900 from one location to another location.

In yet another aspect, the opening 881 at a bottom portion of the secure coin cassette 900 comprises a coin dispensing device 883 (see FIG. 13) configured to dispense a predetermined number of coins responsive to an instruction from the controller 895. The outlet of the coin dispensing device, while permitting discharge of the coins on an interior volume of the secure coin cassette, itself provides a barrier preventing access to the interior of the secure coin cassette. In at least one aspect, the coin dispensing device comprises a conventional rotating disk, inclined at a predetermined angle, comprising recesses accommodating individual coins wherein rotation of the rotating disk causes coins to occupy the recesses and discharge of the coins to the coin outlet at a predetermined rotational position of the rotating disk. An optional one-way door or gate (not shown) is disposed at the outlet of the coin dispensing device. In other aspects, any conventional coin dispenser could be integrated with a secure coin cassette.

In yet other aspects of the present concepts, it is desired that the secure coin cassettes 900 are universal and are adapted to accept any denomination of coin. In at least some aspects of a universal secure coin cassette 900, the secure coin cassette does not include a coin dispensing device disposed internally thereto and, instead, coin dispensing devices are optionally provided on or in other devices to which the secure coin cassettes 900 are attached. Such coin dispensing devices receive, as an input, coins discharged (e.g., gravity flow) from the bottom opening 881 of the secure coin cassette 900, and singulate and discharge the coins one-at-a-time. In such aspects, any available empty secure coin cassette 900 can be inserted to any available docketing port in a self-service machine 510 to receive coins of any single denomination. As previously described, the secure coin cassette controller 895 advantageously communicates with a controller of the system to which the empty secure coin cassette 900 is attached (e.g., controller 520 of self-service machine 510) and data relating to a position of the secure coin cassette (e.g., denomination, etc.) is transmitted to the secure coin cassette memory 890. Following placement in-service, data for every coin output to the secure coin cassette 900 is transmitted at least to the secure coin cassette memory 890.

In another aspect of a universal secure coin cassette 900, the secure coin cassette comprises an universal upper portion and a detachable lower portion, the universal upper portion comprising a standard or coin input region adapted to accommodate any input coins of any denomination and defining an interior coin receptacle geometry suitable for retention of coins of any denomination. The detachable lower portion comprises an internally disposed coin dispensing device adapted to discharge, from the interior volume defined by the universal upper portion and/or detachable lower portion, coins of a specific denomination. The universal upper portion and detachable lower portion are thus able to be matched to a particular application and particular denomination as needed. The connection between the universal upper portion and the detachable lower portion may comprise any mechanical connector(s) including, but not limited to, latches, locks, mating connectors, or sliding connectors.

In some aspects of the present concepts, the secure coin cassettes 900 are optionally expandable or of variable size so that the same cassette may be used in different machines and/or different applications. As one example, each wall (the term "wall" being inclusive of top and bottom walls forming the "ceiling" and the "floor" of the secure coin cassette) are formed with wide flanges or side members that overlap corresponding side members of adjacent panels forming the adjacent walls. The overlaps permit variability in positioning of the walls relative to one another and conventional means of securing stable connection therebetween (e.g., special locking screws with proprietary heads, etc.) are able to lock the walls of the secure coin cassette in a contracted position, fully expanded position, or a position therebetween. In another configuration, a secure coin cassette 900 comprises two parts, each part having three side walls, a bottom wall (floor), and a top wall (ceiling), wherein one of the two parts is slightly smaller in dimension in the lateral and height dimensions so as to be positionable inside of the other of the two parts and to telescope inwardly and outwardly therefrom in sliding engagement. One or more latches, locks, or fixing members (e.g., screws or fasteners) are provided on one or both of the parts to maintain a set spatial relationship between the two parts (e.g., a plurality of locks, one for each set of walls). Thus, the depth-wise dimension can be changed, as needed (e.g., to permit a greater coin capacity, to accommodate a smaller machine, etc.), by movement of the first part relative to the second part and fixing or locking the parts together in the desired configuration. As another example, a secure coin cassette 900 may have an accordion-style wall configuration. As yet another example, the top and bottom walls of the secure coin cassettes 900 may be exchangeable so that different tops and bottom walls may be mated with preexisting lateral walls from another container so that a secure coin cassette of a first set of lateral dimensions (e.g., width, depth) may be readily converted to a secure coin cassette having one or more different lateral dimensions.

Optionally, an on-board battery of the secure coin cassette 900 can be used to power an LED display or individual LEDs to provide a visual indication of a denomination of coin retained within the secure coin cassette, which is communicated to the secure coin cassette controller 895, for example, the controller 520 of self-service machine 510. For example, a front or forward surface of the secure coin cassette includes a first green LED by a label of $0.01, a second green LED by a label of $0.05, a third green LED by a label of $0.10, a fourth green LED by a label of $0.25, and so on, with a light illuminating the relevant denomination. Of course, any color of LED could be utilized without limitation. Such LEDs could optionally only be illuminated from the time at which the secure coin cassette is taken out-of-service to the time at which the secure coin cassette is placed back in-service on another machine. In yet other aspects, a label pouch may be provided to accept an informational label printed by the machine from which the secure coin cassette is removed (e.g., controller 520 of self-service machine 510) or to accept an externally-generated label.

In at least some aspects of the present concepts, the secure coin cassettes 900 are color-coded for visibility and/or to conform to Federal Reserve/American Banking Association ("ABA") Standards for coin denominations (e.g., blue for nickels, green for dimes, red for pennies, orange for quarters, etc.). In yet other aspects, instead of the entire cassette 900 or portion thereof having color-coding, a universal secure coin cassette 900, such as that noted above, may have an array of LED lights (e.g., an array of single lights or an array of clusters of lights for enhanced visibility) of different colors corresponding to the color-coded conforming to Federal Reserve/ABA Standards for coin denominations (e.g., blue LEDs are illuminated when a secure coin cassette 900 contains nickels, green LEDs are illuminated when the secure coin cassette contains dimes, etc.).

Tamper evident features may optionally be incorporated into the secure coin cassettes 900 and/or the devices which fill them with coins (e.g., self-service machine 510). As described herein, some tamper evident features are electronic in nature and generally rely upon tracking or other analysis of data (e.g., known coin counts, access by known personnel, etc.) relating to the handling of the secure coin cassettes 900. In other aspects, the tamper evident features are physical in nature. By way of example, the device that fills the secure coin cassette 900 with coins comprises one or more devices configured to apply, to a secure coin cassette that is to be removed therefrom, a variable length plastic seal (e.g., "pull tight seal"), a fixed length seal (the ends of which are clicked into place to lock), a metal seal (e.g., a wire U-ring used in combination with a polyester label affixed to ends of the metal seal), and/or labels affixed to the members closing the openings 880, 881 (e.g., polyester or vinyl labels, holographic labels, Tamperco Label Lock™ Non-residue tamper proof label, etc.). To facilitate application of an optional tamper evident seal, members used to occlude the openings 880, 881 may comprise features (e.g., rings, bars, etc.) and the housing may comprise features (e.g., rings, bars, etc.) adjacently situated relative to the features of such members so that, in combination, the features facilitate the application of a tamper evident seal (e.g., a plastic seal may be inserted through the features and then the ends of the plastic seal are bonded together.

Alternatively, one or more secure coin cassettes 900 are optionally denomination-specific so as to permit optimization of each secure coin cassette to a particular denomination.

In accord with at least some aspects of the present concepts, one or, or both of, the secure coin cassette(s) 900 and/or docking station(s) (e.g., 916; FIG. 14) to which the secure coin cassettes are operatively associated comprise a locking mechanism to cause the secure coin cassettes to be locked to the docking stations until such time as an authorized personnel is authorized to unlock and remove the secure coin cassettes. By way of example, the docking station 916 for the secure coin cassette 900 may comprise one or more locking members that engage portions of the secure coin cassette housing and lock to thereby prevent unauthorized removal of the secure coin cassette from the machine (e.g., self-service machine 510) to which the secure coin cassette is attached.

Optionally, it is further advantageous to render the locked or secured openings tamper evident. According to at least some embodiments, the secure coin cassette 900 controller 895 monitors a position of the members occluding (and optionally locking) the openings 880, 881 (and any other occluded openings). If a position of any of such members occluding the openings is changed while the secure coin cassette is in transport from a first location to a second location, the controller 895 logs the deviation. In some aspects, if the deviation exceeds a threshold minimum level, the controller 895 transmits an alert to one or more other devices, addresses or parties using the communication device 885. As another alternative, or in addition to the previously described aspect, the controller 895 advantageously times the transit from the first location to the second location and the controller 895 is configured to transmits a status update or an alert to one or more other devices, addresses or parties using the communication device 885 if a transit time exceeds a predetermined minimum threshold (which could constitute an indication of an attempt to tamper with the secure coin cassette or possibly of an unattended secure coin cassette). By way of example, if employees of a grocery store routinely move a secure coin cassette 900 from a self-service machine 510 in a front portion of a grocery store to a service desk room in which a coin repurposing machine (e.g., 915; FIG. 15) is located, and such transport and docking with the coin repurposing machine ordinarily lasts 3 minutes, with a standard deviation of 1 minute, an alert may be issued by the controller 895 once 5 minutes has lapsed from the removal of the secure coin cassette from the self-service machine 510 without a docking of the secure coin cassette with the coin repurposing machine. In at least some aspects, prior to removal of the secure coin cassette 900, an authorized person removing a secure coin cassette is required to input to the device from which the secure coin cassette is removed (e.g., coin repurposing machine 915 in FIG. 15) the location to which the secure coin cassette is to be moved (e.g., self-service machine 510) and such information is used to set a timer appropriate for such transfer.

The secure coin cassette 900 may, in lieu of or in additional to communication of status and/or alerts using the communication device 885 as noted above, use controller 895 to communicate data (e.g., status, alerts, etc.) to a system to which the secure coin cassette is operatively associated (e.g., coin repurposing machine 915 in FIG. 15).

FIG. 14 illustrates an example where the secure coin cassette 900, denoted as SC1, comprises an optional RFID 886 (active or passive) that uniquely identifies the secure coin cassette. Separate and apart from, or optionally used in conjunction with, any tracking that may be effected utilizing an optional onboard controller 895 and optional communication device 885 (e.g., GPS, trilateralization, etc.), RFID 886 transmits a unique ID to a local and/or remote tracking system, such as by reading RFID information using a reader 887. The reader 887 may comprise a mobile (e.g., handheld) RFID reader (e.g., Motorola MC9190-Z Handheld RFID Reader) and/or using one or more fixed area RFID readers (e.g., Motorola FX9500 fixed reader). Fixed RFID readers (e.g., Receiver 887 in FIGS. 14, 16) may be used to identify a location of a secure coin cassette 900 within a known space (e.g., a grocery store, a bank, etc.) at a specific time and/or over a range of time. Although the reader 887 is depicted as being disposed remotely from the self-service machine 510 and coin repurposing machine 915 in FIG. 14, one or more readers 887 may be optionally disposed in such machines or in any other machine or device to which a secure coin cassette 900 is to be removably attached so as to identify the secure coin cassette to the system controller (e.g., controller 520 in self-service machine 510).

FIG. 14 shows the secure coin cassette 900 ("SC1") in dashed lines in an initial position in the self-service machine 510. FIG. 14 further represents removal of the secure coin cassette 900 ("SC1") from the self-service machine 510 and movement of the secure coin cassette by the arrow A1 and the use of dashed lines. Upon removal and/or during this movement, intermittently or continuously, the secure coin cassette 900 transmits its location and/or other data via one or more signals 888*a* to reader 887, the signals 888*a* originating from the RFID 886 and/or the communication device 885. Signals 888*a* are represented by dashed lines to indicate the transitory movement of the secure coin cassette 900. The movement of the secure coin cassette 900 represented in FIG. 14 may be to a local site (e.g., within the same room or same building) or a remote site (e.g., to a different building, a different part of a town, a different business, etc.). FIG. 14 further shows that, following the movement of the secure coin cassette 900, it is then attached, as indicated by arrow A2, to a coin repurposing machine 915. In association with the attachment of the secure coin cassette 900 to the coin repurposing machine 915, the secure coin cassette 900 transmits its location, status and/or other data via one or more signals 888*b* to reader 887, the signals 888*a* originating from the RFID 886 and/or the communication device 885 and/or the coin repurposing machine 915. The signals 888*a*, 888*b* transmitted to the receiver 887 are routed, via wireless or hardwired communication pathways, to external systems (not shown). In at least some aspects, the external systems synchronize the location of the secure coin cassette 900 at a specific point in time with one or more cameras linked to the external system to capture one or more images of the movement of the secure coin cassette 900 from such camera(s).

Figure 17:
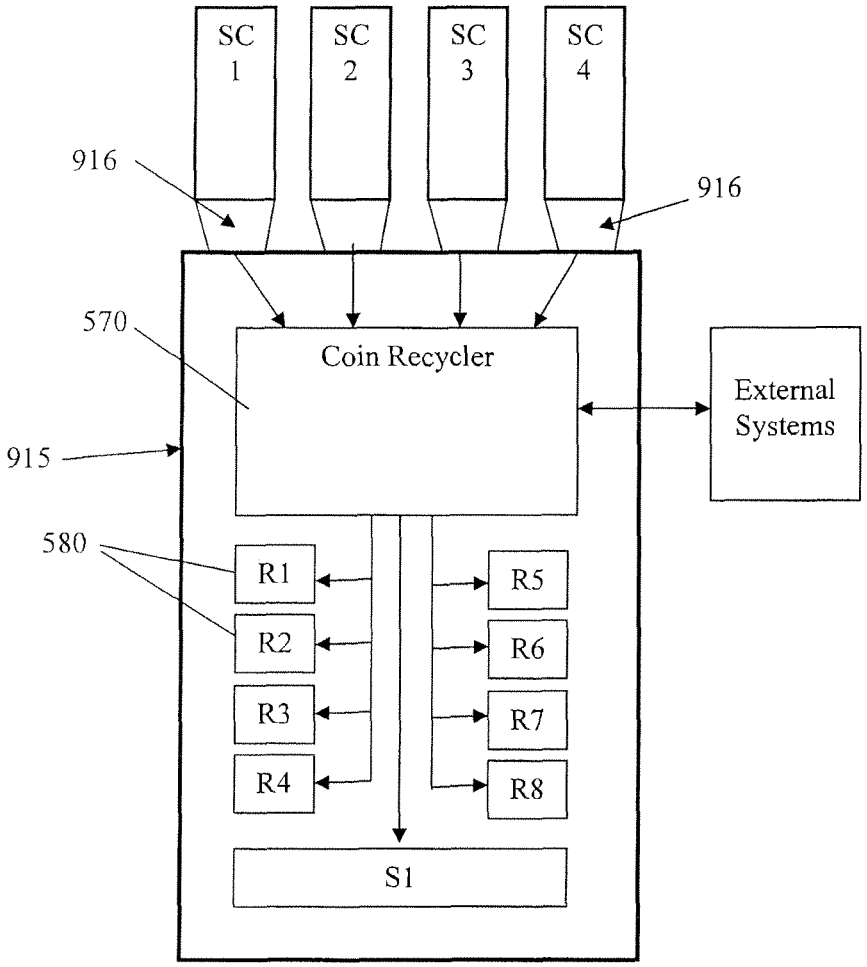
FIG. 17 illustrates an example of a coin repurposing machine utilizing secure coin cassettes in accord with at least some aspects of the present concepts.

In FIG. 14, a side-view of the coin repurposing machine 915 is shown to comprise, as previously noted, a coin repurposer 570 configured to repurpose coins and output packages of coins to a variety of small to medium-sized repurposed currency retrieval areas R1-R4 or to a large repurposed currency retrieval area S1. A front view of the coin repurposing machine 915 of FIG. 14 is shown in FIG. 17, where the coin repurposer 570 is shown to repurpose coins and output packages of coins to a variety of small to medium-sized repurposed currency retrieval areas R1-R8 or to a large repurposed currency retrieval area S1. In both FIGS. 14 and 17, the secure coin cassettes 900 are attached to docking stations 916, which lock the secure coin cassettes 900 in place on the coin repurposing machine 915 and which guide the coins into the coin repurposing machine 915. Dashed arrow 917 in FIG. 14 represents the flow of coins from the secure coin cassette 900 through the docking station 916 and to the coin repurposer 570. FIG. 17 shows the coin repurposer 570 in communication with external systems, which may be used to control the operation of the coin repurposing machine 915, attached secure coin cassettes 900 and/or coin repurposer 570. Of course, operation of the coin repurposing machine 915 may be performed directly at the coin repurposing machine 915 via operator input using associated buttons and/or an associated GUI (e.g., touch screen), voice commands, or other input device.

Figure 25:
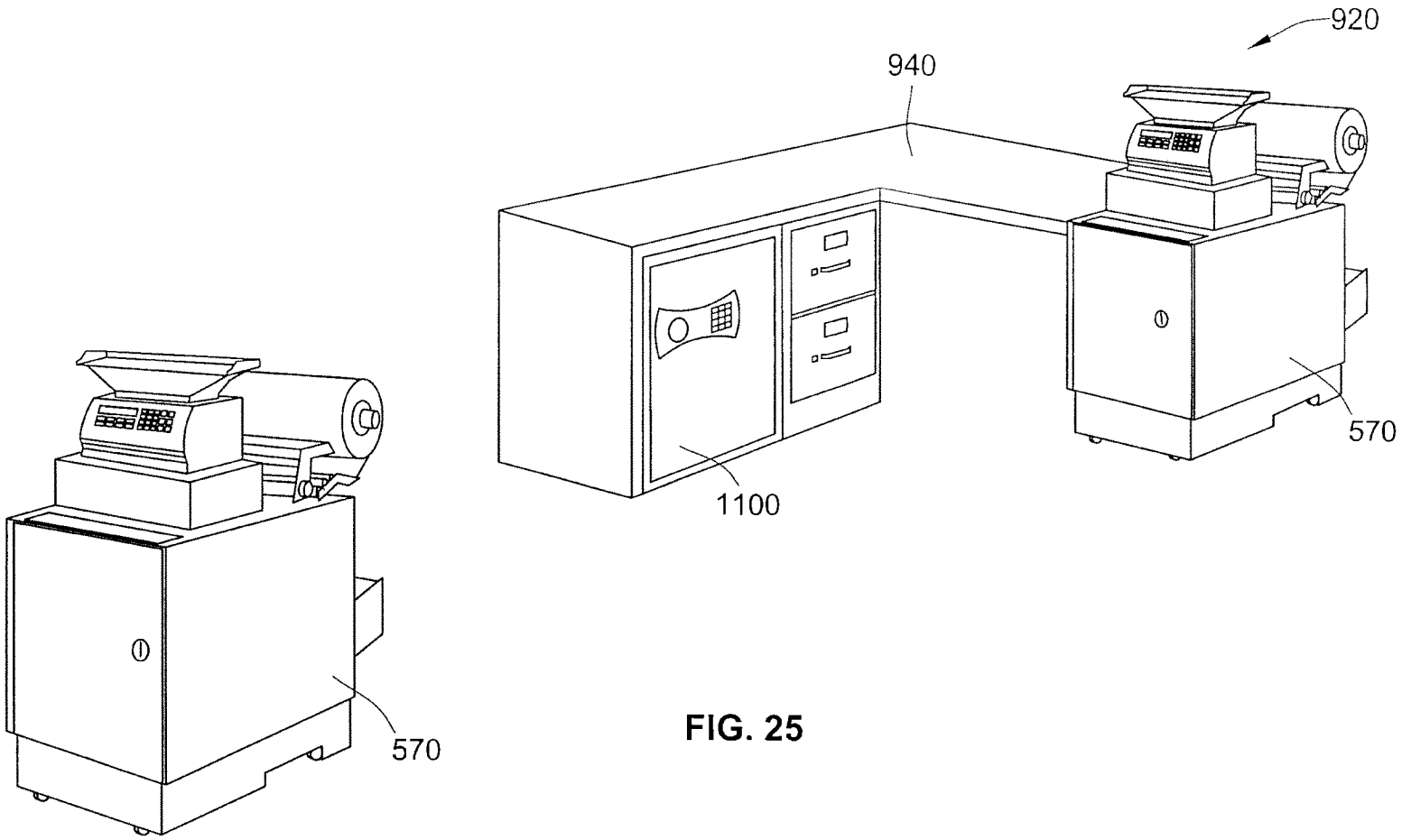
FIG. 25 illustrates an example of a coin repurposing machine comprising a coin processing device in accord with at least some aspects of the present concepts.

FIG. 14 also shows a representation of movement of the secure coin cassette 900 SC1, via arrow A3, to a coin repurposing machine 915 comprising its own coin processing device 950 (see also, e.g., FIG. 25). In association with the attachment of the secure coin cassette 900 SC1 to the docking port 916 of the coin processing device 950, the secure coin cassette 900 transmits its location, status and/or other data via one or more signals (not shown) to reader 887, the signals 888*a* originating from the RFID 886 and/or the communication device 885 and/or the coin repurposing machine 915. The signals 888*a*, 888*b* transmitted to the receiver 887 are routed, via wireless or hardwired communication pathways, to external systems (not shown). This aspect of the coin repurposing machine 915 comprises, for illustration, a coin repurposer 570 configured to repurpose coins and output packages of coins to a variety of small to medium-sized repurposed currency retrieval areas R1-R2 or to a large repurposed currency retrieval area S1.

In relation to locking of the secure coin cassettes 900 during or in preparation for transport, in at least some aspects of the present concepts, one or more discrete locking points are provided that are separately actuatable so that openings or access points may be selectively locked. For example, in some configurations, such as deployment of one or more full secure coin cassettes 900 on a coin packaging machine (see, e.g., dedicated coin packaging machine 915 in FIG. 14), the coin packaging machine 915 (and/or the secure coin cassettes 900 following identification of the machine to which it is attached) is configured to lock the input of the secure coin cassettes 900, but not the output thereof. Likewise, in some configurations, the self-service machine 510 (and/or the secure coin cassettes 900 following identification of the machine to which it is attached) is configured to lock the output of the secure coin cassettes 900, but not the input thereof. Additional discrete locking points may include, for example, data ports or communication ports.

A secure coin cassette is a cassette that may be locked and, once locked, the coins and/or currency bills and other documents therein are secure and access to and/or the ability to remove and/or insert coins and/or currency bills and other documents into the cassette is prevented or inhibited (e.g., the container may need to be destroyed and/or damaged to overcome the container lock). According to at least some embodiments, secure coin cassettes are physically lockable and/or lockable on command, such as by an operator, handler, self-service machine 510 controller 520 (e.g., secure coin cassettes 900 may be configured to lock automatically upon the removal of a secure coin cassettes from a docking station or docking port within the self-service machine 510), and/or secure coin cassette 900 resident controller and actuator(s). Once locked, only authorized personnel (e.g., personnel utilizing a password, key, code, device, or the like) are able to unlock the secure coin cassettes 900 and such ability to unlock the secure coin cassettes 900 may further be conditionally limited (e.g., only certain discrete locking points may be unlocked and only when the secure coin cassette 900 is in a particular operational condition or inoperable condition, etc.).

In accord with at least some aspects of the present concepts, a secure coin cassette is configured to log data relating to the secure coin cassette on a resident memory device (see, e.g., MD1 in FIG. 13), such data including, but not limited to, records of access (e.g., attempts at access, actual access, time and date of access or attempted access, identification code or identifying information on person accessing or attempting access of secure coin cassette, coins received by the secure coin cassette, and/or status of secure coin cassette (e.g., properly docked and operable, full, partially full, error codes, etc.), in any combination. The information stored by the optional secure smart secure cassette memory device MD1 is accessible by an authorized external device or, in additional or alternatively, by a resident controller and communication device (e.g., COM1 in FIG. 13). The resident communication device may be powered by a device to which the secure coin cassette is operatively associated (e.g., a self-service machine 510, etc.) and/or by a battery borne by the secure coin cassette (e.g., a rechargeable lithium-ion battery). The secure coin cassette is thereby configured to transmit the information borne by the memory device (e.g., MD1 in FIG. 13) to another device (e.g., PDA, tablet, network, remote computer, etc.) via an established wireless or hard-wired communication link.

Utilizing such on-board data-storage capability (e.g., MD1 in FIG. 13) and/or communication capability (e.g., COM1 in FIG. 13), the value and the count of coins added to or extracted from each secure repurposing coin cassette 900 can be tracked not only while disposed in an operable condition at a machine (e.g., a self-service machine 510, etc.), but also external thereto so as to allow tracking throughout a retail or banking system (e.g., during exchange of coins from a first machine, such as self-service machine 510, to a second machine, such as a dedicated coin packaging machine).

Alternatively, or in addition to the aforementioned smart secure cassettes bearing a resident memory device (e.g., MD1 in FIG. 13, which may comprise an encrypted flash memory device) and/or controller and communication device (e.g., COM1 in FIG. 13), in at least some embodiments, the self-service machine 510 controller 520 (or controller of another machine or device to which a secure coin cassette 900 is operatively associated) itself separately records and/or transmits a log of details about the status of individual secure coin cassettes 900 from the moment of insertion of the secure coin cassettes into the self-service machine (or other machine or device) until the removal of the secure coin cassettes from the self-service machine (or other machine or device), such log including data on all coins received by the secure coin cassettes and all operator records (e.g., passwords or access codes entered, times of such events, etc.) during such operational interval.

Figure 12:
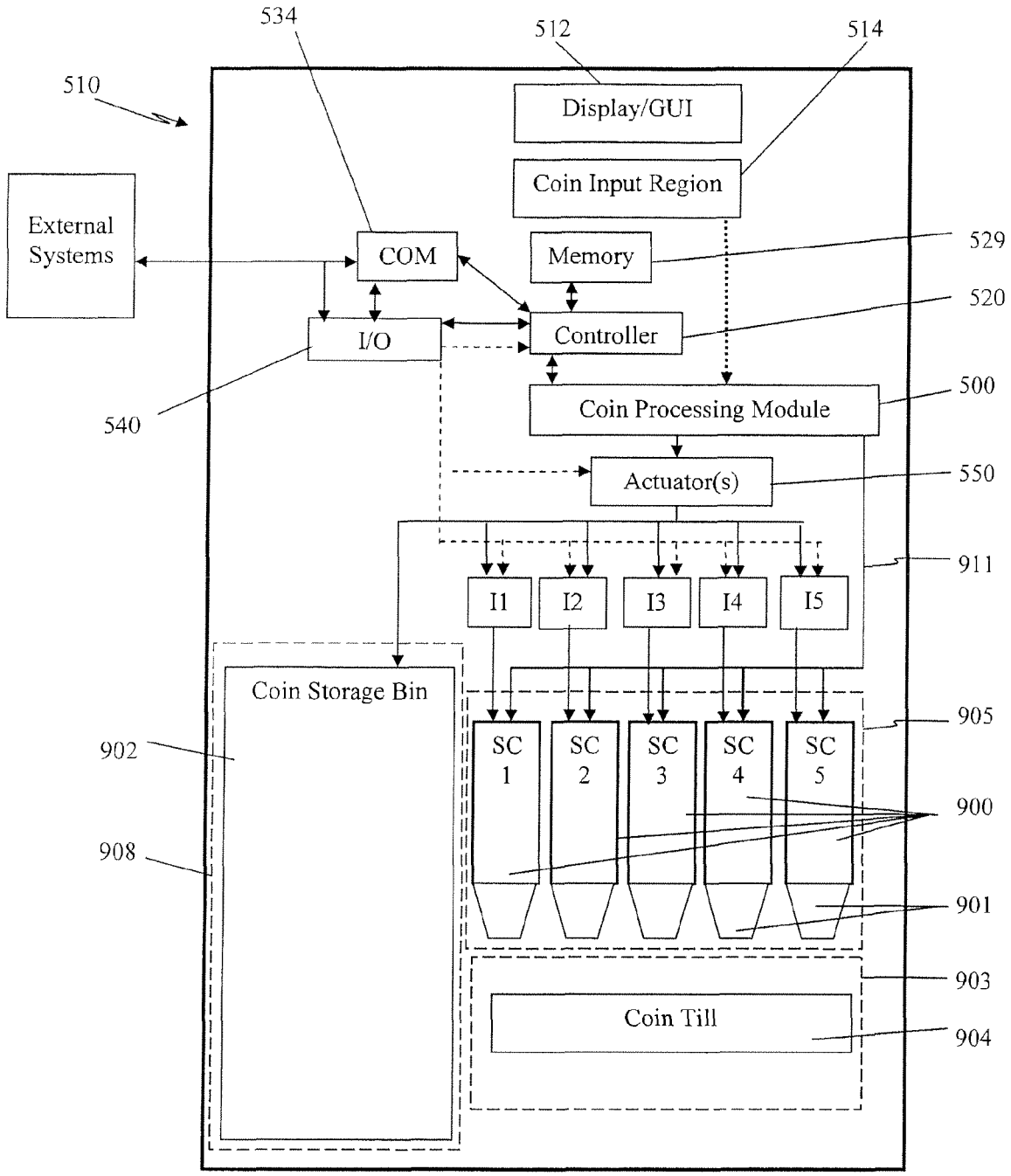
FIG. 12 illustrates yet another self-service machine embodiment in accord with at least some aspects of the present concepts.

When the secure coin cassette 900 is operatively associated with a self-service machine 510, communications from the self-service machine controller 520 via I/O 540 and/or communication device 534 may include, for example, transmitting (e.g., via a hardwired connection or a wireless communication, such as Bluetooth, Wi-Fi, cellular connection, etc.) data relating to the secure coin cassettes 900 to another device (e.g., PDA, tablet, network, other computer device, etc.), generally denoted in FIGS. 11-12 as external systems. Data stored by the self-service machine 510 controller 520 relating to the coins output to a specific secure coin cassette 900 is optionally transmitted to such external system(s) to enable comparison of such data to corresponding data stored by the smart secure cassette 900 resident memory devices (e.g., MD1 in FIG. 13) as a check against tampering, theft, or of errors. The value and the count of coins added to or extracted from each secure coin cassette can be tracked at the machine operating or securely retaining the cassette at any time.

To illustrate of example of the present concepts, secure coin cassettes 900 are utilized in combination with a self-service machine 510, such as the Cummins-Allison Corp. "Money Machine 2," and coins processed thereby are used to fill the secure coin cassettes. Once filled, or if needed to be removed prior to filling for any reason, the secure coin cassettes 900 are able to be rapidly removed from the self-service machine 510 by authorized personnel (e.g., a supervisor) and moved to another location, such as a back room in the business (e.g., a bank, a grocery store, etc.). Following removal of a secure coin cassette 900 (e.g., a "full" coin cassette), an empty secure coin cassette is substituted therefor and the machine placed back in service. The removed secure coin cassette(s) are then able to be stored or put into or onto another device, such as is represented by way of example in FIG. 14. In one aspect, a removed secure coin cassette is inserted into or onto a coin storage device to hold the secure coin cassette in a secure location until a later transfer of the secure coin cassette to another business or entity. In another aspect, a "full" secure coin cassette is inserted into or onto a cash till filling device configured to cause the attached secure coin cassette to discharge of a predetermined or set number of coins to enable the business to refill tills for employees secure coin cassette and to provide other inventory of coin as required, such as is represented by way of example in FIGS. 12 and 14.

In some embodiments, a machine such as, but not limited to, the self-service machine 510 is configured to variously fill the secure coin cassettes 900, but not discharge directly therefrom (see, e.g., FIG. 11), such extraction being accomplished on a different machine.

In other embodiments, a machine such as, but not limited to, the self-service machine 510 is configured to variously fill the secure coin cassettes 900 and also discharge directly therefrom (see, e.g., FIG. 12), such as to a cash till 904.

In still other embodiments, a machine such as, but not limited to, the self-service machine 510 is configured to discharge coins from the coin processing module 500 to the secure coin cassettes 900 without any intermediary intermediate coin holding areas (e.g., I1-I5 shown in FIG. 12) or actuators, such as is shown by way of example in FIG. 15.

In yet another variant of the self-service machine 510, the coin processing module 500 outputs coins to the secure coin cassettes 900 and the secure coin cassettes 900 are in turn configured to dispense coins to one or more intermediate coin holding areas (e.g., I1-I5 shown in FIG. 12). In this embodiment, the intermediate coin holding areas are configured to dispense coins from coin dispensers to a cash till 904 or other removable container or receptacle (e.g., cup, tube, sleeve, bag, etc.). Thus, loose mixed coin can be input into the self-service machine, where it is sorted into the secure coin cassettes 900. The full or partially full secure coin cassettes 900 can, in turn, then be used to refill cash tills or dispensed into coin tubes (e.g., pre-formed Federal limit tubes, rolled coin tubes, POS coin tubes, small container cups, etc.) to provide a comprehensive backroom self-service machine.

To further illustrate some of the above aspects of the present concepts, a number of exemplary applications and configurations are discussed below.

In the examples of FIG. 12 and FIG. 15, for example, once a secure coin cassette 900 (e.g., SC1) and/or optional intermediate coin holding area (e.g., I1), as appropriate, is full of coins of an appropriate denomination, additional sorted coins of that denomination are then output by the coin processing module (see, e.g., 500 in FIG. 12) of the self-service machine 510 to a conventional coin bin 902 (e.g., mixed coin bin) or coin bag (not shown). For example, a supervisor at a store may require 500 quarters and can input an order for the quarters through a display/GUI 512 at the self-service machine 510 or remotely through an external system. In one or more subsequent coin processing transactions, quarters processed by the coin processing module 500 would be output to a designated one of the secure coin cassettes (e.g., SC1 in FIG. 15) until the requested order has been fulfilled (e.g., 500 quarters). The next coin of the requested denomination (e.g., the 501$^{st}$ quarter) and beyond would then be output by the coin processing module 500 into the mixed coin bin 902 or to another appropriate collection bag within the self-service machine 510. If the supervisor were to require a quantity of a denomination (e.g., quarters) in excess of a storage capacity of a single secure coin cassette (e.g., SC1 in FIG. 15), coins of that denomination would be output to a first secure coin cassette (e.g., SC1 in FIG. 15) until the capacity of the first secure coin cassette has been met (e.g., 750 quarters, which is an arbitrarily-selected illustrative amount), at which point successive coins of that denomination are output to a second secure coin cassette (e.g., SC2 in FIG. 15) until the requested order has been fulfilled (e.g., 1000 quarters). The next coin of the requested denomination (e.g., the 1001$^{st}$ quarter) and beyond would then be output by the coin processing module 500 into the mixed coin bin 902 or to another appropriate collection bag within the self-service machine 510.

Figure 27A:
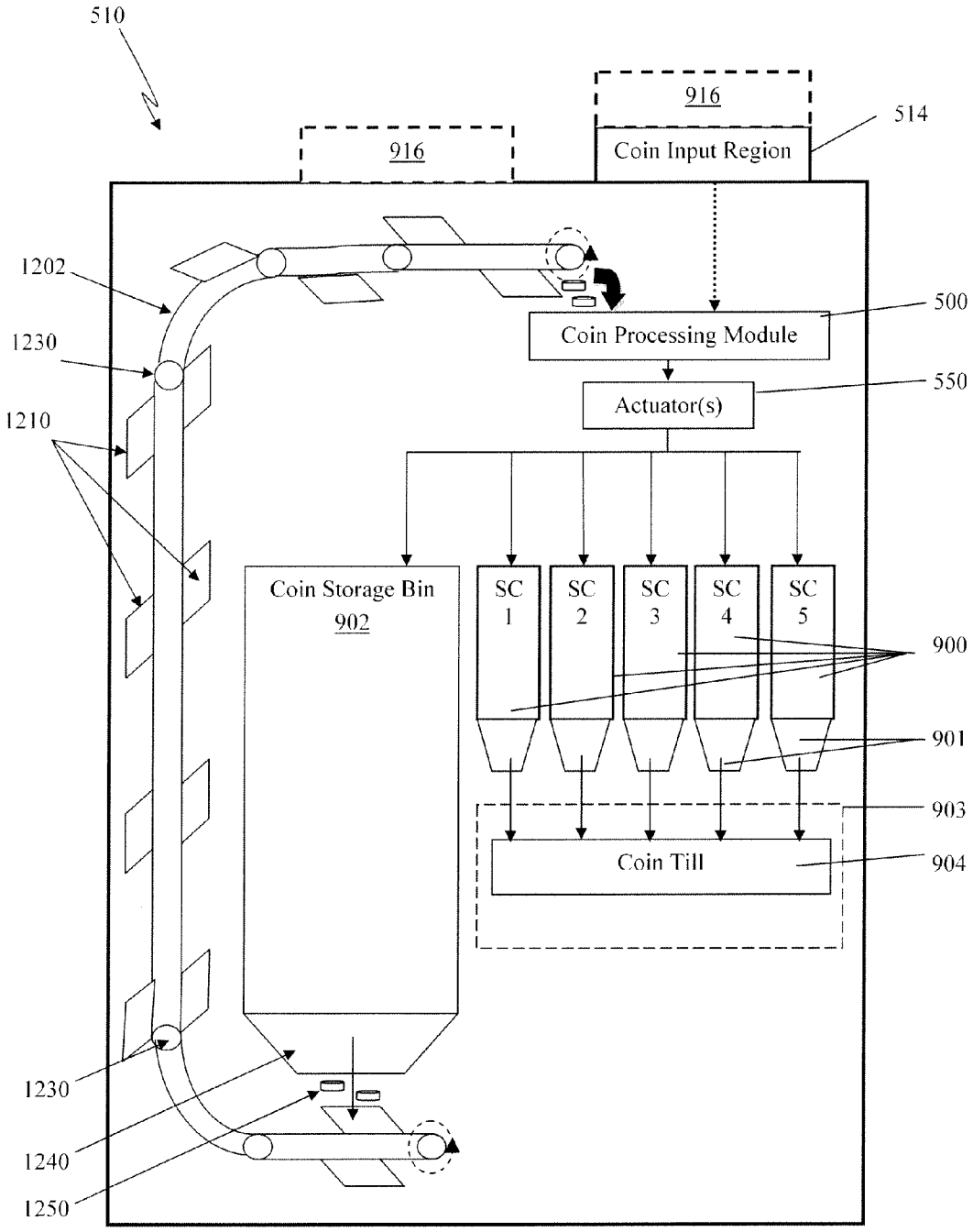
FIGS. 27A-27C further illustrate examples of coin repurposing machines in accord with at least some aspects of the present concepts.
Figure 27B:
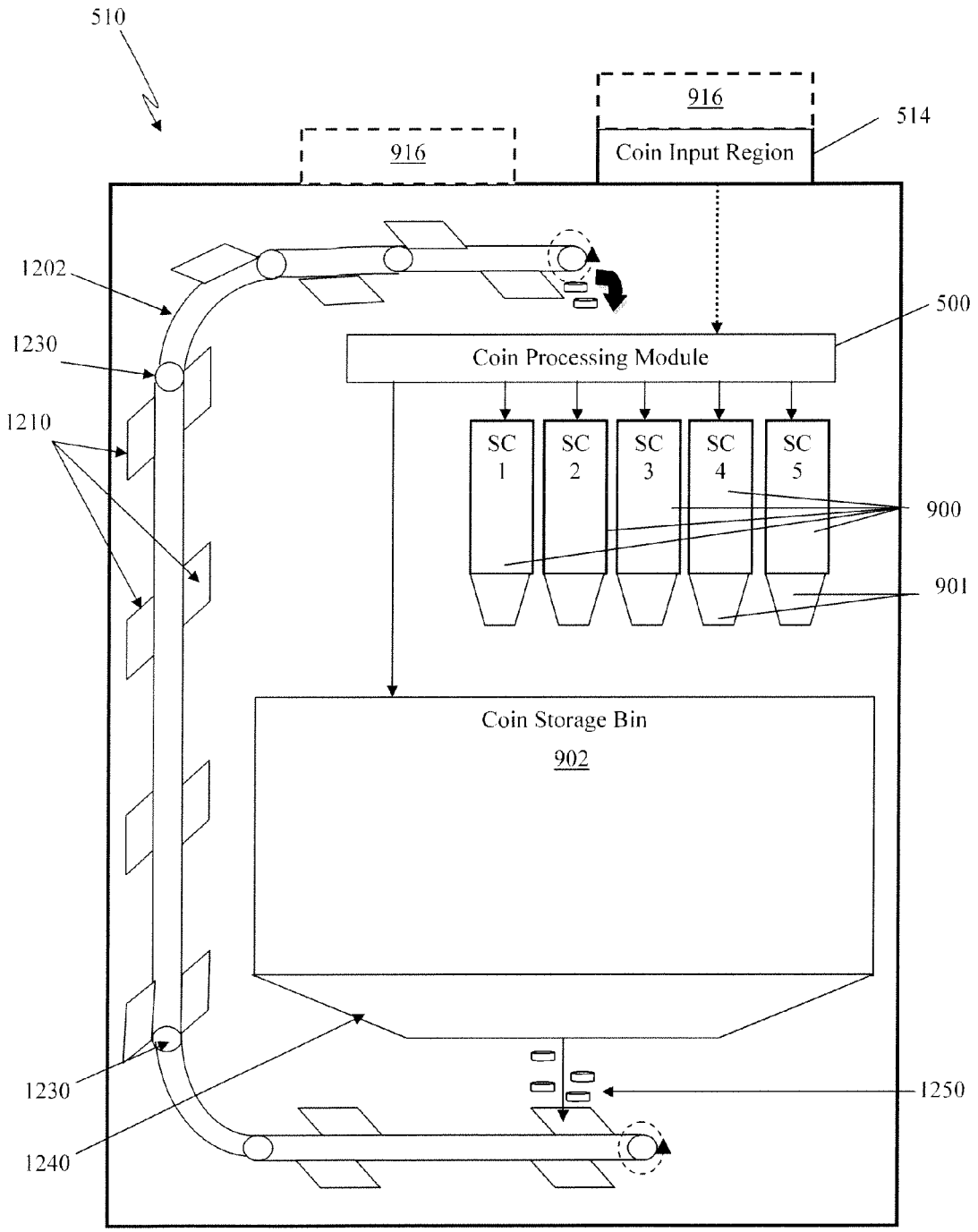
Figure 27C:
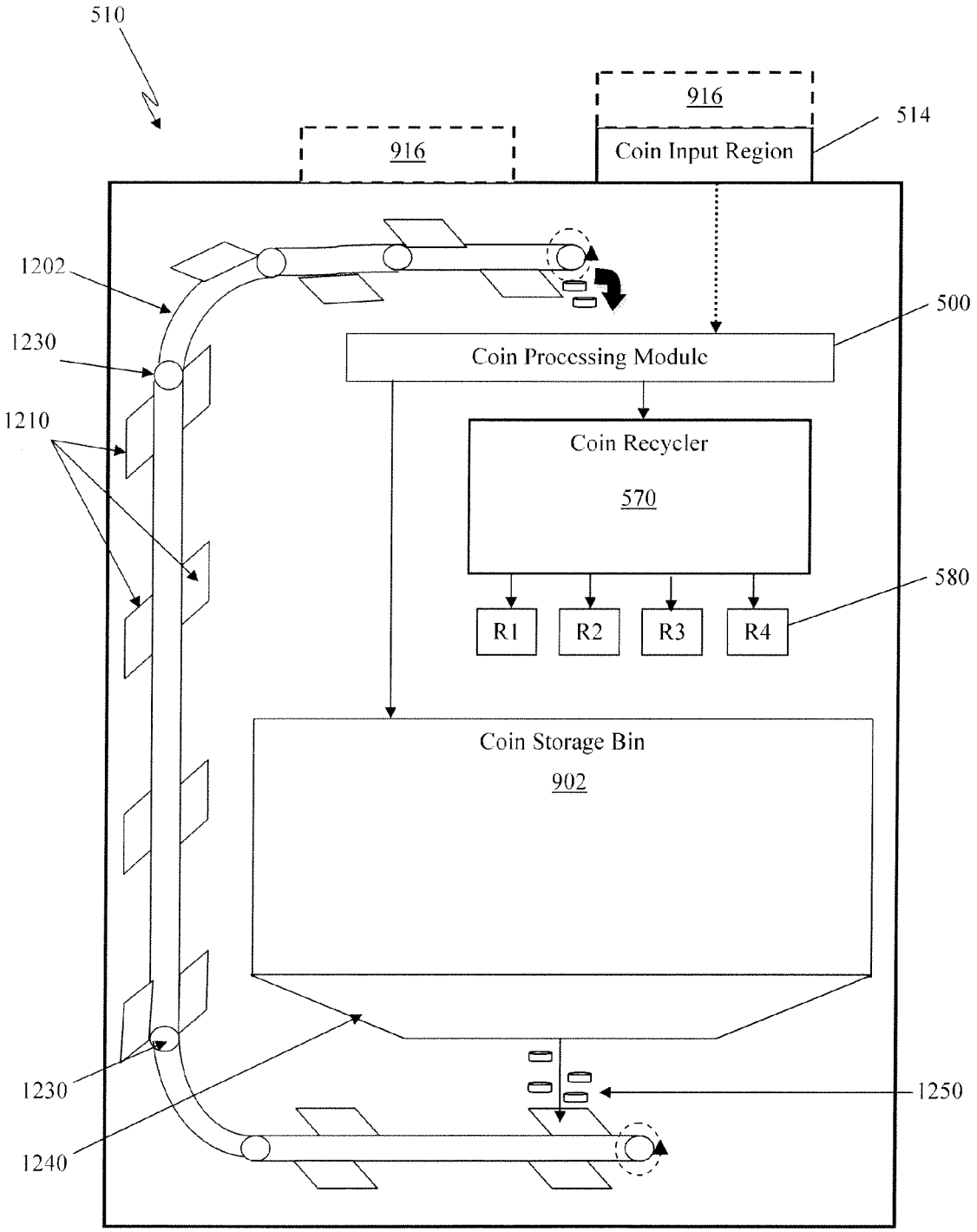

Similarly, if the supervisor inputs an order for multiple denominations (e.g., 500 quarters, 500 dimes, 500 nickels), through a self-service machine 510 display/GUI 512 or remotely through an external system, the controller 520 is configured to cause the coin processing module 500 to output the requested denominations, in one or more subsequent coin processing transactions, to designated ones of the secure coin cassettes (e.g., in FIG. 15, quarters to SC1, dimes to SC2, nickels to SC3) until the requested order has been fulfilled, at which time the next coin of each of the requested denominations (e.g., the 501$^{st}$ quarter, the 501$^{St}$ dime, the 500 nickel) and beyond would then be output by the coin processing module 500 into the mixed coin bin 902 or to another appropriate collection bag within the self-service machine 510. In instances where only one secure coin cassette 900 at a time is available (e.g., SC2-SC5 of FIG. 27B are not available), and such secure coin cassette is determined by the controller not to have sufficient capacity for the order, the controller 520 provides a variety of options to the supervisor. First, the controller 520 provides an option for the supervisor to swap out the unavailable secure coin cassettes for empty secure coin cassettes that are available for use. Second, the controller 520 provides an option for the supervisor to delay processing of the order until a later time at which a sufficient number of secure coin cassettes are available to complete the order. Third, the controller 520 provides an option for the supervisor to serially process of the order using a single secure coin cassette station, wherein when the secure coin cassette (e.g., SC1 in the above example) is full, the supervisor removes the full SC1 once processing has terminated upon reaching the capacity limit of the secure coin cassette and replaces it with an empty secure coin cassette (i.e., an empty SC1 secure coin cassette), at which time processing recommences. Similar options can be utilized for single denomination or multi-denomination orders.

The self-service machine 510 is advantageously, but not necessarily, networked to a network of the business or an external system via communication device 534. Accordingly, status information from the self-service machine 510 and, more particularly, status information relating to the secure coin cassettes 900 is communicated to local or remote devices (e.g., cell phone, computer, tablet, etc.) to notify appropriate personnel (e.g., a business supervisor) as to a status of one or more of the secure coin cassettes 900 (e.g., near-full, full, out-of-service, error, etc.). The business supervisor is then able to take appropriate actions, such as to change out a full secure coin cassette for an empty one. For example, if a one or more secure coin cassettes are filled, they can be quickly (e.g., within a few minutes) removed from the self-service machine 510 and stored or moved to another machine, locally or remotely, for further processing.

As each secure coin cassette 900 is removed from the self-service machine 510 by the supervisor, at least the coin input opening 880 and coin discharge opening 881 will automatically self-lock and secure itself for movement, such as noted above. Other openings, such as data port openings (not shown), may also be configured to automatically lock when the secure coin cassette 900 is not docked. FIG. 15 shows the removal of the secure coin cassette 900 ("SC1") from the self-service machine 510 and movement of the secure coin cassette (see arrow A1). Upon removal and/or during this movement, intermittently or continuously, the secure coin cassette 900 transmits its location and/or other data via one or more signals 888*a*, from the RFID 886 and/or the communication device 885, to reader 887.

Figure 16:
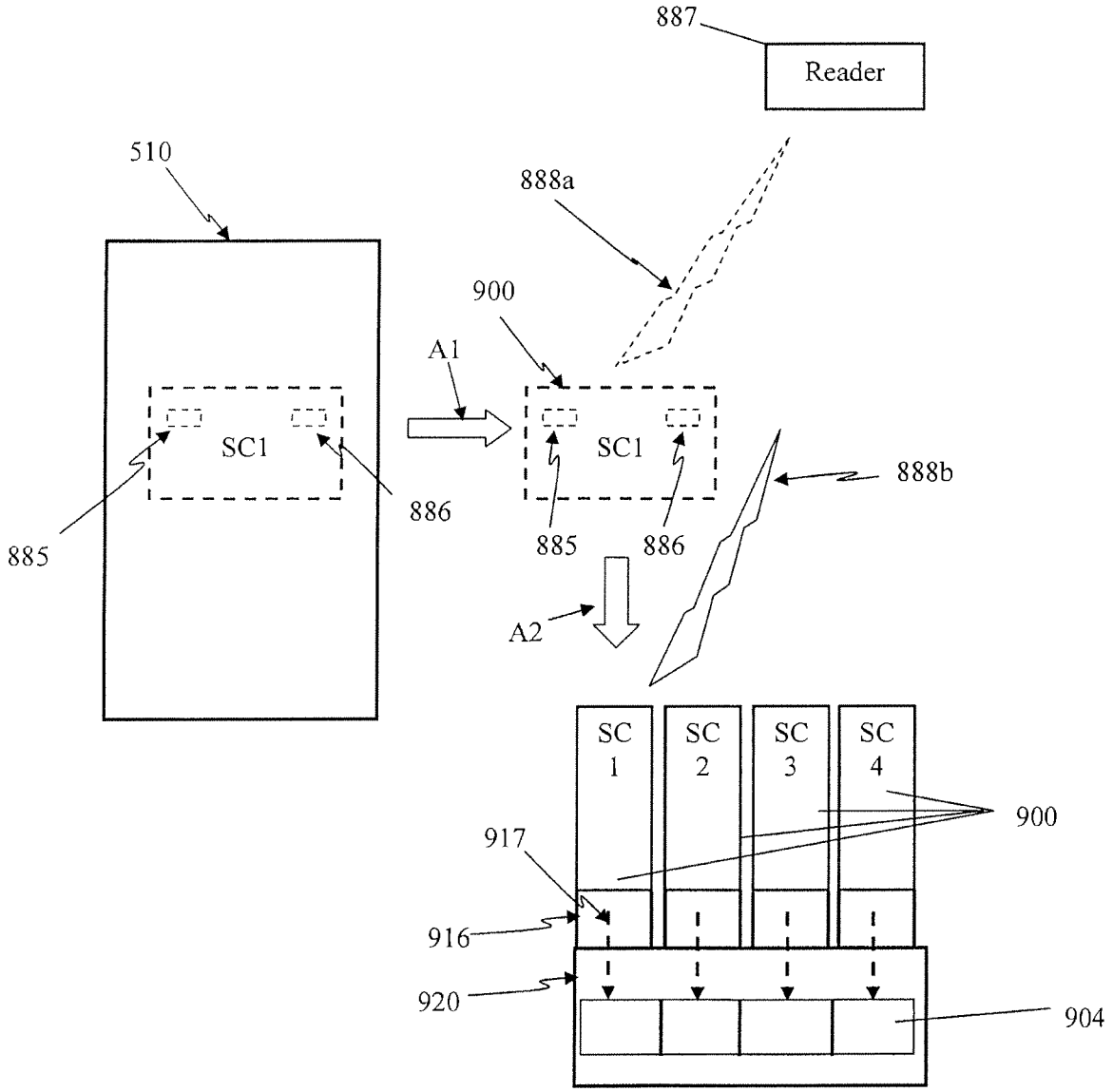
FIG. 16 illustrates another example of movement of a secure coin cassette from a self-service machine to another machine in accord with at least some aspects of the present concepts.

The supervisor is then able to carry the secure coin cassette(s) 900 back to a self-service machine elsewhere in the business (e.g., coin repurposer 915 of FIG. 14 or cash till machine 920 of FIG. 16), or to an adjacently disposed machine where provided, and attach the secure coin cassette(s) 900 to the docking port(s) of the respective machine (e.g., docking ports 916 of the cash till machine 920 of FIG. 16). The movement of the secure coin cassette 900 into place on the docking port 916 is indicated by arrow A2. The docking ports In association with the attachment of the secure coin cassette 900 to the cash till machine 920, the secure coin cassette 900 is registered to the cash till machine 920 (e.g., a location, status and/or other data is transmitted to an external system and/or reader 887 via the RFID 886 and/or the communication device 885 and/or the coin repurposing machine 915).

In the example of the cash till machine 920 of FIG. 16, following the attachment of the secure coin cassette(s) 900 to the docking ports 916, the supervisor (or other authorized personnel) is able to use the secure coin cassette(s) 900 to refills tills 904 for use at the cashier stations. In the aspect shown, each secure coin cassette 900 includes one denomination and feeds such one denomination to a specific portion of a cash till 904 disposed beneath the respective secure coin cassette 900 (e.g., a quarter secure coin cassette outputs quarters to a quarter portion of a cash till 904, etc.). A coin dispenser, configured to regulate the dispensing of coins from each secure coin cassette 900 attached to the cash till machine 920, may be disposed in the secure coin cassette, in the docking port 916, or in the cash till machine 920, without limitation. By way of example and without limitation, a coin dispenser configured to receive coins and singularly and reliably dispense them may comprise a dispenser, such as is disclosed in any of U.S. Pat. Nos. 5,061,222 A, 5,415,582 A, 6,558,245 B2, 6,695,690 B2, 7,294,051 B2 and 8,408,979 B2, which are each incorporated by reference herein in its entirety.

In another embodiment, cash till machine 920 of FIG. 16, a coin processing device (e.g., a coin sorter) is provided at a top portion of the cash till machine. As noted above, and as shown by way of example in FIG. 12, a mid-section of the cash till machine comprises docking stations or docking ports (not shown) configured to operatively receive one or more secure coin cassettes 900 (e.g., single denomination and/or multi-denomination). The one or more secure coin cassettes 900 are removable from the cash till machine 920 following negotiation of one or more security barriers, such as one or more electronic interlocks and/or physical barriers (e.g., a locked door in the housing of the cash till machine).

Figure 18:
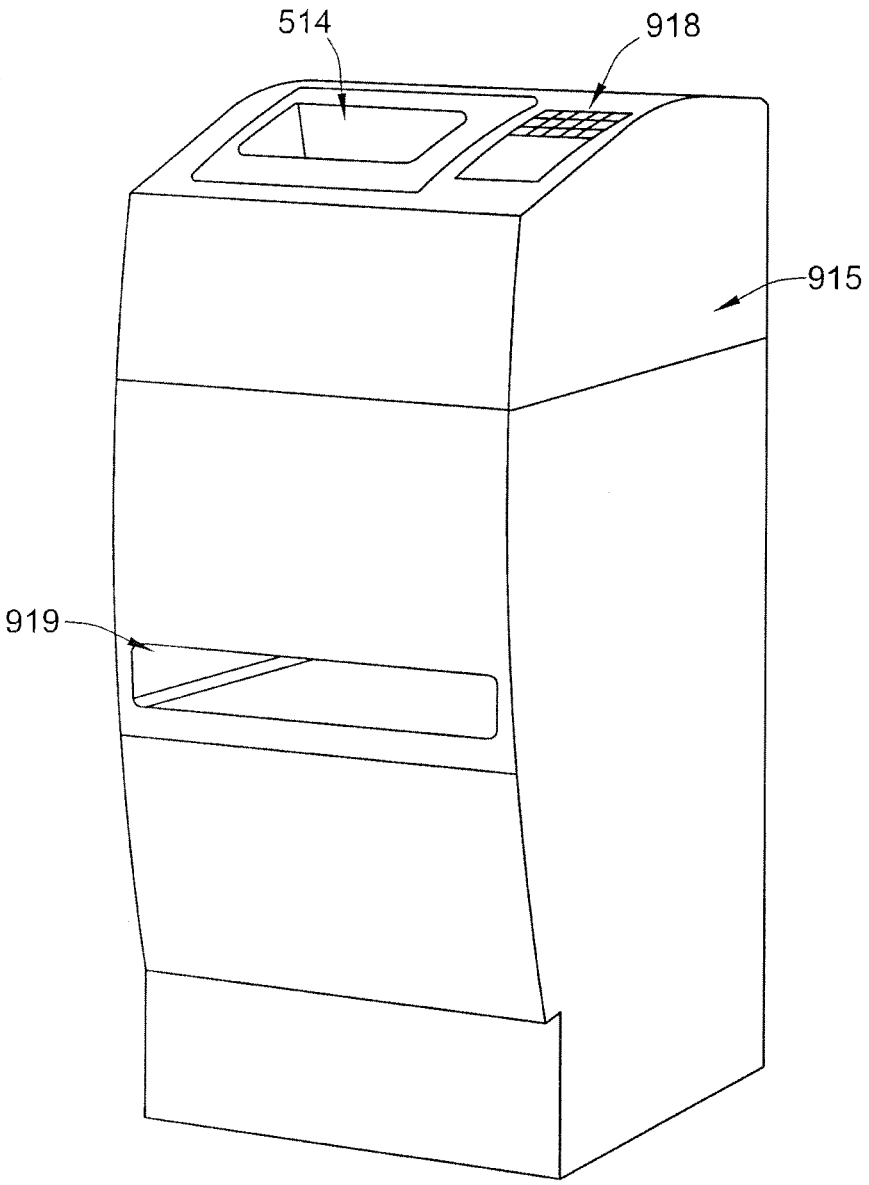
FIG. 18 illustrates another example of a coin repurposing machine utilizing secure coin cassettes in accord with at least some aspects of the present concepts.

FIG. 18 shows a variant of a coin repurposing machine 915 wherein input coins are supplied to coin processing device (e.g., a coin sorter) and then from the coin processing device to a coin repurposer. A user interface 918, such as a graphical user interface (e.g., a touch screen) and/or pushbuttons, is configured to permit an authorized user to input packaging instructions to the coin repurposing machine. The packaged coins are output to the opening 919. The coin repurposing machine 915 may be a stand-alone machine that is networked or non-networked and may communicate with external systems, networks, and/or servers wirelessly and/or via a hardwired connection. In another aspect, the coin repurposing machine 915 of FIG. 18 could utilize internally-disposed secure coin cassettes in combination with the coin processing device. In yet another aspect, the coin repurposing machine 915 of FIG. 18 could omit coin processing device and/or the secure coin cassettes entirely and simply feed the pre-sorted input coins into a packaging queue for packaging by the coin repurposer.

Figure 19:
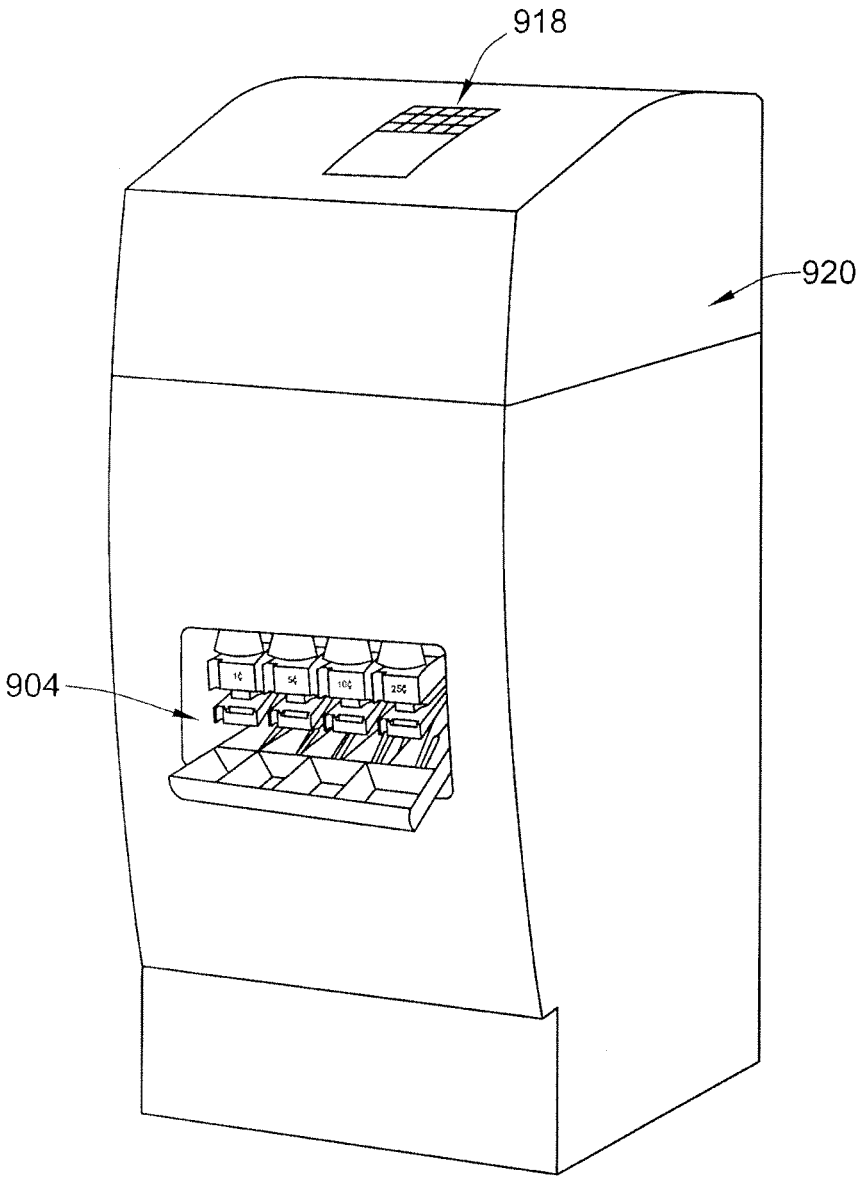
FIG. 19 illustrates an example of a cash till machine utilizing secure coin cassettes in accord with at least some aspects of the present concepts.

FIG. 19 shows an example of a cash till machine 920 utilizing internally-disposed secure coin cassettes in accord with at least some aspects of the present concepts. A user interface 918, such as a graphical user interface (e.g., a touch screen) and/or pushbuttons, is configured to permit an authorized user to input instructions to the cash till machine to dispense particular quantities of and denominations of coins to a cash till 904 positioned in the opening 919. The cash till machine 920 may be a stand-alone machine that is networked or non-networked and may communicate with external systems, networks, and/or servers wirelessly and/or via a hardwired connection.

Figures 20A, 20B, 21A, 21B:
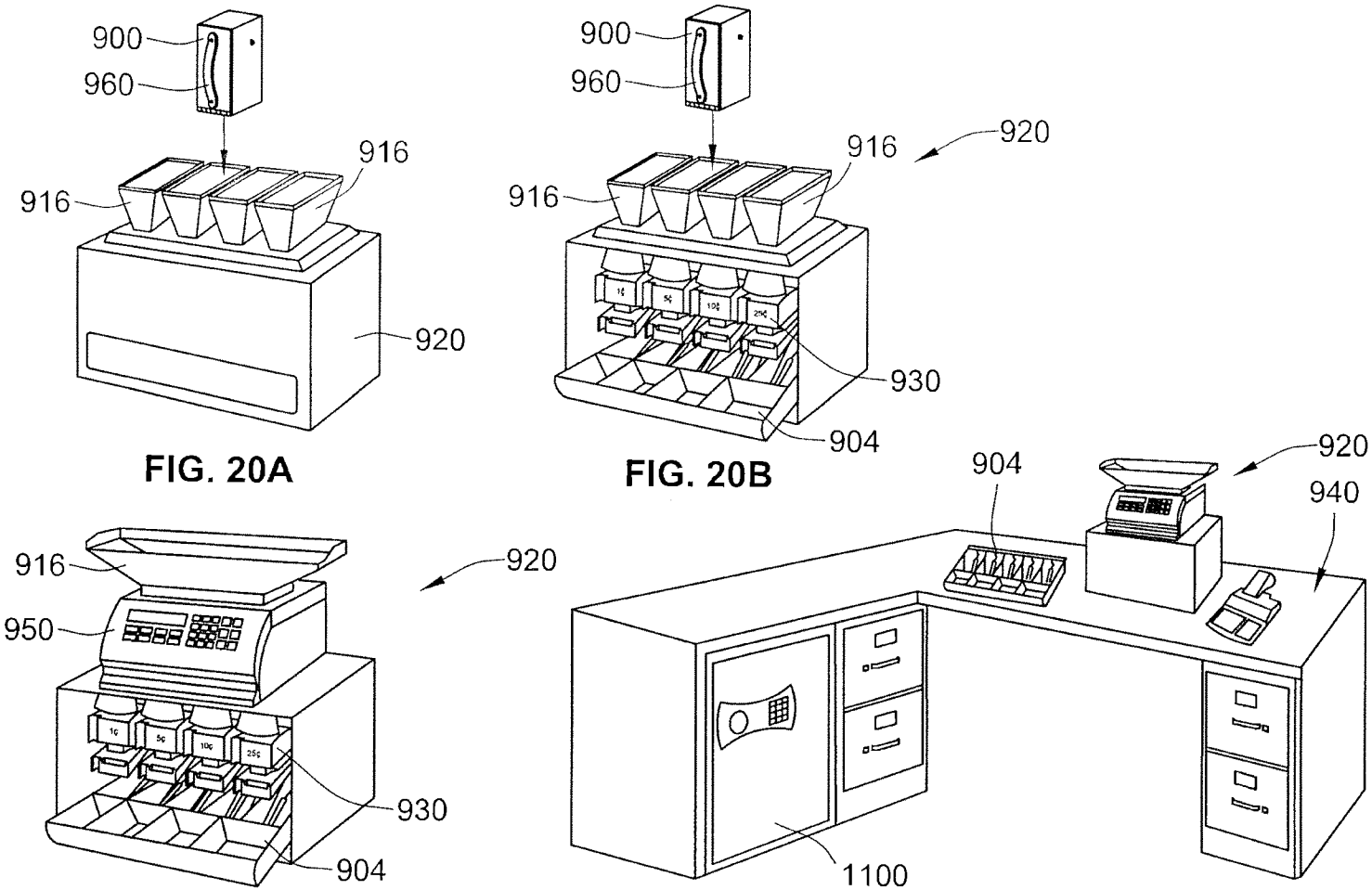
FIGS. 20A-20B illustrate examples of cash till machines utilizing secure coin cassettes in accord with at least some aspects of the present concepts.
FIGS. 21A-21B illustrate additional examples of cash till machines utilizing secure coin cassettes in accord with at least some aspects of the present concepts.

FIGS. 20A-20B show a representation of two embodiments of a cash till machine 920 of FIG. 18 wherein the cash till machine 920 are in open (FIG. 20B) and closed (FIG. 20A) configurations. Atop the cash till machines 920 of FIGS. 20A-20B are disposed docking ports 916 to which secure coin cassettes 900 are attached. Coins from each of the attached secure coin cassettes 900 are output from openings 881 at the bottom portions of the secure coin cassette, such as by a coin dispenser disposed within (see, e.g., FIG. 13) or attached externally to the secure coin cassette, a coin dispenser integrated with the docking port 916, or a coin dispenser 930 provided in the cash till machine 920.

Once dispensed, the coins are directed into appropriate sections of the cash till 904. The open configuration of FIG. 20B shows four coin dispensing devices 930 each coin dispensing device corresponding to a specific secure coin cassette 900 and docking port 916. The coin dispensing devices 930, in one aspect, are configured to hold a predetermined number of coins appropriate to the business cash tills. As one illustration, the secure coin cassette 900 coin dispenser (or docking port 916 coin dispenser if provided) discharges a cash till mix of coins to the respective coin dispensing devices 930 (e.g., $10 in quarters to the quarter coin dispensing device 930) where they are held until required. When a cash till (coin drawer) is inserted beneath the coin dispensing devices 930 the coin dispensing devices may automatically dispense the held coins into the cash till or, alternatively, a user can activate one or more levers on the coin dispensing devices to manually dispense the coins therefrom.

The coin dispensing devices 930 of FIG. 20B can alternatively be used to dispense a predetermined number of coins into a metal coin tube, plastic coin tube (e.g., Fed color coded and sized), pre-formed paper tube (e.g., Fed color coded and sized), plastic sleeve (not shown) which can then be transported for use elsewhere (e.g., elsewhere in the store, to refill a coin change dispensers at a point of sale (POS), etc.). The coin dispensing devices can be used to fill to the exact count of a Federal rolled coin utilizing pre-formed plastic or paper tubes which are Fed color-coded and sized to correspond to the Fed coin tube quantity limit for each denomination of coin. The filled tubes can then be crimped or capped and secured (e.g., in safe 1100) or removed and used (e.g., at a POS).

In another embodiment, the coin dispensing devices 930 can be used to dispense a predetermined number of coins of a denomination into a small container cups, optionally having a sealable top and optionally durable and reusable, which can then be secured (e.g., in safe 1100) or removed and used (e.g., at a POS).

Further, the coin dispensing devices 930 can be used to dispense a predetermined number of coins of a plurality of denominations into a mixed-denomination bulk coin container. For example, an attendant can instruct the coin dispensing devices 930 to dispense (or can manually dispense) five-dollars in quarters, one-dollar in nickels, two-dollars in climes, and fifty cents in pennies to a selected container inserted under the coin dispensing devices 930.

Although not shown, the cash till machines 920 may comprise lockable door limiting access and/or control systems that enable operation of the coin dispensing devices 930 only following satisfaction of security requirements. The cash till machines 920 of FIGS. 20A-20B may comprise a touch screen display (e.g., a 5"-7" display) and a GUI and controls (e.g., electronics/driver board, actuators, etc.) to allow an operator to select a specific number of coins to be dispensed from each of the coin dispensing devices 930. For example, a default condition of the coin dispensing devices 930 may be locked and only entry of a security code into a keypad or GUI caused an associated controller to enable actuation of the coin dispensing devices and, even then, to operate only within predetermined parameters (e.g., to discharge one of a plurality of preprogrammed coin mixes). Different security codes may advantageously enable different parameters (e.g., a supervisor has more permissive parameters than an employee, etc.).

In the embodiment of FIGS. 20A-20B, the cash till machines 920 do not themselves involve an automated device to process and sort coins. Instead, the coins are pre-sorted using a separate method (e.g., ordering them from a bank in bulk, using a coin processing machine to pre-sort/pre-bag, using a secure coin cassette, etc.) and then poured into the docking ports 916, which are configured as coin hoppers, and the coin dispensing devices 930 are used to dispense loose coin to fill cash tills. Thus, the coin dispensing devices 930 may be filled using coins input from a source other than the secure coin cassettes.

FIGS. 21A-21B show another embodiment wherein a cash till machine 920 comprises a coin processing device 950 (e.g., a Cummins Allison Corp. JetSort 1000, etc.) disposed thereon.

In at least some aspects, the funnel 916 at the top of the coin processing device is simply a funnel configured to accept input of loose mixed coins. The coin processing device 950 and cash till machine 920 then, in combination, dispense coin by denomination into intermediate coin holding areas (not shown), into the cash till 904, or into another type of container such as, but not limited to, pre-formed standard coin tubes (Federal specifications) or other coin tubes (e.g., long tubes for refill of POS coin dispensers). In other aspects, however, the coin processing device 950 itself comprises a docking port 916 disposed to feed coins to the coin input region of the coin processing device. A secure coin cassette 900 is attached to the docking port 916 to permit coins to be discharged from the secure coin cassette, via an on-board or external coin dispensing device, into the coin processing device 950 coin input area to be processed thereby. The processed coins are then dispensed into a cash till 904. In this example, the secure coin cassette 900 may comprise a mixed-denomination secure coin cassette, wherein output channels of the coin processing device 950 direct a coin of a specific denomination to a coin path leading to a specific portion of a cash till 904. Alternatively, the secure coin cassette 900 comprises a single-denomination secure coin cassette and the coin processing device 950 directs the coins of that denomination to a specific portion of a cash 904 till via a corresponding coin outlet and coin path.

Although shown to include only a single docking port 916 in FIG. 21A, a plurality of docking ports 916 can be provided atop the coin processing device 950 to discharge thereto a plurality of denominations from single-denomination secure coin cassettes 900.

FIG. 21B shows a representation of the cash till machine 920 disposed on a desktop workspace 940 adjacent to an empty cash till 904. A safe 1100 may be used to store formed deliverable coin packages, deliverable currency bill packages, or deliverable coin and currency bill packages until use, pick-up, or delivery.

FIGS. 21A-21B show examples comprising a coin processing device 950 wherein the coin counting and/or sorting mechanism is used to fill the coin portions of the cash tills 904. These embodiments can be used for a variety applications, such as a stand-alone coin repurposer for back office retail (loose coin cash till repurposing depositing and dispensing) or as integrated into a coin repurposing side car for an automated employee safe or for a personal teller machine. As discussed above, for example, the coin processing device used to fill the cash till 904 and/or secure coin cassettes can be a Cummins Allison Corp. JetSort or a Cummins Allison Corp. "Money Machine," a variant of which is represented in FIG. 12. Coin discrimination is not required.

FIG. 18, discussed above, represents an example of a stand-alone cash till machine 920 wherein the secure coin cassettes 900 are disposed internally. In yet other aspects the cash till machine 920 is integrated with another machine (e.g., a currency repurposer or an ATM), either within the same cabinet, attached thereto, or disposed adjacent thereto or in the vicinity thereof. A user interface, such as a graphical user interface (e.g., a touch screen) and/or push-buttons, is configured to permit an authorized user to input instructions to the cash till machine 920 to dispense particular quantities of and denominations of coins to a cash till 904 (not shown) positioned in a correspondingly dimensioned opening in the cash till machine. By way of example, in such combination, a cashier at the end of a shift can simply empty the coins from the cashier's cash till into the coin repurposing machine (e.g., 510 in FIG. 15) attached to the coin till machine 920. The coin repurposing machine tallies the cashier's cash till coins and outputs the amount to external systems (e.g., accounting). Preferably, the coin repurposing machine performs a coin discrimination function. The empty till 904 is then left for the new cashier's shift. Additional modules may also be integrated therewith to facilitate the counting of and/or dispensing of currency bills.

Figure 22B:
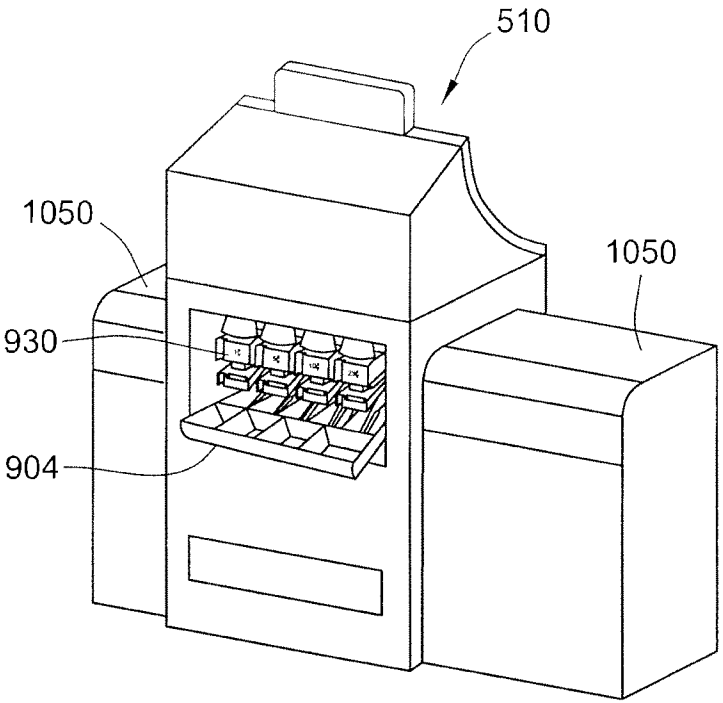
FIGS. 22A-22B illustrate an example of a self-service machine comprising a cash till dispenser in accord with at least some aspects of the present concepts.
Figure 22A:
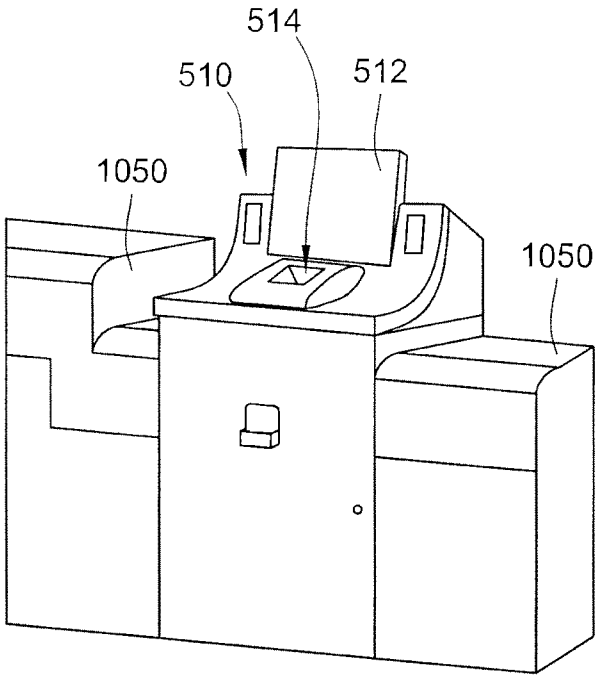

As another example, FIG. 22A depicts an example of a Cummins-Allison Corp. "Money Machine" self-service machine 510, modified in accord with at least some aspects of the present concepts, disposed in a countertop 1050 of a retail environment (e.g., a counter of a bank, a service desk of a grocery store, etc.). In some aspects, a Cummins-Allison Corp. "Money Machine" accepts coins from a consumer, via coin input region 514, and either deposits verified coins into a mixed denomination bin and/or into one or more single-denomination bags and/or one or more mixed-denomination bags. In accord with at least some aspects of the present concepts, the self-service machine 510 depicted in FIG. 22A comprises a plurality of coin dispensing devices 930 disposed on a rear side of the self-service machine. Each of the coin dispensing devices 930 is configured to receive a single coin denomination from the coin processing module (not shown) and/or intermediate coin holding areas (not shown) and/or secure coin cassettes (not shown).

As one example, a retailer may utilize a Money Machine self-service machine 510 utilizing four coin dispensing devices 930, one coin dispensing device for each of pennies, nickels, dimes, and quarters, which are typical coins used by retailer in making change for transactions in the United States. In operation, the Money Machine would sort coin and discharge processed coins into the coin dispensing devices 930 until they are filled with a set number of coins appropriate for use to fill a cash till and further processed coins of a given denomination are the directed by the coin processing module to one or more intermediate coin holding areas, secure coin cassettes, coin bags, and/or coin bins. FIG. 22B shows a backside of the self-service machine 510 of FIG. 22A, with portions of the countertop 1050 in which the self-service machine is disposed. The backside of the self-service machine 510 comprises an opening 950, which may be open (as shown) or may be closed and secured with a locking door. As shown, a cash till 904 is inserted in a bottom portion of the opening 950 to be filled using the coin dispensers 930, such as discussed above. In the example of FIGS. 22A-22B, the opening 950 is disposed on a secure side of the self-service machine 510 (i.e., behind the counter) where it is readily accessible by authorized personnel. Although not shown, a locking door or other access-control device may be utilized to provide additional security for rear access to the self-service machine 510 coin dispensing devices 930. Further, to facilitate employee use, a GUI (e.g., a 5-7" touch screen) may be provided on the rear side of the self-service machine 510.

Figure 23A:
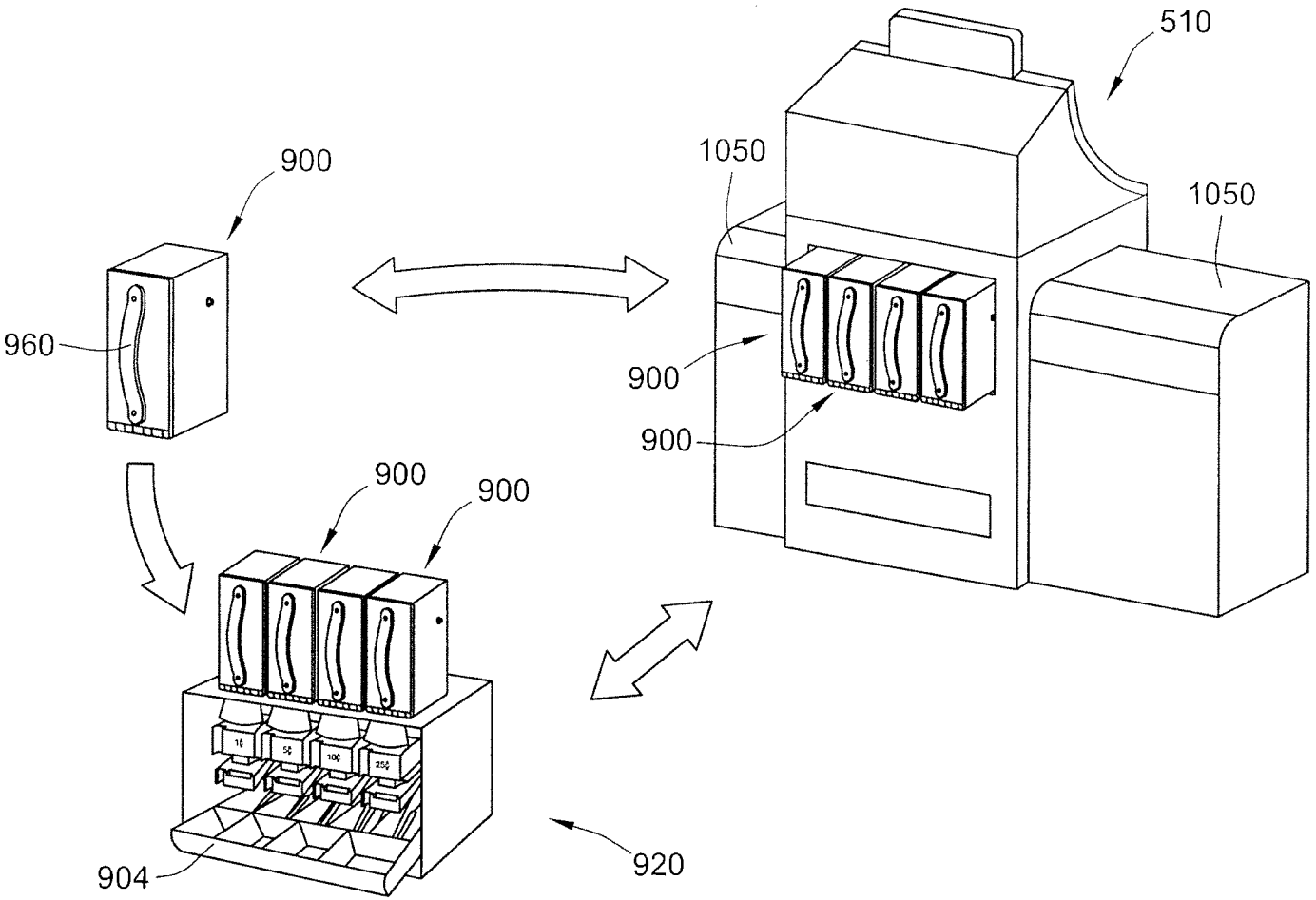
FIG. 23A illustrates an example of a self-service machine utilizing secure coin cassettes in accord with at least some aspects of the present concepts and movement of the secure coin cassettes from the self-service machine to another machine in accord with at least some aspects of the present concepts.

FIG. 23A shows a variant of the self-service machine 510 of FIGS. 22A-22B wherein secure coin cassettes 900 are filled by the self-service machine and are made available to authorized personnel through the back of the self-service machine. For example, the rear of the self-service machine 510 optionally comprises a lockable door and a full cassette is made available for removal responsive to input of an appropriate key (e.g., to unlock the door) and/or codes (e.g., entry of employee code) and/or satisfaction of other security requirements (e.g., biometric scan of finger using biometric reading device). The secure coin cassettes 900 each comprise a handle 960 to facilitate handling. In other aspects, handle 960 comprises a lateral central handle, an upper and lower lateral handle, or a longitudinal handle, similar in orientation to the illustrated handle, formed into the cassette itself so as to be integral with the cassette. As described above, the secure coin cassettes 900 can be removed from the rear of the self-service machine 510 when they are full and an empty secure coin cassette inserted in place thereof. The full secure coin cassette 900 can then be moved to, for example, a cash till machine 920 as shown in FIG. 23A for attachment to docking ports (not shown) thereon.

Figure 23C:
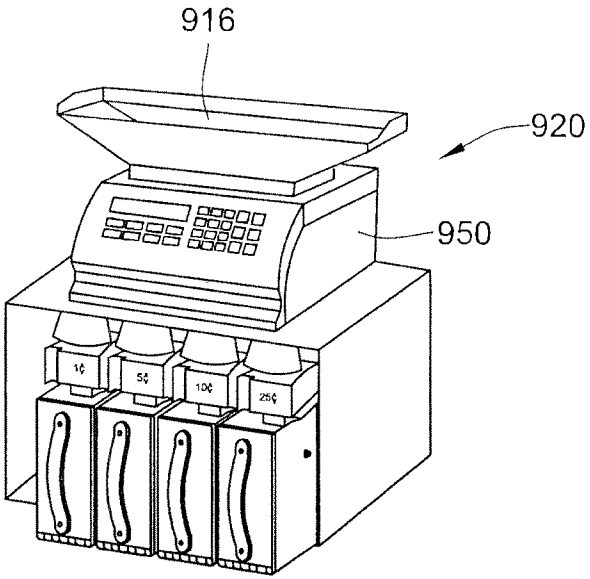
FIG. 23C illustrates another example of a cash till machine filling secure coin cassettes in accord with at least some aspects of the present concepts.
Figure 23B:
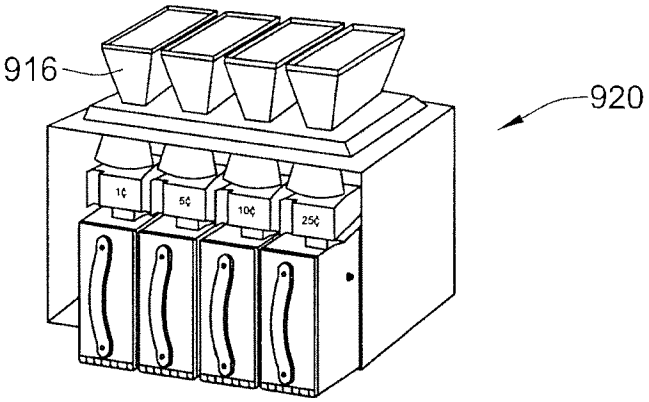
FIG. 23B illustrates an example of a cash till machine filling secure coin cassettes in accord with at least some aspects of the present concepts.

FIGS. 23B-23C show other variants of cash till machine 920 that are configured to fill secure coin cassettes 900. In FIG. 23B, for example, four secure coin cassettes 900 are inserted under four coin dispensing devices 930, each coin dispensing device outputting coins to a specific secure coin cassette 900. In FIG. 23C, the secure coin cassettes 900 are being filled by a coin processing machine 950 disposed atop the cash till machine 920, such as was described above in relation to FIGS. 21A-21B. Docking ports 916 are adapted to receive loose coin. Alternatively, where cassettes do not need to be attached to the cash till machine 920, funnels or coin trays (e.g., tiltable coin trays) could be used in lieu of docking ports.

Figure 24:
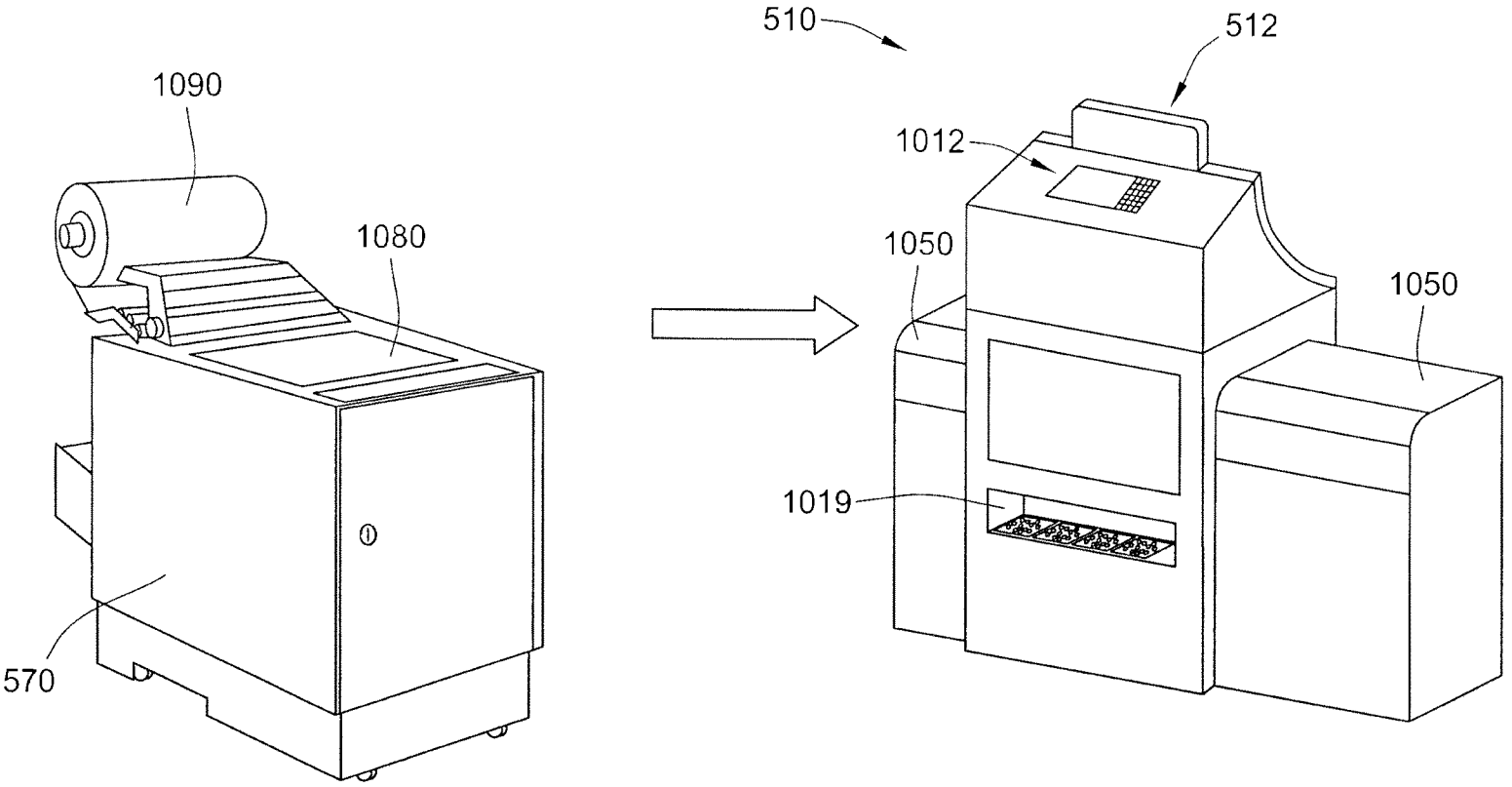
FIG. 24 illustrates an example of a self-service machine utilizing a coin repurposing machine in accord with at least some aspects of the present concepts.

FIG. 24 shows an embodiment of a self-service machine 510 disposed in a counter 1050 separating a public area from a non-public area reserved for use by the business, with the front of the self-service machine facing the public area. Whereas the prior examples provided rear access to secure coin cassettes 900 or a cash till 904 refilling area, the embodiment of FIG. 24 provides a coin repurposer 570 integrated therein, such as is described in relation to FIGS. 8, 10, 11, 14, and 18, with a rear discharge opening 1019. Coins of an appropriate quantity of and denomination, and currency where provided, are discharged to an inlet 1080 of the coin repurposer 570 from intermediate coin holding areas (e.g., I1-I4) and/or secure coin cassettes 900, where they are packaged by the coin repurposer. In one example, one or more rolls of material 1090 (e.g., polyethylene, LDPE, LLDPE, MDPE, Tyvek®, woven fabric, sheet paper, etc.) are used to wrap the ordered coins (or currency bills or coins and currency bills) and one or more heat sealing units (or other types of sealing unit(s) appropriate to the material, such as tape, adhesive, etc.) are used to seal open edges of the package. The material of the one or more rolls of material 1090 may comprise micro-perforations or one or more small openings to permit excess air to escape and to reduce the potential for condensation. Alternatively, the coin repurposer 570 optionally comprises a vacuum sealing device to vacuum seal the prepared coin packages (e.g., where the material used in the packaging is non-porous).

The graphical user interface 512, or an attendant graphical user interface 1012 disposed on a back portion of the self-service machine 510, is configured to permit input or one or more orders for packaged coins, as described elsewhere herein. Ordered packaged coins are dispensed to discharge opening 1019 at the rear of the self-service machine 510 for retrieval by an attendant (in the configuration depicted in FIG. 24). Where ordered by another business or by a member of the public (as opposed to being requested for internal use by the business in which the self-service machine 510 is disposed), the ordered packaged coins (or ordered packaged currency if a package of bills, or a packaged of mixed of coins and bills is ordered) can be removed from the discharge opening 1019 and stored for pickup in a separate secured location. Alternatively, the self-service machine 510 prepares the package, using intermediate coin holding areas (e.g., I1-I4) and/or secure coin cassettes 900 to supply the integral coin repurposer 570 with an appropriate quantity of and denomination of coin for the coin repurposer to prepare the packaged coins in real-time following input of the order by a business or user at the self-service machine and/or following validation of or completion of the order on-site at the self-service machine. The self-service machine 510 may comprise payment input devices such as, but not limited to, a card reader (e.g., smart card reader, magnetic strip reader, PayPass®, Tap&Go™, etc.), a near field transmitter/receiver (e.g., for a digital wallet), and/or a currency bill receiving module appropriate to the networked or non-networked configuration of the self-service machine. Where networked, the coin repurposer 915 is communicatively coupled to external systems, such as accounting systems and remote servers, to effectuate any transactions requiring remote communication.

Although the coin repurposer 570 is shown elsewhere herein to be integrated into a self-service machine 510, the coin repurposer may alternatively be a stand-alone unit into which an attendant disposes a pre-sorted ordered coin mix (or currency bill mix or coin and currency bill mix). By way of example, an attendant (e.g., a supervisor) may utilize a cash till machine 920 to discharge thereto a predetermined coin mix from attached secure coin cassettes 900. This coin mix may then be manually input into the coin repurposer 570 to produce the requested coin package, which is then held for payment and pick-up. The coin repurposer 570 may package coins and/or currency bills using, by way of example, sheet paper wrap, plastic sheet, fabric sheet, pre-formed plastic bags or pre-formed fabric bags (satchels), cardboard boxes, or pre-formed plastic shells, or may itself form a container using the material roll 1090 (e.g., heat sealing LDPE film from the roll 1090 along three sides to form a cavity with an opening along the fourth side, depositing coins in the formed cavity through the opening, and then heat sealing the opening at the fourth side, etc.). The packaged coins are then dispensed into a discharge opening 1019.

In yet other aspects of the present concepts, an ordered coin mix may be processed by an attendant, such as a supervisor, and manually packaged for delivery to another person or business. For example, an attendant (e.g., a supervisor) uses a cash till machine 920 to discharge thereto a predetermined coin mix from attached secure coin cassettes 900, manually packages the coin mix into a bag or box, seals the bag or box, and then holds the coin package for payment and pick-up. Due to the potential for human error, this approach is less preferred than an automated approach.

In another variant of the self-service machine 510 depicted in FIG. 24, an opening 1019 is also provided at a front part of the self-service machine for direct access by a requestor (e.g., another business or by a member of the public) so that the ordered packaged coins (or ordered packaged currency if a package of bills, or a packaged of mixed of coins and bills is ordered) can be removed from the discharge opening 1019 by such requestor following payment and/or validation.

FIG. 25 shows an embodiment of at least one aspect of the present concepts wherein a coin processing device 950 (e.g., a Cummins Allison Corp. JetSort 1000, etc.) is integrated with a coin repurposer 570. The coin processing device 950 comprises a docking port 916 or funnel disposed to feed input coins, such as loose mixed coins, to the coin input region of the coin repurposer 570. The coin repurposer 570 then creates a satchel or bag using the stock material from the material roll 1090. For example, as noted above, the heat sealers (not shown) can be used to seal the stock LDPE film from the material roll 1090 along three sides to form a cavity with an opening along the fourth side, after which coins are deposited in the formed cavity through the opening, and then the opening at the fourth side is heat sealed to form a package or sachet. Alternatively, the coin repurposer could forgo on or more heat sealers and instead utilize one or more applicators for a pressure-sensitive permanent adhesive that can then be sealed via application of pressure. A printer can be provided to label and/or number the package (e.g., with bar codes, requestor name, amounts, etc.) to facilitate storage and audit.

In at least some aspects, the coin sachets formed by the coin repurposer 570 comprise coin mixes specified by a business or person placing an order for coins of such specific mix.

In other aspects, the sachets formed by the coin repurposer 570 comprise coin denomination limits specific to internal use by the banks (e.g., a Fed-specified amount for a particular denomination). The sachets utilize clear plastic having at least a 6.5-mil gauge thickness, possess a tamper-evident seal, have formed therein a reinforced handle able to withstand hang test with a +100 lb. load, and have a label on the opposite side of the handle showing the denomination, dollar amount, depositor's name, and ABA routing number (with four-digit branch code/four-digit endpoint number). The plurality of material rolls 1090 may comprise a plurality of different materials (e.g., so that different layers of the satchel can provide different properties or characteristics).

In some aspects, a secure coin cassette 900 is attached to the docking port 916 to permit coins to be discharged from the secure coin cassette, via an on-board or external coin dispensing device, into the coin repurposer 570 to be packaged thereby for re-use. The packaged coins are then dispensed into a discharge opening 1019.

In other aspects of the device of FIG. 25, a pre-sorted order of coins is input into the docking port funnel 916 following processing of the order using another coin processing device. In this aspect, the coin processing device 950 serves as a check on the accuracy of the order and the coin processing device 950 optionally prints a verification of the count that is actually packaged and can dispense a copy of such printout to the coin repurposer 570 to be incorporated into the coin package. Although FIG. 25 is only shown to have a single docking port 916, a plurality of docking ports 916 can be provided atop the coin processing device 950 to discharge thereto a plurality of denominations from single-denomination secure coin cassettes 900.

FIG. 25 also shows a representation of the coin repurposer 570 and coin processing device 950 combination disposed adjacent a desktop workspace 940. A safe 1100 may be used to store formed coin packages, currency bill packages, or coin and currency bill packages until use, pick-up, or delivery.

Figure 26B:
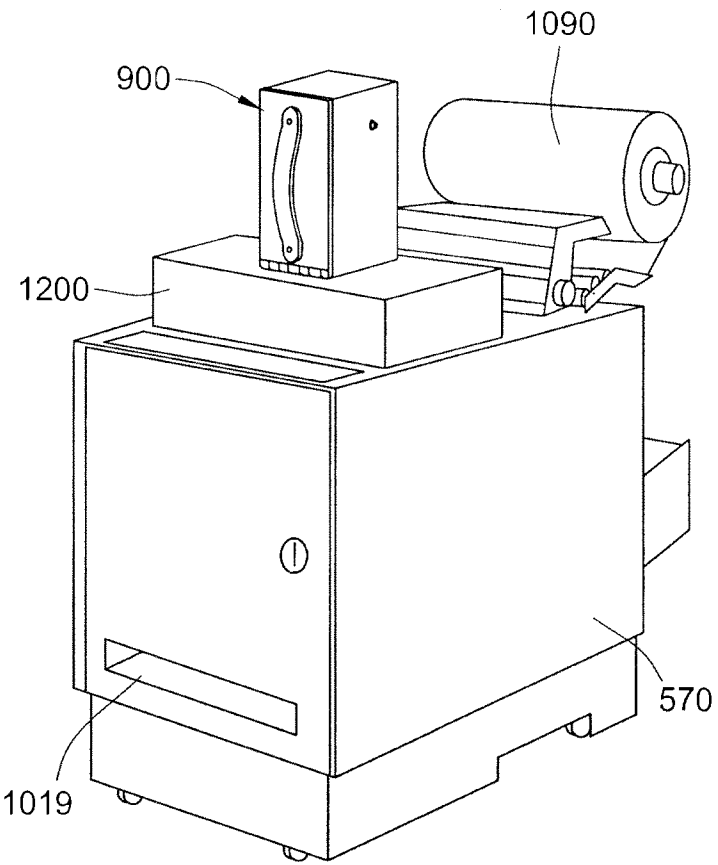
FIGS. 26A-26B illustrate examples of a coin repurposing machine utilizing secure coin cassettes in accord with at least some aspects of the present concepts.
Figure 26A:
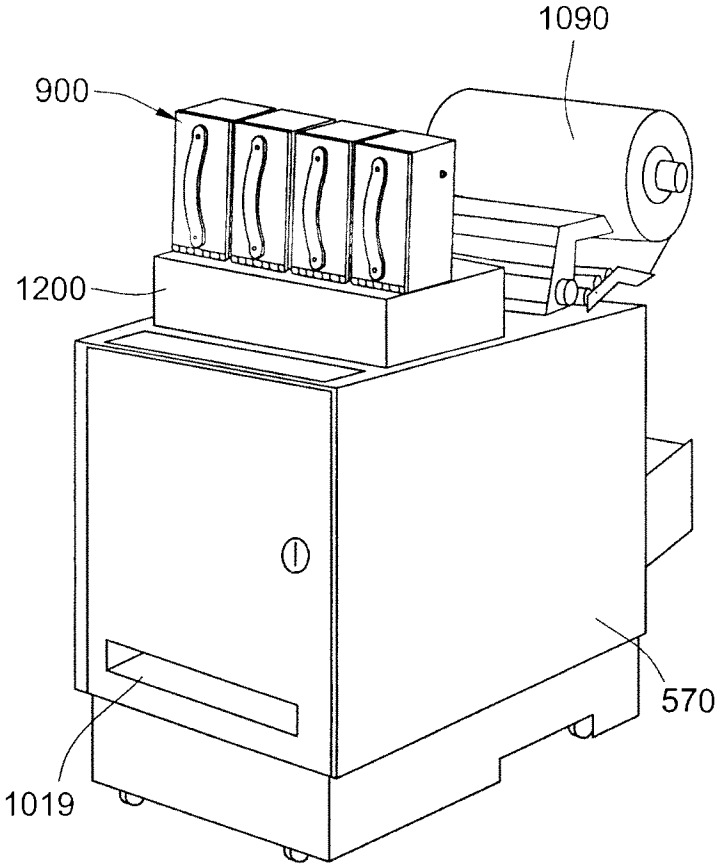

FIGS. 26A-26B show an embodiment of at least one aspect of the present concepts wherein a plurality of single denomination secure coin cassettes 900 are integrated with a coin repurposer 570 (FIG. 26A) or a single, mixed denomination secure coin cassette 900 is integrated with a coin repurposer 570 (FIG. 26B). A docking port 1200 is provided to secure the secure coin cassette(s) 900 in place, to facilitate the discharge of coins therefrom, and to provide data and/or power connections to the secure coin cassette(s) 900. In some aspects, the secure coin cassette(s) 900 discharge coins via an on-board or external coin dispensing device. In other aspects, the docking port 1200 comprises one or more coin dispensing devices. Coins packaged (e.g., into clear plastic satchels) by the coin repurposer 570 (e.g., using a plastic film material roll 1090) are then dispensed into a discharge opening 1019. The formed package of coins (e.g., satchels) can be used, for example, to re-circulate coins into cash tills in the business.

FIGS. 27A-27D show yet other aspects of the present concepts, wherein a self-service machine 510, such as a Cummins Allison Corp. Money Machine™ 2, is configured to supply coins from the coin storage bin 902 to a conveyor system 1202 configured to convey such coins to a coin processing module 500, which would repurpose the coins and output selected coins to one or more coin cassettes 900 (e.g., one coin cassette, two coin cassettes, five coin cassettes, ten coin cassettes, etc.), coin tills 904, or coin repurposer 570 (which in turn would form and output one or more coin repurposing package(s) to respective currency retrieval areas 580 (e.g., R1-Rx)) to thereby utilize coins from the coin storage bin to process a coin repurposing order.

The conveyor system 1202 may utilize any conventional conveyor such as, but not limited to, a vertical conveyor, spiral conveyor, belt conveyor, screw conveyor, or bucket conveyor dimensioned and configured, as appropriate, for conveyance of coins 1250 within the self-service machine 510. As represented in FIGS. 27A-27D, the conveyor system 1202 receives coins output from the base 1240 of the coin bin 902 and temporarily holds the coins in recesses, pockets, or the like 1210. The mixed coins 1250 are moved from the base 1240 of the mixed coin bin 902, via the conveyor system 1202, upwardly to a position where the coins can be discharged from the recesses or pockets 1210 to the coin processing module 500. To facilitate the ordered flow of coins, the base 1240 of the coin bin 902 comprises one or more actuators (not shown) adapted to regulate the flow of coins from the coin bin (e.g., one at a time, a few at a time, ten at a time, twenty at a time, etc.).

Figure 27D:
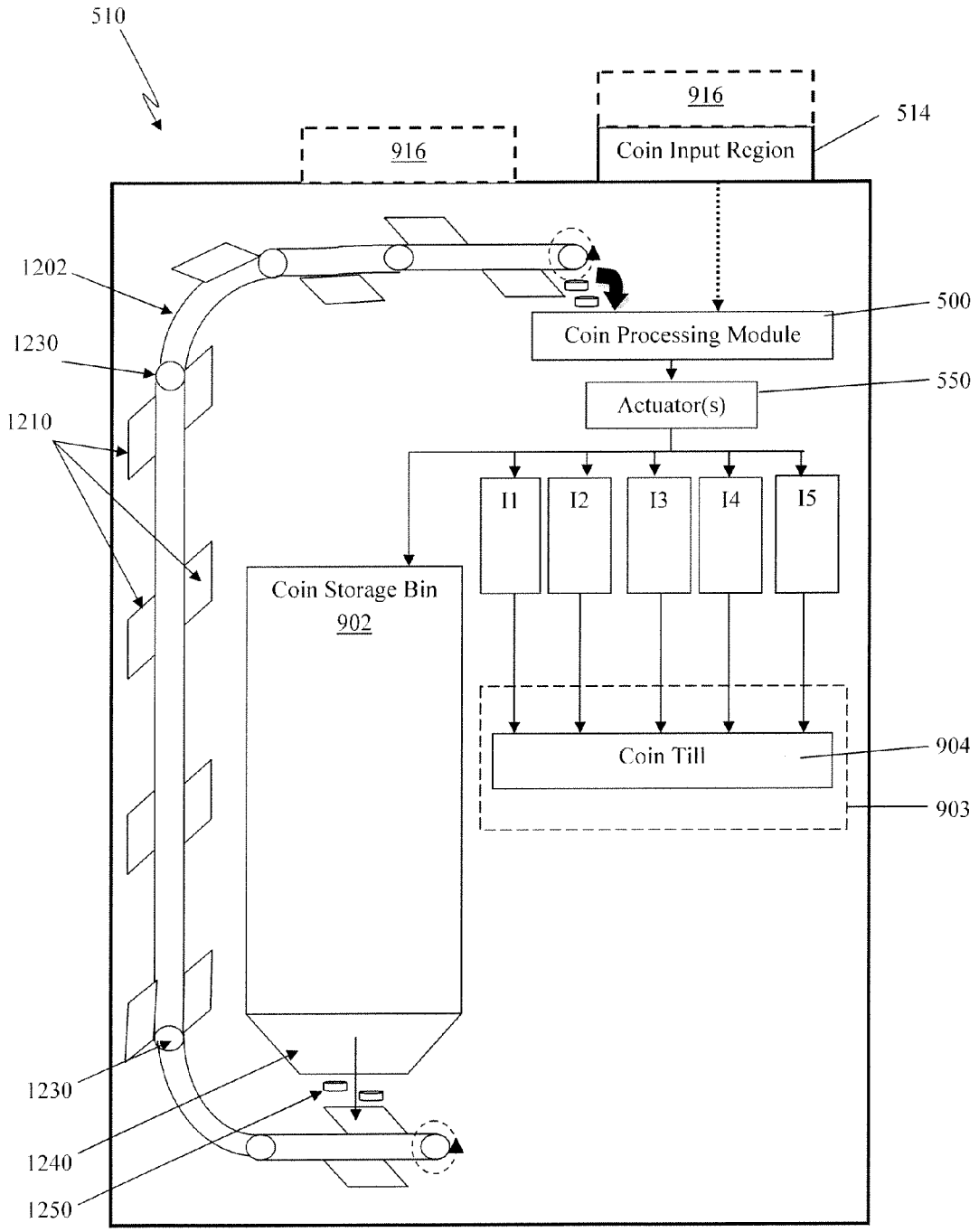

Thus, if an authorized person (e.g., a store supervisor in the store in which the self-service machine 510 was situated, whether in a public area or a back room) wanted to fill one or more coin cassette(s) (or other coin package(s), such as a satchel) with a specific number of quarters for use within the store (e.g., 250 quarters, 500 quarters, 1000 quarters, etc.), he or she would place an order through an appropriate interface with the self-service machine 510 (e.g., a machine GUI 512, a supervisor mode on the machine, a machine button panel, a remote request through an external system, such as a connected computer or a handheld mobile device, etc.). In at least some aspects of the present concepts, following receipt of the order, the self-service machine 510 would initially determine, via the controller(s) 520 (not shown in FIG. 27A) whether or not sufficient coins to fill the order were available in one or more of the secure coin cassette(s) 900. If the controller(s) 520 operatively associated with the self-service machine 510 determine that the secure coin cassette(s) 900 are not available to satisfy the order, the self-service machine activates a coin transport system (e.g., conveyor 1202 in FIGS. 27A-27D) to transport coins from the coin storage bin 902 to the coin processing module 500, where the mixed coins from the coin storage bin would then be processed (again) and separated by denomination. Optionally, the coin processing module 500 is started subsequent to the starting of the coin transport system at a time at which the first coins from the coin transport system would be nearing the coin processing module. The coin processing module 500, under the control of the controller 520 (not shown in FIGS. 27A-27D), dispenses the specified coins (e.g., single denomination, mixed denominations, etc.) to one (or more) designated secure coin cassette(s) 900 (e.g., SC1-SCx, as shown in FIGS. 27A-27B), to a coin repurposer 570 configured to form deliverable coin packages (shown in FIG. 27C), or to one or more intermediate holding areas (e.g., I1-I5, as shown in FIG. 27D). Coins not fitting the requested profile of the order are output by the coin processing module 500 to the coin storage bin 902.

This process continues until the order has been fulfilled, at which point all of the remaining coins in the coin transport system are processed by the coin processing module 500 and returned to the coin storage bin 902, with corresponding updates to the tallies of coins stored in the coin storage bin and secure coin cassette(s) 900, respectively. Following completion of these acts, the self-service machine 510 may be either immediately placed back into service, such as in the case of an order for coins placed by a supervisor through an external system (e.g., a remote computer) to avoid unnecessarily out-of-service times, or may be placed back into service only following retrieval of the one (or more) designated secure coin cassette(s) 900 by the requestor (e.g., a store supervisor), such as where the requestor is present at the self-service machine and is able to contemporaneously retrieve the one (or more) designated secure coin cassette(s) and manually place the self-service machine back in service.

With reference to an illustrative example of a user of the systems shown in FIGS. 27A-27D, at the end of a day, a supermarket manager might determine that the store is in need of between one and two full cassettes of quarters (e.g., each being ¼ of a Federal Bag) from a self-service machine 510 disposed in the supermarket. The supermarket manager can place an order at the self-service machine 510, or via an intermediary device (e.g., computer, laptop, wireless device, etc.), for the required number of quarters. The self-service machine 510 would then allocate two secure coin cassettes 900 for the input order, start the coin transport system to divert coins from the coin storage bin 902 to the coin processing module 500, and process the mixed coins using the coin processing module 500 to separate the coins by denomination and, under the control of the controller 520 (not shown), dispense the quarters first to the first designated secure coin cassette 900 until full and then to the second designated secure coin cassette. When the second designated secure coin cassette 900 is full, remaining coins in the coin transport system are processed by the coin processing module 500 and output back to the coin storage bin 902.

By way of example, in view of the configuration of FIGS. 27A-27D, inter alia, a supervisor can take the self-service machine 510 out of operation for a brief period of time to provide for in-store repurposing of coins (e.g., to a secure coin cassette 900, coin till 904, repurposed coin package, etc.). Advantageously, the supervisor is enabled to quickly access mixed coin located in the coin storage bin 902 and divert this coin to the coin processing module 500, where it is separated by denomination, and the selected coin denomination(s) are output to a destination of choice (e.g., to a secure coin cassette 900, coin till 904, repurposed coin package, etc.) until such destination has received a specified number of coins of such denomination. To illustrate, a supervisor can access the self-service machine 510 (e.g., locally using an input device, such as a GUI, or remotely using an external system, such as a remote computer), activate a "supervisor mode" or other controlled-access mode, input the coin order requirements (e.g., the denomination(s), quantity/quantities of coin(s)), and desired repurposing form(s) (e.g., secure coin cassette(s), bag(s), shrink wrap, etc.). The self-service machine 510 controller 520, responsive to the input order, causes activation of the coin conveyor system 1202 and activation of one or more actuators to release coins from the coin bin 902 to the conveyor system 1202. The conveyor system 1202 receives coins 1250 output from the coin bin 902 (e.g., a gravity feed from the base 1240 of the coin bin, etc.), temporarily holds the coins in recesses, pockets, or the like 1210, and moves the coins upwardly to a position where the coins can be discharged from the recesses or pockets 1210 to the coin processing module 500 inlet for reprocessing.

The coin processing module 500 processes the coins 1250 delivered by the conveyor system 1202 and delivers the sorted coins to the appropriate secure coin cassette 900. In one aspect, the secure coin cassette 900 is denomination-based and mixed coin is sorted by the coin processing module 500 so that quarters are discharged to a secure coin cassette 900 for quarters, dimes are discharged to a secure coin cassette for dimes, nickels are discharged to a secure coin cassette for nickels, and pennies are discharged to a secure coin cassette for pennies.

The coin processing module 500 continues to operate until one or more of the secure coin cassettes are full or otherwise at a desired level (e.g., a predetermined value, a predetermined number of coins, etc.), at which time the coin processing module stops outputting coins to the secure coin cassette 900 and instead discharges any coins remaining in the coin processing module, or later input into the coin processing module, back to the coin bin 902 or other designated output. At the same time, the controller 520 causes the actuator(s) (not shown) at the base of the coin bin 902 to stop discharging coins from the coin bin and causes the conveyor system 1202 to continue operating to deliver coins to the coin processing module 500 until the conveyor system no longer conveys any coins. When it is determined by the controller 520 that all coins on the conveyor system 1202 have been deliver to the coin processing module 500, processed thereby, and returned to the coin bin 902 (e.g., by a complete circuit or cycle of the conveyor system 1202 with no coin being processed by the coin processing module, lapse of a predetermined time, lapse of a predetermined time with no coin being processed by the coin processing module, etc.), the controller stops the conveyor system.

Following the filling of the secure coin cassette(s) 900 with one or more denominations, either as a single-denomination secure coin cassette or a mixed or multi-denomination secure coin cassette, the supervisor could then unlock an access panel (not shown) in the self-service machine 510 to permit access to the secure coin cassette(s) for which the order for repurposed currency had been output. As one example, if only one secure coin cassette 900 is available to a supervisor, and the supervisor needs to secure two coin cassettes of coins (e.g., a first secure coin cassette of a first denomination and a second secure coin cassette of a second denomination, which could optionally be the same as the first denomination) the supervisor could remove the first full coin cassette, replace it with an empty secure coin cassettes, and continue the repurposing operation until the empty secure coin cassette has received the requisite number of coins of the desired denomination. As noted above, coins that are not of the selected denomination for the particular secure coin cassette are redirected back to the coin bin 902 or, if applicable, are diverted to other secure coin cassettes.

Following completion of the repurposing operation, the supervisor would turn off the coin conveyor system 1202 and place the self-service machine 510 back into service for customers and consumers to utilize.

Since the self-service machine 510 maintains an exact count of all coins in the coin bin 902, the self-service machine is preferably configured to, upon receipt of the request for repurposed coins, compare the requested number of or value of coins of the first denomination (e.g., quarters) to an actual number of or value of coins of the first denomination in the coin bin, such actual number of or value of coins of the first denomination in the coin bin being maintained on a memory device associated with the coin processing device, and output a message to the authorized person that the request cannot be filled. Thus, if the supervisor requests that the self-service machine 510 discharge 1000 quarters to a secure coin cassette 900, and the coin bin 902 only contains 750 quarters (at that time), the self-service machine outputs a message to the supervisor (e.g., via a self-service machine display, text message to an electronic device used to place the request, etc.) informing the supervisor that the request cannot be filled at that time (e.g., an "error" message, etc.). Optionally, the self-service machine 510 provides an option of storing the request for fulfillment at a later time, with the self-service machine being configured to periodically (e.g., after each coin processing operation, every 10 minutes, every 30 minutes, etc.) compare the actual number of or value of coins of the first denomination in the coin bin to the requested number of or value of coins of the first denomination. Following satisfaction of such condition, the self-service machine can either notify the supervisor of the viability of order fulfillment or automatically initiate the repurposing operation based on a prior instruction from the supervisor.

In another aspect of the present concepts, it is conceivable that contents of the mixed coin bin 902 could be owned by more than one party. For example, a store in which a leased self-service machine 510 is situated could be entitled to a first value of the coins borne within the mixed coin bin 902 and an owner of the self-service machine is entitled to a second value of the coins borne within the mixed coin bin. The owner of at least a portion of a value of the coins (e.g., a store supervisor in the store in which the self-service machine 510 was situated) is enabled to withdraw, via the system depicted in FIGS. 27A-27B, a value correspond to that owned from the mixed coin bin 902 (e.g., to reconcile a balance sheet at the end of a shift, day or week, etc.). Following identification of the authorized user to the self-service machine 510 via an appropriate interface (e.g., a machine GUI 512, a supervisor mode on the machine, a machine button panel, a remote request through an external system, such as a connected computer or a handheld mobile device, etc.), the system enables the authorized user to, via selection of inputs (e.g., selectable buttons, soft buttons, etc.), input an order for one or more coin packages (see, e.g., FIG. 27C), having a cumulative value totaling the value of coins owned by such person or entity. Once the request for the coins has been input into the self-service machine 510, via selection of appropriate inputs using an interface with the self-service machine controller(s) 520 (not shown in FIG. 27A) and the controller(s) 520 determine that the secure coin cassette(s) 900 are not available to satisfy the request, the self-service machine activates the coin transport system (e.g., conveyor 1202 in FIGS. 27A-27D) to transport coins from the coin storage bin 902 to the coin processing module 500 for processing and repurposing. The coin processing module 500, under the control of the controller 520 (not shown in FIGS. 27A-27D), dispenses the specified coins (e.g., single denomination, mixed denominations, etc.) to one (or more) designated secure coin cassette(s) 900 (e.g., SC1-SCx, as shown in FIGS. 27A-27B) and/or to a coin repurposer 570 configured to form deliverable coin packages (shown in FIG. 27C) as designated by the requestor. Coins not fitting the request are discharged by the coin processing module 500 back to the coin storage bin 902.

In another aspect, where there is multi-party claim to the currency processed by the self-service machines (e.g., 510) disclosed herein, As yet another option, one or more self-service machines 510 situated in a business is networked to the POS network connecting the various sensors, scanners, cash registers and/or EFTPOS terminals to a back-room, local or remote computer. The controller(s) 520 for the self-service machine(s) 510 and/or the controller(s) for the POS network monitor the cash flow (e.g., coins and/or currency bills) at each of the cash register tills. Upon assuming a new shift at a register, the amount of the till is entered manually by the cashier or is registered automatically (e.g., each till is registered and tracked and an amount input into the till prior to the shift by an automated cash till management system is entered into the POS network as a shift starting value). With successive transactions, the POS network and/or controller(s) monitors the inflow and outflow of coins and/or currency bills. When the controller(s) 520 for the self-service machine(s) 510 and/or the controller(s) for the POS network determine that a particular till requires, or will require, replenishment of one or more coin denominations or currency bill denominations, the controller(s) 520 for the self-service machine(s) 510 can then be optionally configured to automatically generate a deliverable currency package for that individual till. Thus, if a particular coin till is running short on quarters and is projected to require more quarters during the shift, the self-service machine(s) 510 is configurable to generate a deliverable coin package comprising quarters in an appropriate amount (e.g., a predetermined amount, an amount relating to a time-remaining in shift, an amount relating to a rate of cash till coin utilization, an amount specifically requested by the cashier via the cashier terminal or other input device, etc.) for pick-up by an authorized person (e.g., a shift manager, etc.) for delivery to the cashier. A label could be advantageously printed by a printing device of the self-service machine(s) 510 and affixed to the deliverable coin package, receipt of which is then entered into the POS network via, for example, manual input by the cashier into the cashier terminal or scanning of the deliverable coin package by a cashier terminal scanning device.

The foregoing disclosure has been presented for purposes of illustration and description. The foregoing description is not intended to limit the present concepts to the forms, features, configurations, modules, or applications described herein by way of example. Other non-enumerated configurations, combinations, and/or sub-combinations of such forms, features, configurations, modules, acts, elements, and/or applications are considered to lie within the scope of the disclosed concepts.

By way of example, other modules are utilizable in combination with the self-service machine 510 and/or coin repurposer 570 disclosed herein. For example, a document processing module or document processing machine (e.g., a Cummins Allison Corp JetScan currency sorter, a Cummins Allison Corp JetScaniFX i400, etc.) may be optionally provided to accept documents including currency bills, but also tickets, checks, and/or other security paper or bearer paper. Yet other add-on modules to the self-service machine 10 could include, by way of example, a value card dispenser and/or an ATM. Thus, various combinations of the present concepts are expressly contemplated as falling within the scope of the disclosure and, by way of example, the self-service machine 510 may comprise only a coin processing and repurposing module, only a currency bill processing and repurposing module, or both a coin processing and repurposing module and a currency bill processing and repurposing module.

As a further variation on the concepts disclosed herein, the secure coin cassettes 900 are utilizable in combination with the document processing modules to store and/or dispense currency bills, with the same features and functionality as that described above with respect to the secure coin cassettes 900.

The coin repurposing machines 570 disclosed herein may comprise additional docking ports configured to receive secure coin cassettes 900 bearing currency bills and the coin repurposing machines in turn configured packages of mixed coin and currency bills (e.g., in sachets or packets), coins of a single denomination, mixed-denomination coins, single denomination of currency, mixed denominations of currency, documents, or any combination thereof, without limitation.

The concepts herein apply to any country's currency system, inclusive of U.S. currency, and further apply to configurations adapted to accommodate mixed currency systems (e.g., airports where multiple currencies are frequently present, border crossing areas, etc.).

Although the repurposed currency retrieval areas R1-Rx are generally described herein as output locations for packet(s) or package(s) of coin and/or currency bills, the present concepts include dispensing of loose (unpackaged) coin and/or currency bills to the repurposed currency retrieval areas R1-Rx or other currency dispensing outlet.

In any of the self-service machines disclosed herein, a "teller assist" or trained personnel may be made available to a user to facilitate or complete certain transactions.

Further, although many of the machines or devices described herein, by way of example, refer to a resident controller in the machine or device, such control may alternatively be provided by one or more external controllers, which may be local or remote.

Yet further, in accord with at least some aspects of the present concepts, the self-service machines disclosed herein may advantageously include a biometric device configured to positively identify a user to the self-service machine via a previously enrolled biometric input or template. In one embodiment, the biometric device is incorporated in the self-service machine. Alternatively, the biometric device is carried by the user (e.g., a biometric device incorporated into a smart phone or handheld device, etc.) which the user then activates to transmit data to the target self-service machine. For example, some users may carry a fingerprint-based fob (e.g., an electronic key) that may be adapted to input identifying information on the user's biometric characteristic to the self-service machine. This includes, but is not limited to, the scanning of a fingerprint, scanning of one's iris, or other known techniques for biometric identification. The identification of the user to the self-service machine via the biometric device is used, for example, to operatively associate a requested transaction with an account or accounts operatively associated with the user. Thus, following such positive identification, a self-service machine may automatically charge such user's designated account for the creation and delivery of a deliverable currency package to the user. The self-service machine may comprise one or more biometric devices which may include, without limitation, those that obtain biometric readings or measurements from a finger print, facial dimension(s) (e.g., facial recognition), teeth, retinal structure, iris structure, body part dimension(s), vein pattern, vein dimension(s), thermographic pattern, nailbed dimension(s), vocalization, and skin spectral response.

The appended claims reflect certain aspects and combinations of the present concepts, but are not exhaustive of all such aspects and combinations. Further, the present concepts include all possible logical combinations of the claims and of the various claim elements appended hereto, without limitation, within the associated claim sets regardless of the presently indicated dependency.

What is claimed is:

1. A self-service machine comprising:

a controller;

a coin processing module configured to sort coins and to discharge the sorted coins to a selected output destination including being configured to selectively discharge coins of mixed denominations to a mixed coin bin;

the mixed coin bin configured to receive and hold mixed coins received from the coin processing module and to selectively discharge mixed coins held thereby, the mixed coin bin comprising a discharge actuator, controlled by the controller, configured to selectively discharge mixed coins from the coin bin;

at least one secure repurposed coin retrieval area;

a coin repurposing module configured to package coins received from the coin processing module into a deliverable coin package and to output the deliverable coin package to a designated one of the at least one secure repurposed coin retrieval area; and a conveyor system configured to receive mixed coins discharged from the mixed coin bin and securely convey the mixed coins to the coin processing module for reprocessing;

wherein the controller, responsive to an order for a deliverable coin package received through one or more user-interfaces, causes the mixed coin bin discharge actuator to selectively discharge mixed coins from the coin bin to the conveyor system, causes the conveyor system to securely convey the mixed coins received from the mixed coin bin to the coin processing module, causes the coin processing module to sort the mixed coins, outputting coins corresponding to the order for a deliverable coin package to the coin repurposing module and outputting coins not corresponding to the order for the deliverable coin package back to the mixed coin bin, and continuing these acts until the coin processing module outputs to the coin repurposing module coins corresponding to the order for a deliverable coin package, at which point any remaining coins conveyed by the conveyor system and processed by the coin processing module are directed to be output to the mixed coin bin and the coin repurposing module is caused to prepare the deliverable coin package and to output the deliverable coin package to the designated one of the at least one secure repurposed coin retrieval area.

2. The self-service machine according to claim 1, wherein the one or more user-interfaces comprises a user-interface disposed at the self-service machine.

3. The self-service machine according to claim 1, further comprising:

a communication interface configured to communicatively couple the self-service machine to an external device, wherein the one or more user-interfaces comprises a remote user-interface disposed remotely from the self-service machine and communicatively coupled to the self-service machine via the communication interface, such remote user-interface comprising at least one of a workstation, computer, or mobile communication device.

4. The self-service machine according to claim 1, wherein the coin repurposing module is configured to package the coins in a shrink wrapping device and the deliverable coin package comprises a shrink-wrapped coin package.

5. The self-service machine according to claim 1, further comprising:

a bag sealing device, wherein the coin repurposing module is configured to package the coins in one or more sealable bags, and wherein the bag sealing device seals the one or more sealable bags prior to outputting the deliverable coin package.

6. The self-service machine according to claim 5, wherein the bag sealing device comprises at least one of an adhesive sealing device, ultrasonic sealing device, heat sealing device, or mechanical sealing device.

7. The self-service machine according to claim 5, further comprising:

a label printer configured to print a label comprising information relating to the order for the deliverable coin package and to affix the label to the deliverable coin package.

8. The self-service machine according to claim 5, further comprising:

a label printer configured to print information relating to the order for the deliverable coin package on the deliverable coin package.

9. The self-service machine according to claim 1, wherein the at least one secure repurposed coin retrieval area comprises a plurality of repurposed coin retrieval areas disposed in a secured area of the self-service machine wherein access to each of the repurposed coin retrieval areas is through a lockable controlled-access panel specific to each repurposed coin retrieval area, and wherein the controller is configured to generate an access code enabling access to a specified repurposed coin retrieval area to which the deliverable coin package is output responsive to the order for the deliverable coin package, and wherein the lockable controlled-access panel of the specified repurposed coin retrieval area is configured to lock at least following processing of the order for the deliverable coin package and to unlock only following input of the access code via the one or more user-interfaces.

10. The self-service machine according to claim 1, further comprising:

a plurality of intermediate coin holding areas disposed between the coin processing module and the coin repurposing module, wherein the intermediate coin holding areas are each configured to selectively dispense to the coin repurposing module a specified number of and denomination of coins responsive to an instruction from the controller.

11. The self-service machine according to claim 1, further comprising:

a plurality of secure coin cassettes.

12. The self-service machine according to claim 11, wherein the plurality of secure coin cassettes are disposed to dispense coins to the currency repurposing device in specified numbers and denominations responsive to an instruction from the controller.

13. A self-service machine comprising:

a controller;

a coin processing module configured to sort coins and to discharge the sorted coins to a selected output destination;

a mixed coin bin configured to receive and hold mixed coins received from the coin processing module, the coin bin comprising a discharge actuator, controlled by the controller, configured to selectively discharge mixed coins from the coin bin;

a plurality of removable secure coin cassettes; and a conveyor system configured to receive mixed coins discharged from the mixed coin bin and securely convey the mixed coins to the coin processing module for reprocessing;

wherein the controller, responsive to an order for a deliverable coin package received through one or more user-interfaces, causes the mixed coin bin discharge actuator to selectively discharge mixed coins from the coin bin to the conveyor system, causes the conveyor system to securely convey the mixed coins received from the mixed coin bin to the coin processing module, causes the coin processing module to sort the mixed coins, outputting coins corresponding to the order for a deliverable coin package to a selected one of the plurality of removable secure coin cassettes and outputting coins not corresponding to the order for the deliverable coin package back to the mixed coin bin, and continuing these acts until the coin processing module outputs to the selected one of the plurality of removable secure coin cassettes coins corresponding to the order for a deliverable coin package, at which point any remaining coins conveyed by the conveyor system and processed by the coin processing module are directed to be output to the mixed coin bin.

14. The self-service machine according to claim 13, wherein the one or more user-interfaces comprises a user-interface disposed at the self-service machine.

15. The self-service machine according to claim 13, further comprising:

a communication interface configured to communicatively couple the self-service machine to an external device, wherein the one or more user-interfaces comprises a remote user-interface disposed remotely from the self-service machine and communicatively coupled to the self-service machine via the communication interface, such remote user-interface comprising at least one of a workstation, computer, or mobile communication device.

16. A self-service machine according to claim 15, wherein the self-service machine is deployed as part of a self-service system in which one or more states or parameters of the self-service machine or sub-component or sub-system thereof is monitored by a device communicatively coupled to the self-service machine via the communication interface.

* * * * *